US006100207A

United States Patent [19]

Dean et al.

[11] Patent Number: 6,100,207

[45] Date of Patent: Aug. 8, 2000

[54] ABSORBENT HEAD BAND

[75] Inventors: Leron R. Dean; Robert J. Bobalik, both of Kingsport; F. Henry Dillow, Mount Carmel, all of Tenn.

[73] Assignee: Eastman Chemical Company, Kingsport, Tenn.

[21] Appl. No.: 08/383,027

[22] Filed: Feb. 2, 1995

[51] Int. Cl.[7] ..... D04H 1/58

[52] U.S. Cl. ..... 442/350; 442/118; 442/334; 442/352; 2/174; 2/209.3; 2/207; 2/DIG. 1

[58] Field of Search ..... 2/174, 209.3, 207, 2/DIG. 11; 428/288, 296, 297; 442/118, 334, 350, 352

[56] References Cited

U.S. PATENT DOCUMENTS

| | | |
|---|---|---|
| 2,023,279 | 12/1935 | McNutt . |
| 3,015,335 | 1/1962 | Whitman . |
| 3,109,195 | 11/1963 | Combs et al. . |
| 3,121,040 | 2/1964 | Shaw et al. . |
| 3,156,607 | 11/1964 | Strachan . |
| 3,249,669 | 5/1966 | Jamieson . |
| 3,383,276 | 5/1968 | Gould . |
| 3,529,308 | 9/1970 | McBride . |
| 3,623,939 | 11/1971 | One et al. . |
| 3,650,659 | 3/1972 | Stapp . |
| 3,938,522 | 2/1976 | Repke . |
| 4,044,768 | 8/1977 | Mesek et al. . |
| 4,102,340 | 7/1978 | Mesek et al. . |
| 4,179,259 | 12/1979 | Belitsia et al. . |
| 4,282,874 | 8/1981 | Mesek . |
| 4,285,342 | 8/1981 | Mesek . |
| 4,333,463 | 6/1982 | Holtman . |
| 4,481,680 | 11/1984 | Mason et al. . |
| 4,573,986 | 3/1986 | Minetola et al. . |
| 4,654,040 | 3/1987 | Luceri . |
| 4,656,671 | 4/1987 | Manges . |
| 4,681,577 | 7/1987 | Stern et al. . |
| 4,685,914 | 8/1987 | Holtman . |
| 4,707,409 | 11/1987 | Phillips . |
| 4,731,066 | 3/1988 | Korpman . |
| 4,958,385 | 9/1990 | Rushton, Jr. . |
| 5,033,122 | 7/1991 | Smith . |
| 5,133,371 | 7/1992 | Sivess . |
| 5,200,248 | 4/1993 | Thompson et al. . |

FOREIGN PATENT DOCUMENTS

| | | |
|---|---|---|
| 955625 | 1/1950 | France . |
| 870280 | 6/1961 | United Kingdom . |

OTHER PUBLICATIONS

PCT International Publication No. WO 92/00407 Published Jan. 9, 1992.

A. M. Schwartz & F. W. Minor, *J. Coll. Sci.*, 14, 572 (1959).

PCT International Publication No. WO 90/12130 Published Oct. 18, 1990.

*Plastics Finishing and Decoration*, Chapter 4, Ed. Donatas Satas, Van Nostrand Reinhold Company (1986).

*Primary Examiner*—James J. Bell

*Attorney, Agent, or Firm*—Cheryl J. Tubach; Harry J. Gwinnell

[57] ABSTRACT

Disclosed are head bands comprising a sliver of spontaneously wettable staple fibers. The fibers are of an irregular, grooved shape in cross section and are lightly bound together to permit easy separation into suitable lengths for head bands.

8 Claims, 39 Drawing Sheets

Time
t=0
LFA
θ
LFA
LFA
LFA t=t1
LFA
θ
LFA
LFA
LFA t=t2
LFA
θ
LFA
LFA
LFA

MAXIMUM FLUX VS. ADHESION TENSION 150W
75W
5W
60W
50W
30W
1.3W
.5531
5.393
5.531
5.670
6.084

5.393
4.909
4.771
5.047
5.185
5.531
5.669
6.084

.063R
.690
.168
.341
.336
.290
.580
.870
.290
.580
.870

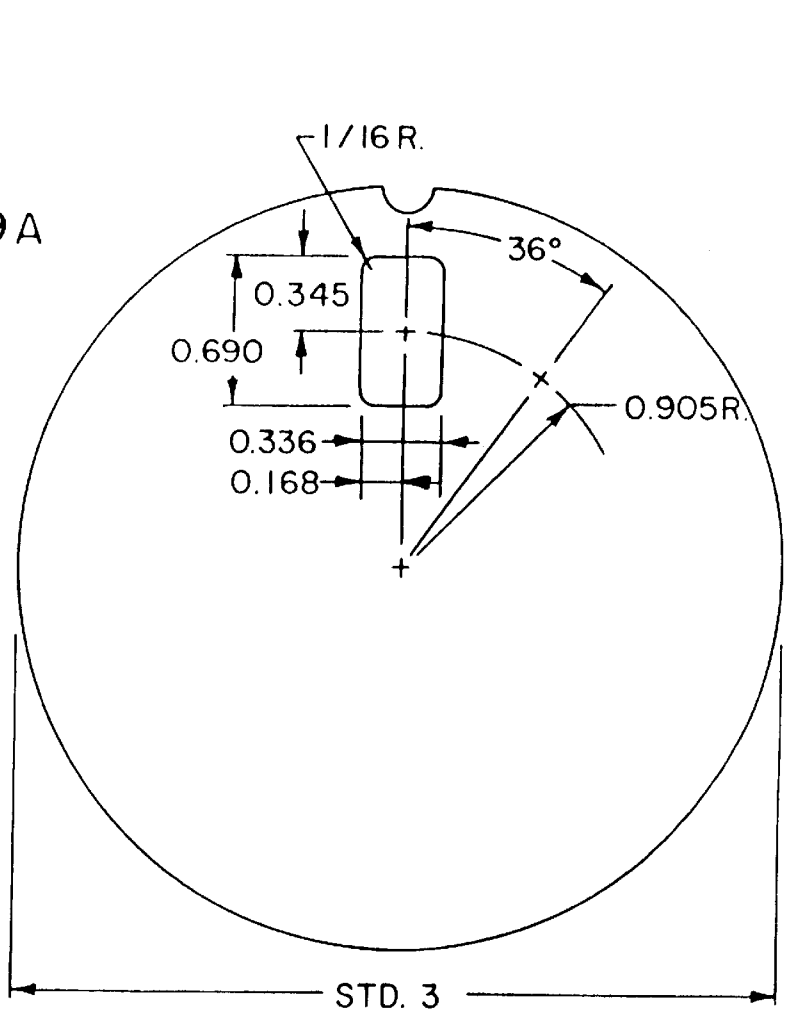
Fig. 29 B
Fig. 29 A
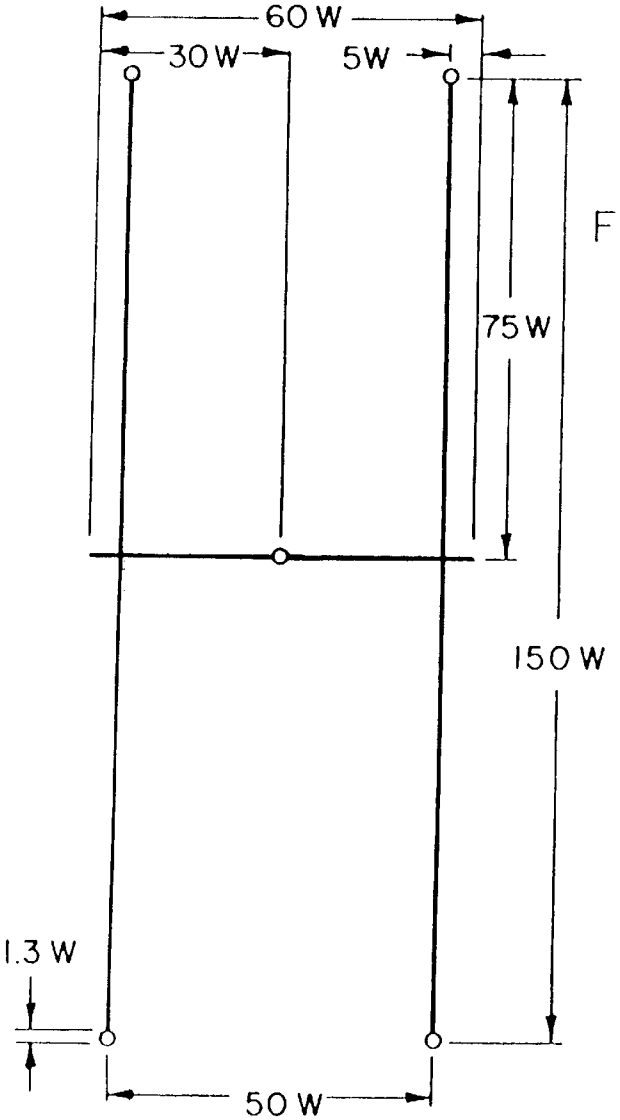

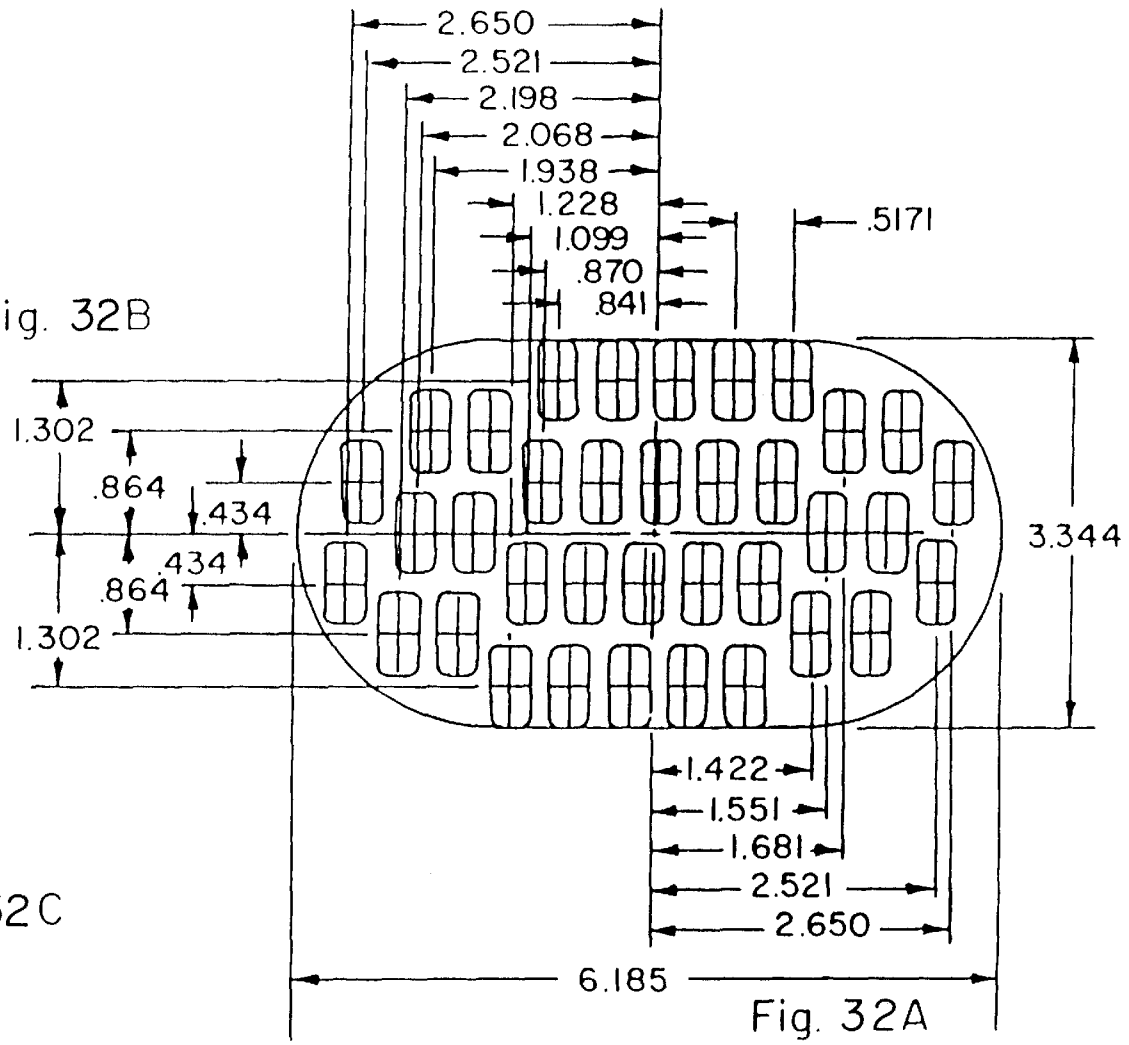
Fig. 32A
Fig. 32B
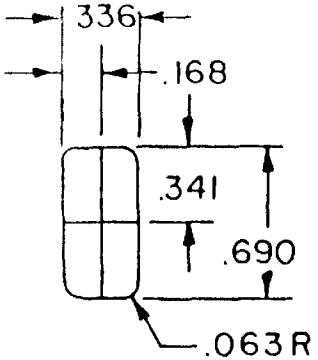
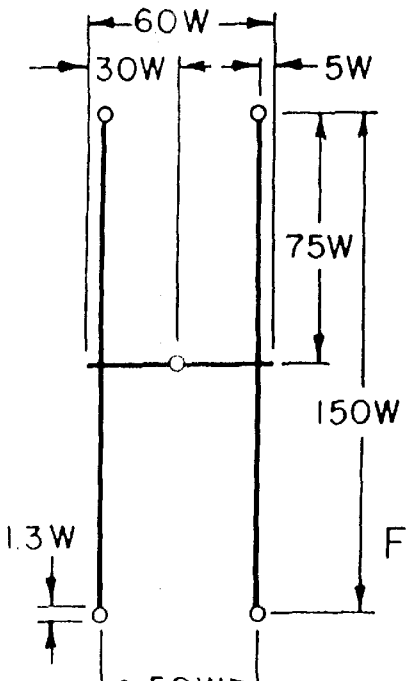
Fig. 32C

ABSORBENT HEAD BAND

TECHNICAL FIELD

The present invention relates to absorbent head bands made of a sliver of spontaneously wettable fibers. The head bands according to this invention are especially useful for protecting human skin and eyes from contact with liquids used in cosmetology.

BACKGROUND OF THE INVENTION

The management of hair involves the use of many fluids which can irritate the eyes and skin. In particular, people may have "permanents" or have their hair colored in some way and these treatments involve the use of potentially irritating fluids. In an attempt to minimize the eye and/or skin irritation from these fluids, absorbent head bands, usually made from cotton or rayon, are wrapped around the head to absorb the excess fluid. These absorbent bands are then discarded after use. Two deficiencies of "cotton" wraps are the fragile nature of band and the inability of the band to remove the fluid from contact with the skin. This invention provides improvements in both of these areas. Current manufactured products are carded cotton sliver which may or may not be reinforced with some means to increase integrity of the sliver.

Patents of interest include U.S. Pat. Nos. 2,023,279; 3,529,308; 4,481,680; 5,133,371; 4,958,385; 4,656,671; 3,015,335 and 5,033,122. None of these patents refer to the use of capillary surface materials in the disclosed inventions.

Fibers useful in the present invention are described in detail in pending U.S. Ser. No. 736,267 filed Jul. 23, 1991; Ser. No. 133,426 filed Oct. 8, 1993, and European Patent No. WO92/00407. Although these documents disclose that the fibers may be used in head bands, they do not disclose the characteristics of the head band now being claimed. Pertinent portions of specifications from these documents are contained in the present specification under the heading "Fibers".

Presently available absorbent articles and the like are generally adequate at absorbing aqueous fluids. However, during typical use such articles become saturated at the impingement zone while other zones removed from the impingement zone will remain dry. As a result, a substantial portion of the total absorbent capabilities of such articles remains unused. Thus, it would be highly desirable to have a means for transporting the aqueous fluids from the impingement zone to other areas of the absorbent article to more fully utilize the article's total absorbent capability. We have discovered such a means by the use of certain fibers that are capable of transporting aqueous fluids on their surfaces.

Liquid transport behavior phenomena in single fibers has been studied to a limited extent in the prior art (see, for example, A. M. Schwartz & F. W. Minor, *J. Coll. Sci.,* 14, 572 (1959)).

There are several factors which influence the flow of liquids in fibrous structures. The geometry of the pore-structure in the fabrics (capillarity), the nature of the solid surface (surface free energy, contact angle), the geometry of the solid surface (surface roughness, grooves, etc.), the chemical/physical treatment of the solid surface (caustic hydrolysis, plasma treatment, grafting, application of hydrophobic/hydrophilic finishes), and the chemical nature of the fluid all can influence liquid transport phenomena in fibrous structures.

French Patent 955,625, Paul Chevalier, "Improvements in Spinning Artificial Fiber", published Jan. 16, 1950, discloses fibers of synthetic origin with alleged improved capillarity. The fibers are said to have continuous or discontinuous grooves positioned in the longitudinal direction.

Also, the art discloses various H-shapes, for example, in the following U.S. Pat. Nos. 3,121,040; 3,650,659; 870,280; 4,179,259; 3,249,669; 3,623,939; 3,156,607; 3,109,195; 3,383,276; 4,707,409.

U.S. Pat. No. 4,707,409 describes a spinneret having an orifice defined by two intersecting slots and each intersecting slot in turn defined by three quadrilateral sections connected in series.

Further, PCT International Publication No. WO90/12/30, published on Oct. 18, 1990, entitled "Fibers Capable of Spontaneously Transporting Fluids" discloses fibers that are capable of spontaneously transporting water on their surfaces and useful structures made from such fibers.

We have discovered head bands of particular fibers that have a unique combination of properties that allows for spontaneous transport of aqueous fluids such as water on their surfaces.

DESCRIPTION OF THE INVENTION

The present invention provides an absorbent head band for protecting skin and eyes from irritation or other unpleasant sensations caused by contact with liquids used in cosmetology comprising a sliver of spontaneously wettable fibers, the sliver having a size of about 30,000–100,000 denier, the fibers of the sliver being held together by a binder such as to have a tensile strength of between 100 and 2,000 grams, the fibers having a denier per filament (dpf) of about 3–30, a staple length of about 1½–6 inches, a shape factor of about 1.5–5 and a maximum potential flux of at least 75 cc/g/hr when measured using a liquid having a surface tension of about 60–65 dynes/cm and a viscosity of about 1 cp.

Headband Description

The head bands according to the present invention comprise a sliver of spontaneously wettable fibers. By the term "sliver", we mean a continuous length of carded fibers arranged in a generally parallel relationship, the sliver being about 30,000–100,000 denier, and preferably about 40,000–60,000 denier. The fibers have a staple length of about 1½–6 inches, preferably about 2–3, and are lightly bound together by a binder such that the sliver has a tensile strength of about 100–2000 grams, preferably about 100–1000 grams. Tensile strength of the sliver is important in permitting portions of it, of suitable length to form an individual headband, to be pulled apart from a larger length with a minimum of effort.

The binder used in the head bands of this invention may be any of those well known in the art, such as a powder or preferably, a binder fiber. It is relatively low melting, such that it can be melted or converted to a sticky state well below the melting point of the spontaneously wettable fibers in the head band. It is important that the binder result in a tensile strength as described so that the sliver has the required integrity but, at the same time, can easily be torn by the user from a continuous length at convenient point for particular requirements. Suitable binders include polyester binder fibers used in amounts of about 2–15%, based on the weight of the sliver.

The fibers in the sliver are spontaneously wettable, i.e., they have a shape factor of about 1.5–5 and a maximum potential flux of at least 75 cc/g/hr when measured using a liquid having a surface tension of about 60–65 dynes/cm and a viscosity of about 1 cp. The preferred liquid used for this measurement is an easily visible liquid such as Syltint Poly Red tint solution from Milliken which has a surface tension of about 62 dynes/cm.

Fiber Description

The fibers useful in the present invention satisfy the following equation $$(1-X\cos\theta_a)<0,$$

wherein $\theta_a$ is the advancing contact angle of water measured on a flat film made from the same material as the fiber and having the same surface treatment, if any, X is a shape factor of the fiber cross-section that satisfies the following equation $$x=\frac{P_w}{4r+(\pi-2)D}$$

wherein $P_w$ is the wetted perimeter of the fiber and r is the radius of the circumscribed circle circumscribing the fiber cross-section and D is the minor axis dimension across the fiber cross-section.

The fibers useful in the present invention preferably satisfy the equation $$(1-X\cos\theta_a)<-0.7,$$

wherein $\theta_a$ is the advancing contact angle of water measured on a flat film made from the same material as the fiber and having the same surface treatment, if any, X is a shape factor of the fiber cross-section that satisfies the following equation $$x=\frac{P_w}{4r+(\pi-2)D}$$

wherein $P_w$ is the wetted perimeter of the fiber and r is the radius of the circumscribed circle circumscribing the fiber cross-section and D is the minor axis dimension across the fiber cross-section.

The present invention also further provides a head band using synthetic fibers which are capable of spontaneously transporting water on the surface thereof wherein said fiber satisfies the equation $$(1-X\cos\theta_a)<0,$$

wherein $\theta_a$ is the advancing contact angle of water measured on a flat film made from the same material as the fiber and having the same surface treatment, if any, X is a shape factor of the fiber cross-section that satisfies the following equation $$x=\frac{P_w}{4r+(\pi-2)D}$$

wherein $P_w$ is the wetted perimeter of the fiber and r is the radius of the circumscribed circle circumscribing the fiber cross-section and D is the minor axis dimension across the fiber cross-section, and wherein the maximum potential flux of said fiber is at least 75 cc/g/hr when measured using a liquid having a surface tension of about 60–65 dynes/cm$^2$ and a viscosity of about 1 cp.

It is preferred that X is greater than 1.2, preferably between about 1.2 and about 5, most preferably between about 1.5 and about 3.

Further, it is preferred that the fiber has a hydrophilic lubricant coated on the surface thereof.

Fibers useful in the present invention are also described in Thompson U.S. Pat. No. 5,200,248, incorporated herein by reference.

BRIEF DESCRIPTION OF THE DRAWINGS

FIG. 18B—a schematic representation of a desirable groove in a fiber cross-section.

FIG. 18C—a schematic representation of a desirable groove in a fiber cross-section illustrating the groove completely filled with fluid.

FIG. 19B—a schematic representation of a groove where bridging is possible in the fiber cross-section.

FIG. 19C—a schematic representation of a groove illustrating bridging of the groove by a fluid.

FIGS. 29A and 29B—a schematic representation of Spinneret I1039 wherein the spinneret holes are oriented in a radial pattern on the face of the spinneret. All dimensions are in units of inches except those containing the letter "W".

FIGS. 32A, 32B and 32C—a schematic representation of Spinneret I 1046 wherein the spinneret holes are oriented such that the cross-flow quench air is directed toward the open end of the H.

The three important variables fundamental to the liquid transport behavior are (a) wettability or the contact angle of the liquid with the solid, (b) surface tension of the liquid, and (c) the geometry of the solid surface.

Figures 1A, 1B, 1C, 2A, 2B, 2C:
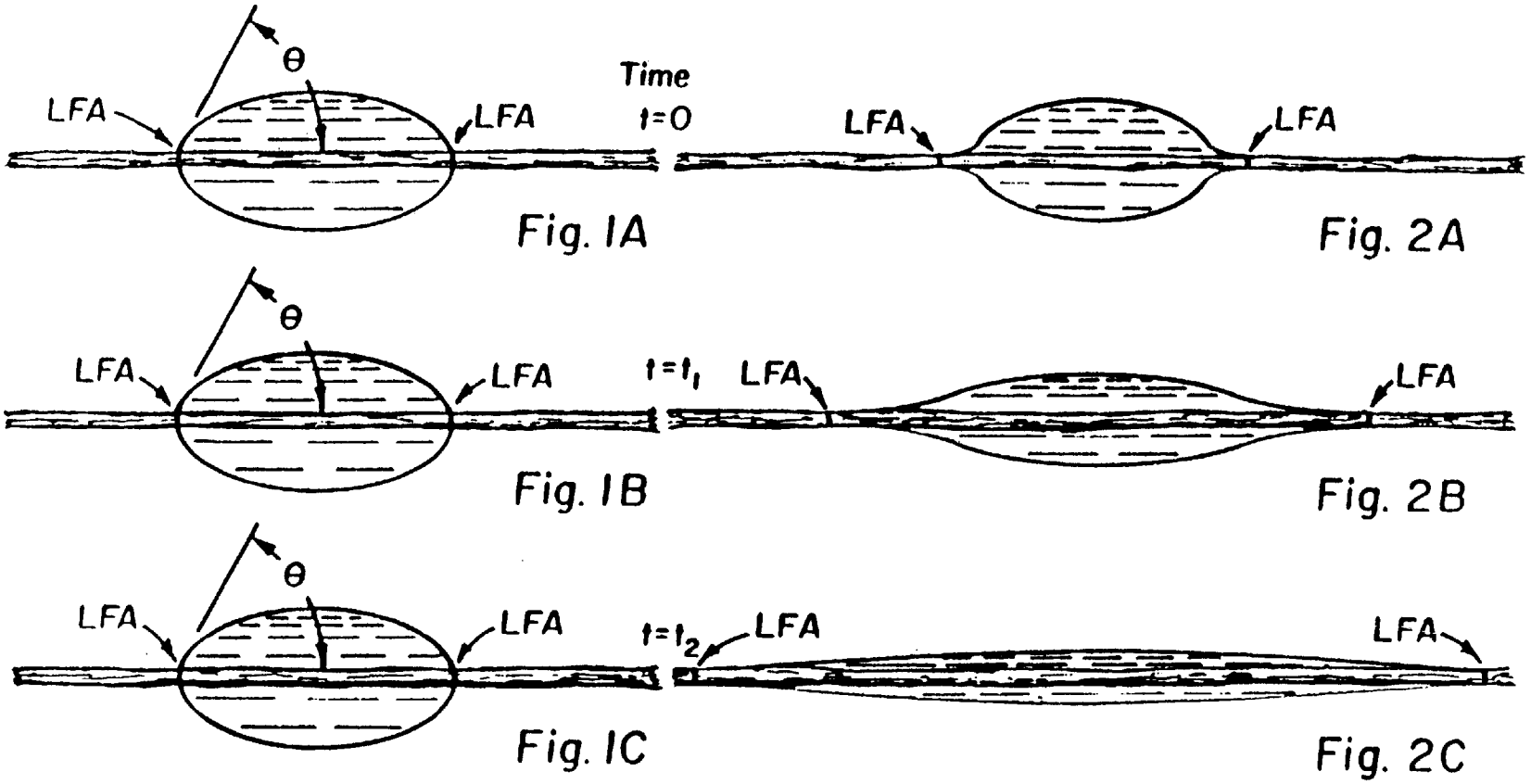
FIG. 1A—illustration of the behavior of a drop of an aqueous fluid on a conventional fiber that is not spontaneously transportable after the ellipsoidal shape forms (t=0). Angle θ illustrates a typical contact angle of a drop of liquid on a fiber. The arrows labelled "LFA" indicate the location of the liquid-fiber-air interface.
FIG. 1B—illustration of the behavior of a drop of an aqueous fluid on a conventional fiber that is not spontaneously transportable at time=$t_1$ ($t_1$>0). The angle θ remains the same as in FIG. 1A. The arrows labelled "LFA" indicate the location of the liquid-fiber-air interface.
FIG. 1C—illustration of the behavior of a drop of an aqueous fluid on a conventional fiber that is not spontaneously surface transportable at time=$t_2$ ($t_2$>$t_1$). The angle θ remains the same as in FIG. 1A. The arrows labelled "LFA" indicate the location of the liquid-fiber-air interface.
FIG. 2A—illustration of the behavior of a drop of an aqueous fluid which has just contacted a fiber that is spontaneously transportable at time=0. The arrows labelled "LFA" indicate the location of the liquid-fiber-air interface.
FIG. 2B—illustration of the behavior of a drop of an aqueous fluid on a fiber that is spontaneously transportable at time=$t_1$ ($t_1$>0). The arrows labelled "LFA" indicate the location of the liquid-fiber-air interface.
FIG. 2C—illustration of the behavior of a drop of an aqueous fluid on a fiber that is spontaneously transportable at time=$t_2$ ($t_2$>$t_1$). The arrows labelled "LFA" indicate the location of the liquid-fiber-air interface.

Typically, the wettability of a solid surface by a liquid can be characterized by the contact angle that the liquid surface (gas-liquid interface) makes with the solid surface (gas-solid surface). Typically, a drop of liquid placed on a solid surface makes a contact angle, θ, with the solid surface, as seen in FIG. 1A. If this contact angle is less than 90°, then the solid is considered to be wet by the liquid. However, if the contact angle is greater than 90°, such as with water on Teflon surface, the solid is not wet by the liquid. Thus, it is desired to have a minimum contact angle for enhanced wetting, but definitely, it must be less than 90°. However, the contact angle also depends on surface inhomogeneities (chemical and physical, such as roughness), contamination, chemical/physical treatment of the solid surface, as well as the nature of the liquid surface and its contamination. Surface free energy of the solid also influences the wetting behavior. The lower the surface energy of the solid, the more difficult it is to wet the solid by liquids having high surface tension. Thus, for example, Teflon, which has low surface energy does not wet with water. (Contact angle for Teflon-water system is 112°.) However, it is possible to treat the surface of Teflon with a monomolecular film of protein, which significantly enhances the wetting behavior. Thus, it is possible to modify the surface energy of fiber surfaces by appropriate lubricants/finishes to enhance liquid transport. The contact angle of polyethylene terephthalate (PET), Nylon 66, and polypropylene with water is 80°, 71°, and 108°, respectively. Thus, Nylon 66 is more wettable than PET. However, for polypropylene, the contact angle is >90°, and thus is non-wettable with water.

Another property of fundamental importance to the phenomena of liquid transport is the geometry of the solid surface. Although it is known that grooves enhance fluid transport in general, we have discovered particular geometries and arrangements of deep and narrow grooves on fibers and treatments thereof which allow for the spontaneous surface transport of aqueous fluids in single fibers. Thus we have discovered fibers with a combination of properties wherein an individual fiber is capable of spontaneously transporting water on its surface.

Figure 18A:
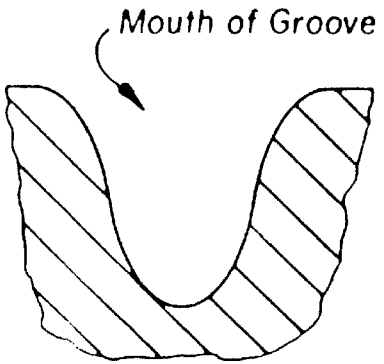
FIG. 18A—a schematic representation of a desirable groove in a fiber cross-section.
Figure 18B:
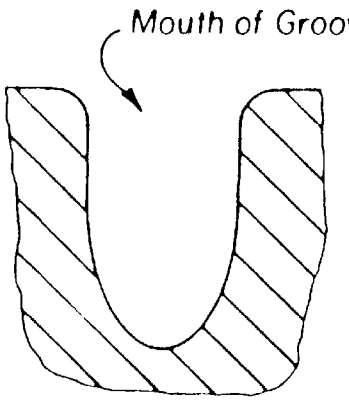
Figure 18C:
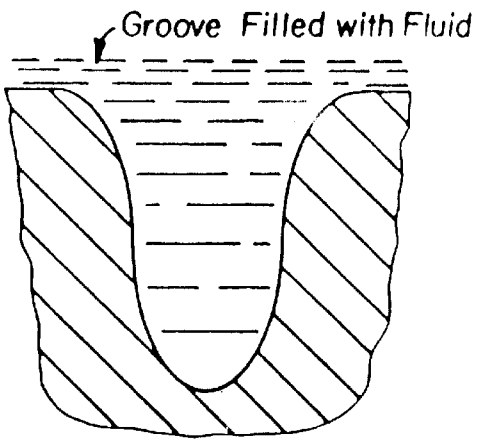
Figure 19A:
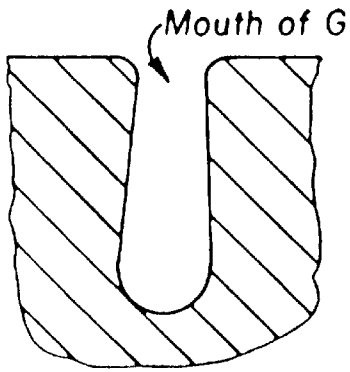
FIG. 19A—a schematic representation of a groove where bridging is possible in the fiber cross-section.
Figure 19B:
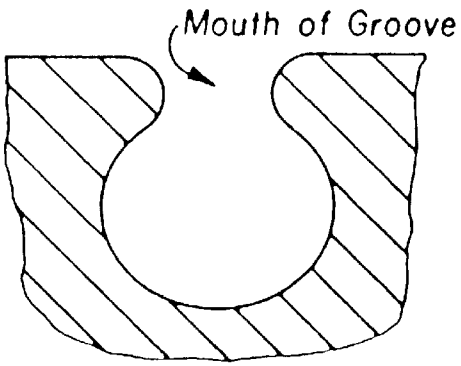
Figure 19C:
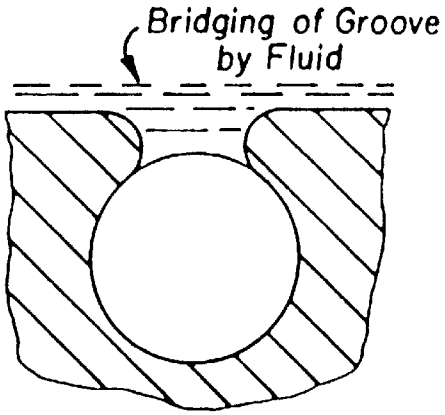

The particular geometry of the deep and narrow grooves is very important. For example, as shown in FIGS. 18A, 18B and 18C, grooves which have the feature that the width of the groove at any depth is equal to or less than the width of the groove at the mouth of the groove are preferred over those grooves which do not meet this criterion (e.g., grooves as shown in FIGS. 19A, 19B and 19C). If the preferred groove is not achieved, "bridging" of the liquid across the restriction is possible and thereby the effective wetted perimeter (Pw) is reduced. Accordingly, it is preferred that Pw is substantially equal to the geometric perimeter.

"Spontaneously transportable" and derivative terms thereof refer to the behavior of a fluid in general and in particular a drop of fluid, typically water, when it is brought into contact with a single fiber such that the drop spreads along the fiber. Such behavior is contrasted with the normal behavior of the drop which forms a static ellipsoidal shape with a unique contact angle at the intersection of the liquid and the solid fiber. It is obvious that the formation of the ellipsoidal drop takes a very short time but remains stationary thereafter. FIGS. 1A–1C and 2A–2C illustrate the fundamental difference in these two behaviors. Particularly, FIGS. 2A, 2B, and 2C illustrate spontaneous fluid transport on a fiber surface. The key factor is the movement of the location of the air, liquid, solid interface with time. If such interface moves just after contact of the liquid with the fiber, then the fiber is spontaneously transportable; if such interface is stationary, the fiber is not spontaneously transportable. The spontaneously transportable phenomenon is easily visible to the naked eye for large filaments [>20 denier per filament (dpf)] but a microscope may be necessary to view the fibers if they are less than 20 dpf. Colored fluids are more easily seen but the spontaneously transportable phenomenon is not dependent on the color. It is possible to have sections of the circumference of the fiber on which the fluid moves faster than other sections. In such case the air, liquid, solid interface actually extends over a length of the fiber. Thus, such fibers are also spontaneously transportable in that the air, liquid, solid interface is moving as opposed to stationary.

Spontaneous transportability is basically a surface phenomenon; that is the movement of the fluid occurs on the surface of the fiber. However, it is possible and may in some cases be desirable to have the spontaneously transportable phenomenon occur in conjunction with absorption of the fluid into the fiber. The behavior visible to the naked eye will depend on the relative rate of absorption vs. spontaneous transportability. For example, if the relative rate of absorption is large such that most of the fluid is absorbed into the fiber, the liquid drop will disappear with very little movement of the air, liquid, solid interface along the fiber surface whereas if the rate of absorption is small compared to the rate of spontaneous transportability the observed behavior will be like that depicted in FIGS. 2A through 2C. In FIG. 2A, a drop of aqueous fluid is just placed on the fiber (time=0). In FIG. 2B, a time interval has elapsed (time=$t_1$) and the fluid starts to be spontaneously transported. In FIG. 2C, a second time interval has passed (time=$t_2$) and the fluid has been spontaneously transported along the fiber surface further than at time=$t_1$.

It has also been discovered that for a given vertical distance and linear distance to move the fluid, a given channel depth and a given adhesion tension, there is an optimum channel width which maximizes the uphill flux of the liquid being transported.

Figure 26:
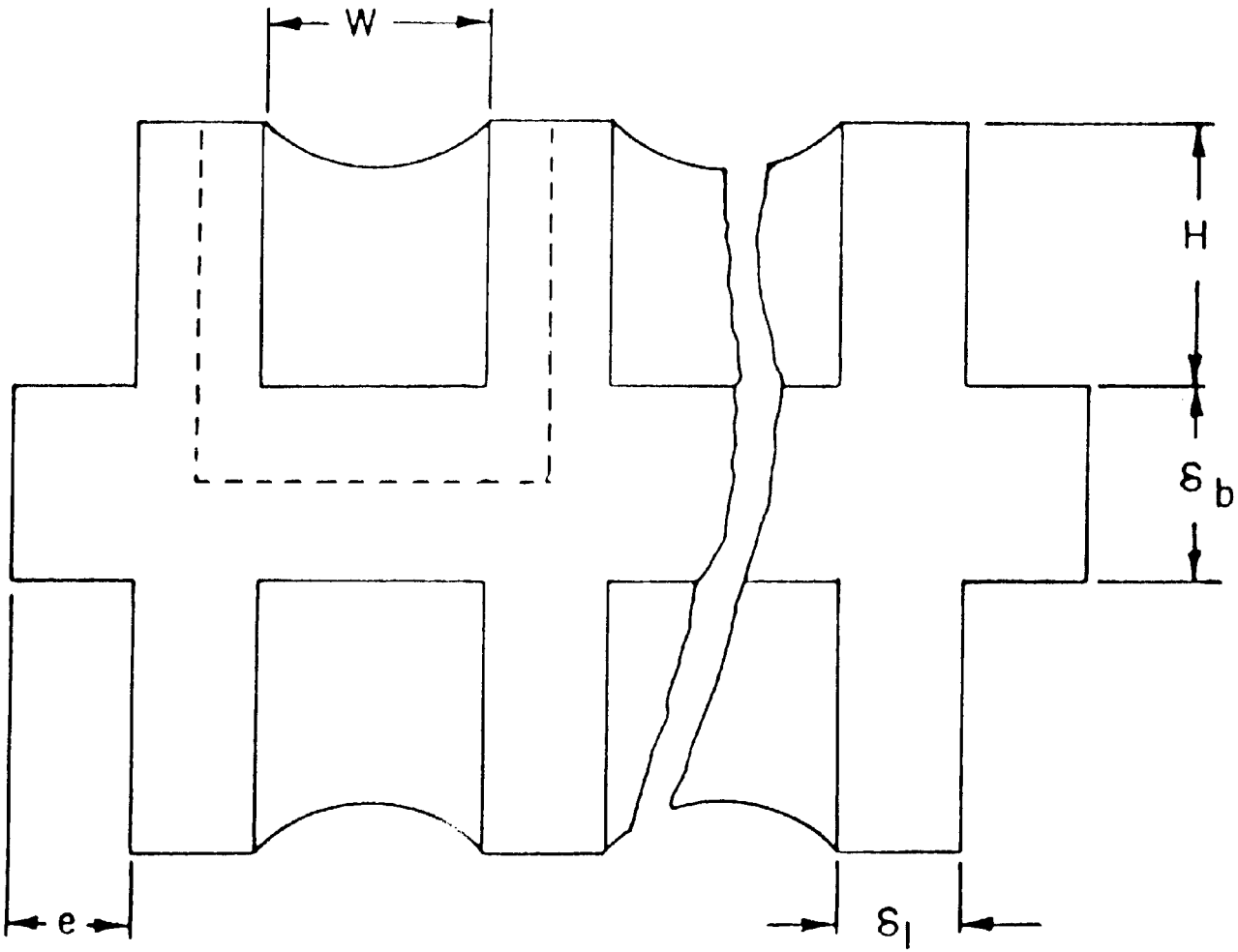
FIG. 26—a schematic representation depicting a unit cell.
Figure 27B:
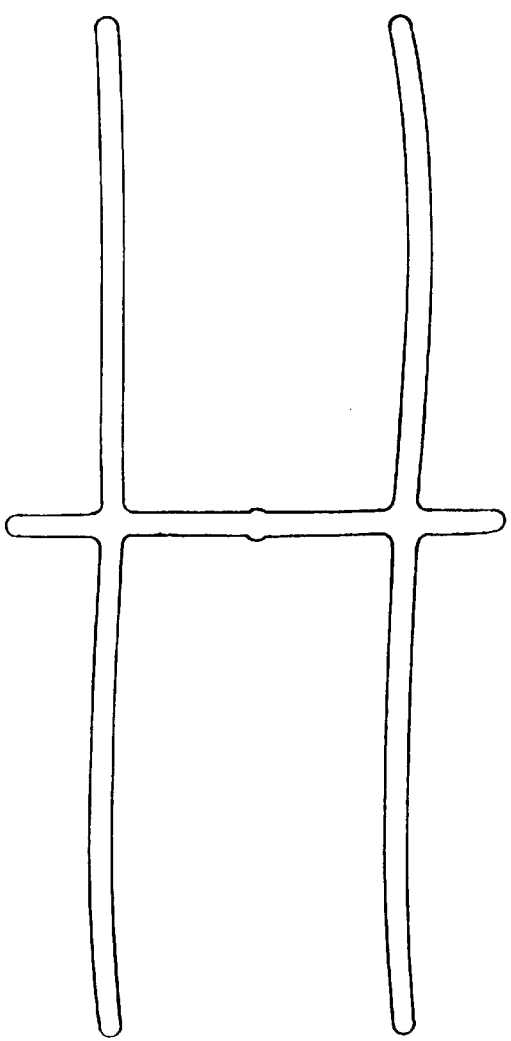
FIGS. 27A and 27B—a schematic representation of a spinneret having dimensions as specified.
Figure 27A:
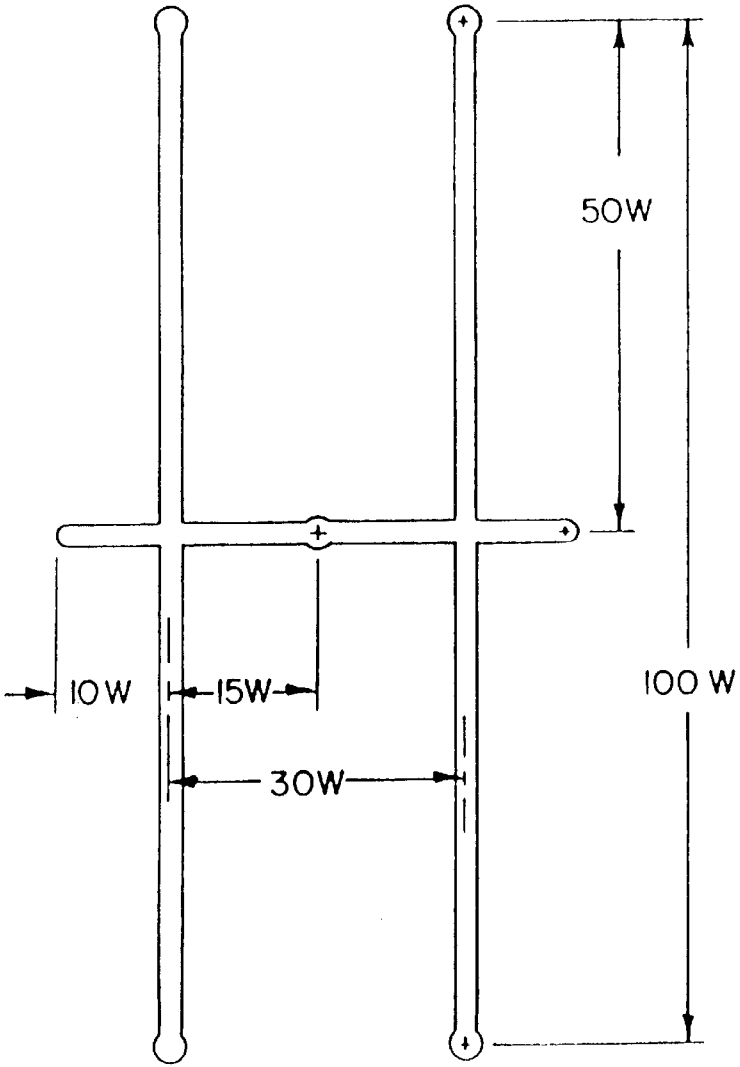
Figures 28A, 28B, 28C:
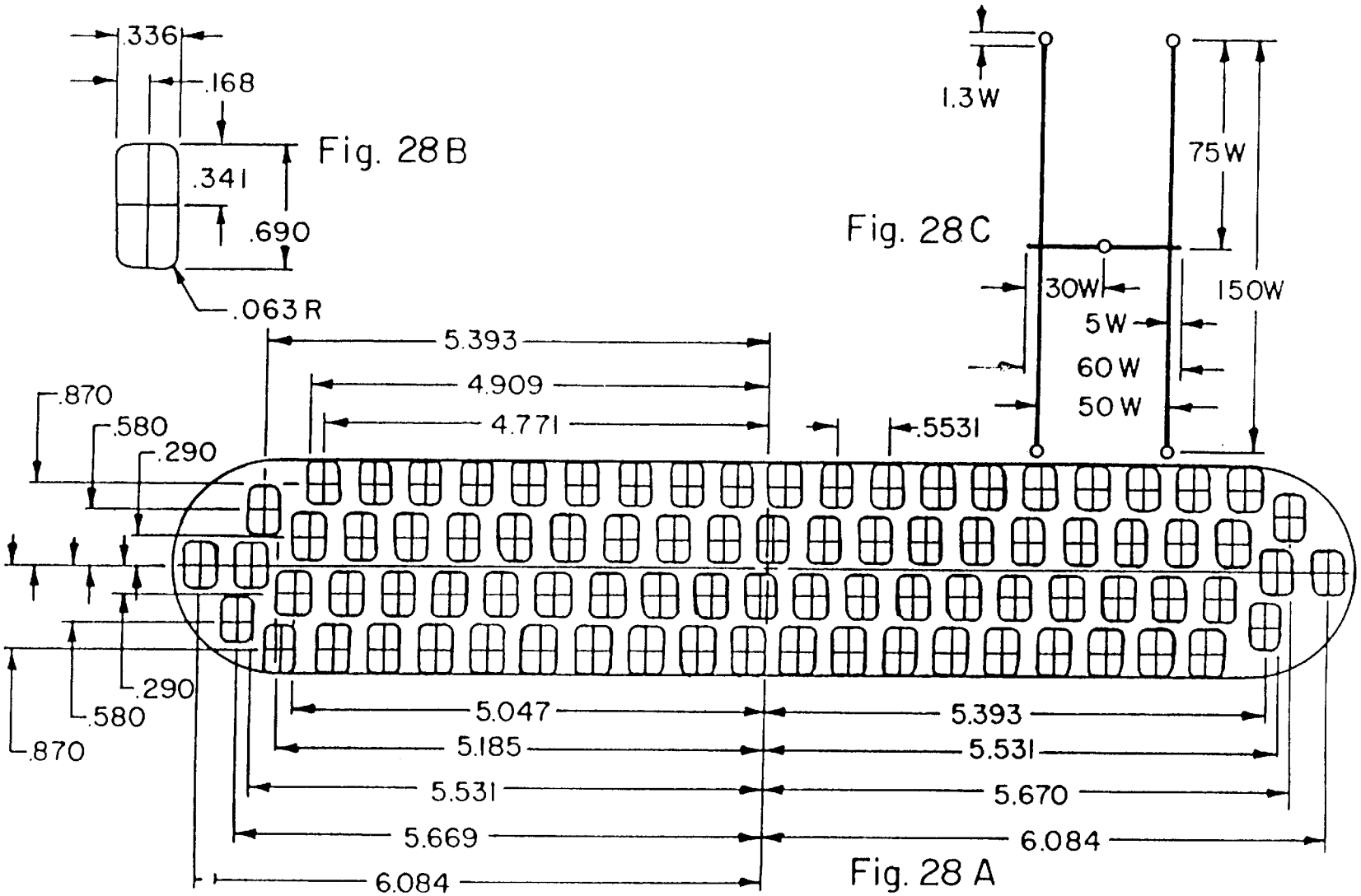
FIGS. 28A and 28B—a schematic representation of Spinneret I1045 wherein the spinneret holes are oriented such that the cross-flow quench air is directed toward the open end of the H. All dimensions are in units of inches except those containing the letter "W".
Figure 30:
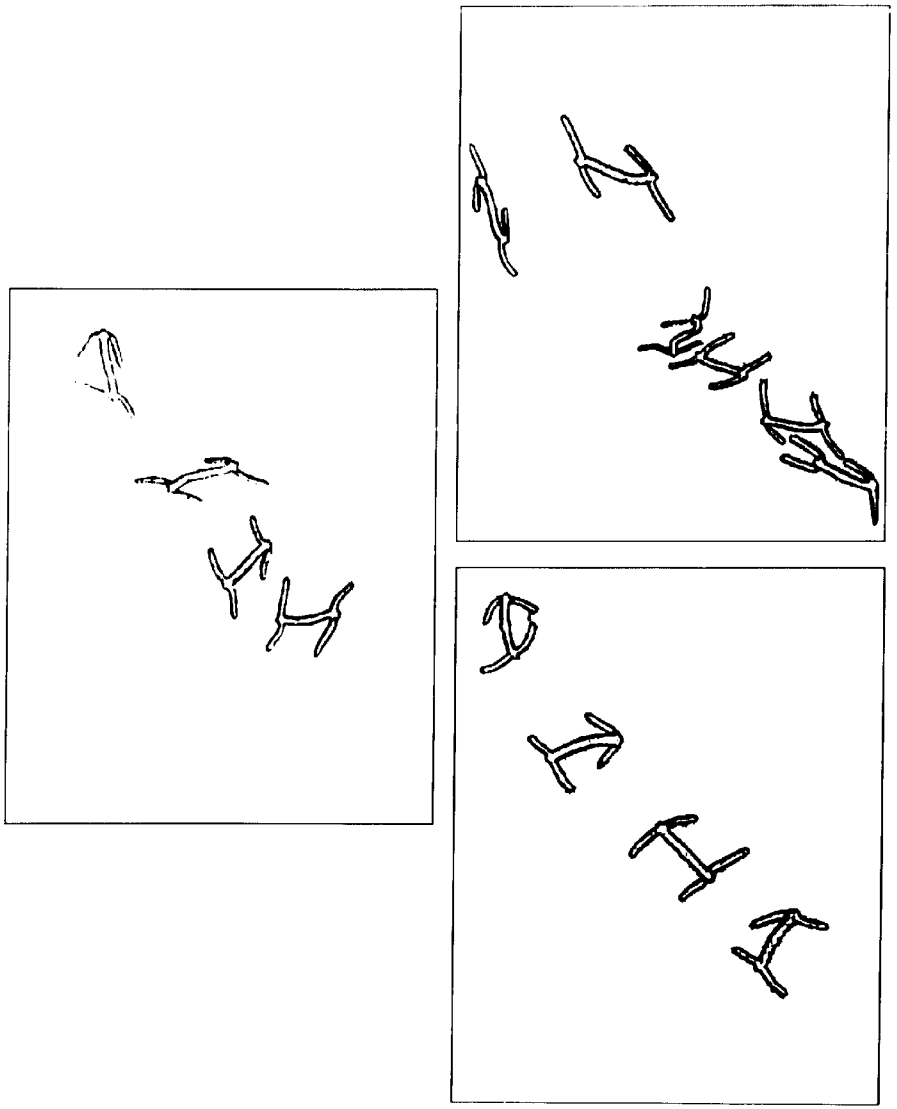
FIG. 30—a photomicrograph of stuffer box crimped fiber having a distorted cross-section.
Figure 31:
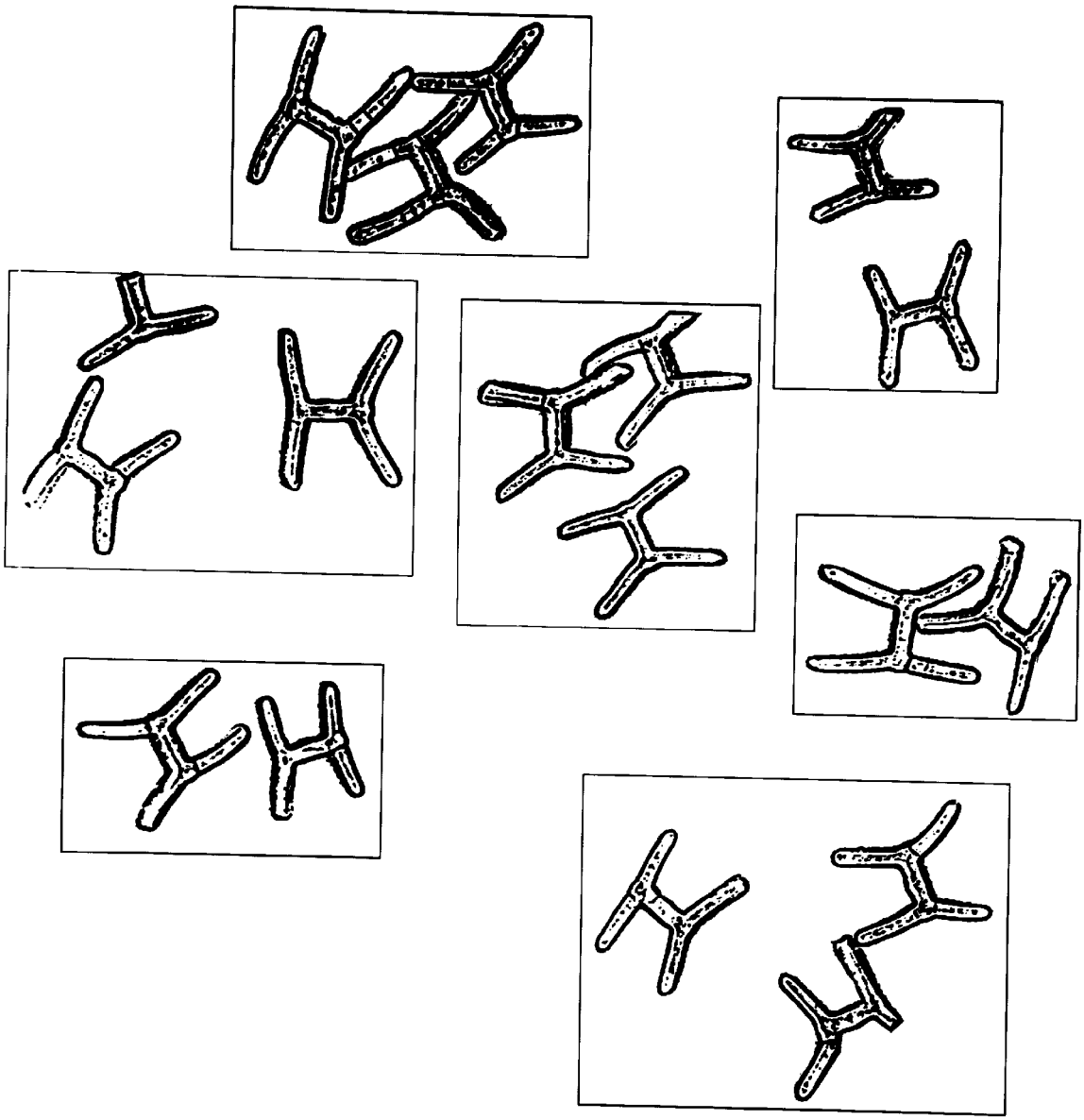
FIG. 31—a photomicrograph of a cross-section of a helically crimped fiber formed by the process of helically crimping a fiber of this invention wherein the fiber cross-section is not distorted.
Figure 33:
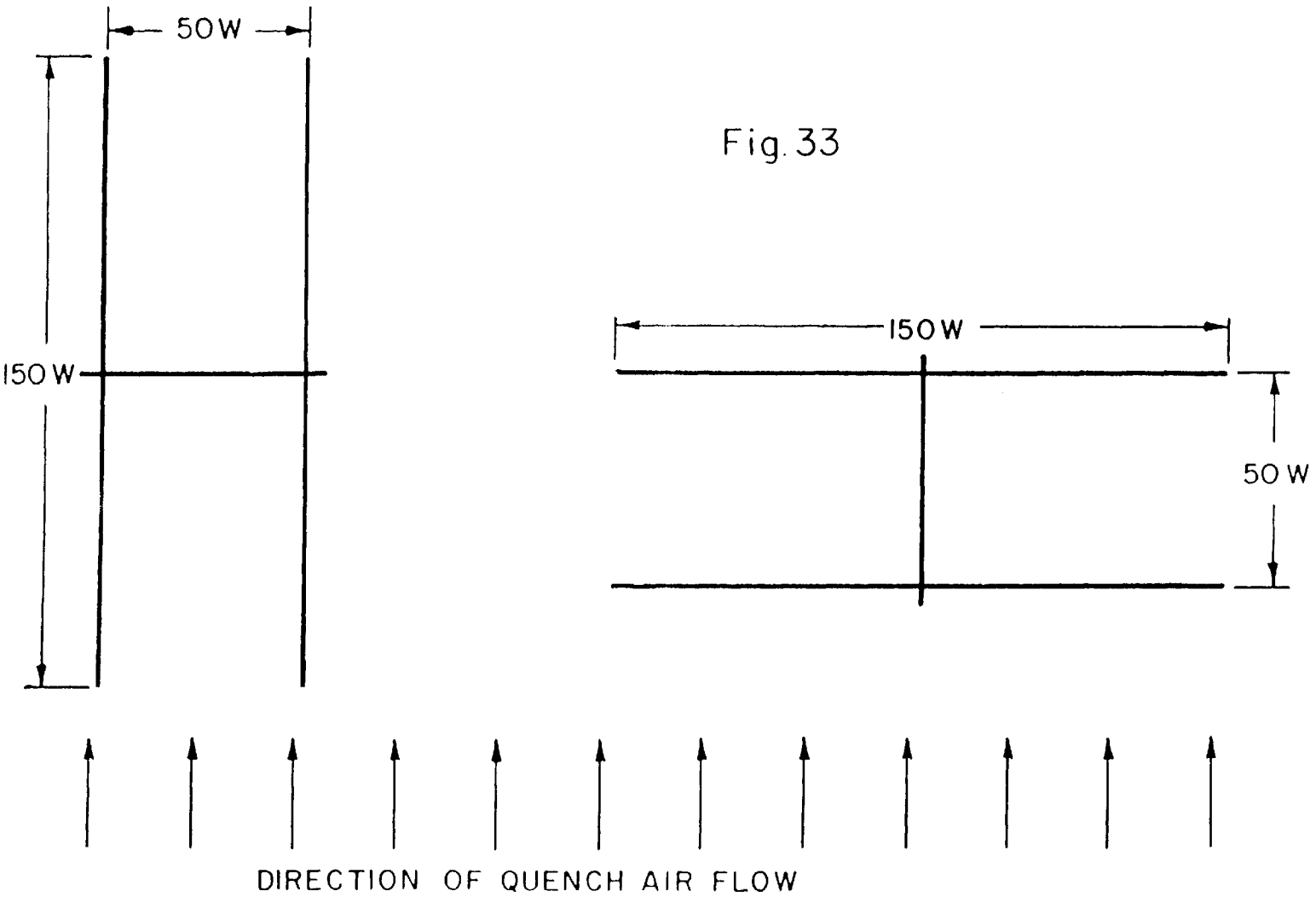
FIG. 33—a schematic representation of quench air direction relative to the spinneret holes.
Figures 34A, 34B, 34C:
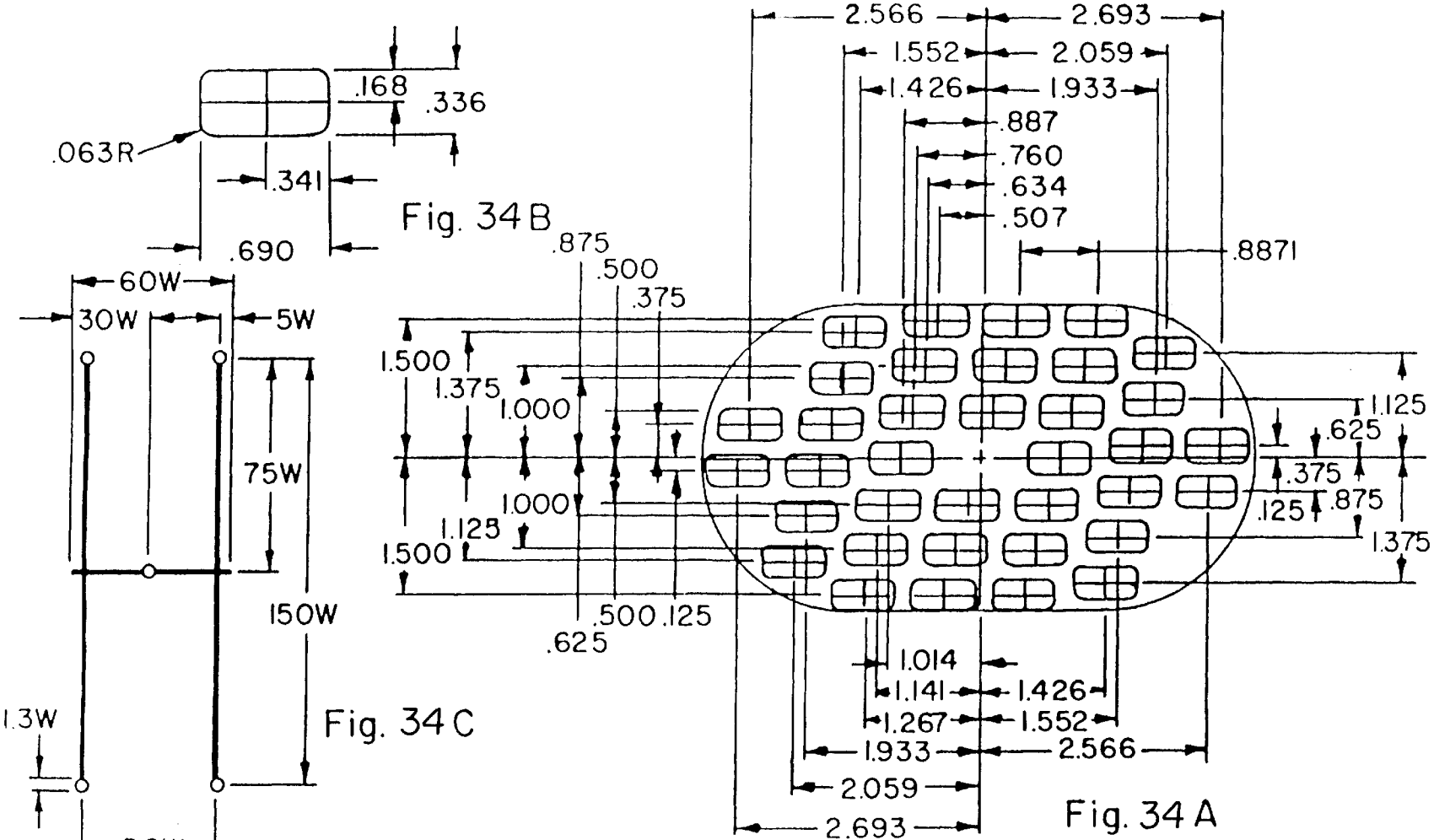
FIGS. 34A, 34B and 34C—a schematic representation of Spinneret 1047 wherein spinneret holes are oriented such that the cross-flow quench air was directed toward one side of the H.
Figure 35:
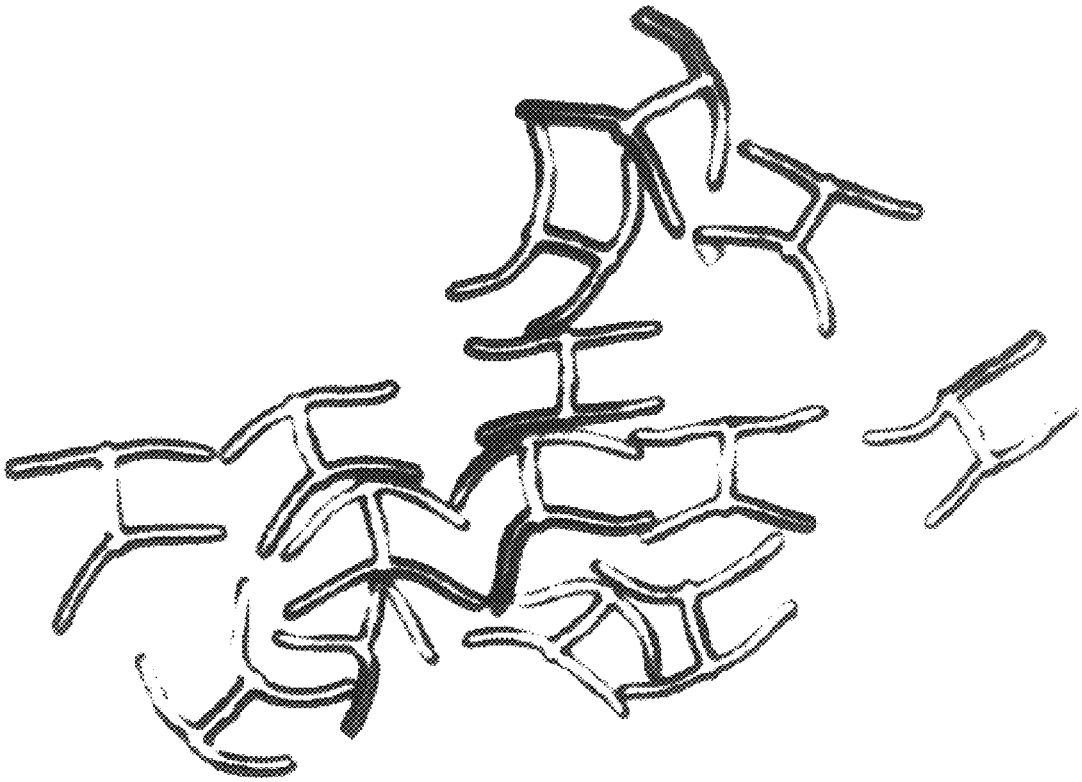
FIG. 35—a photomicrograph of helically crimped fibers of the invention without a distorted cross-section.
Figure 36:
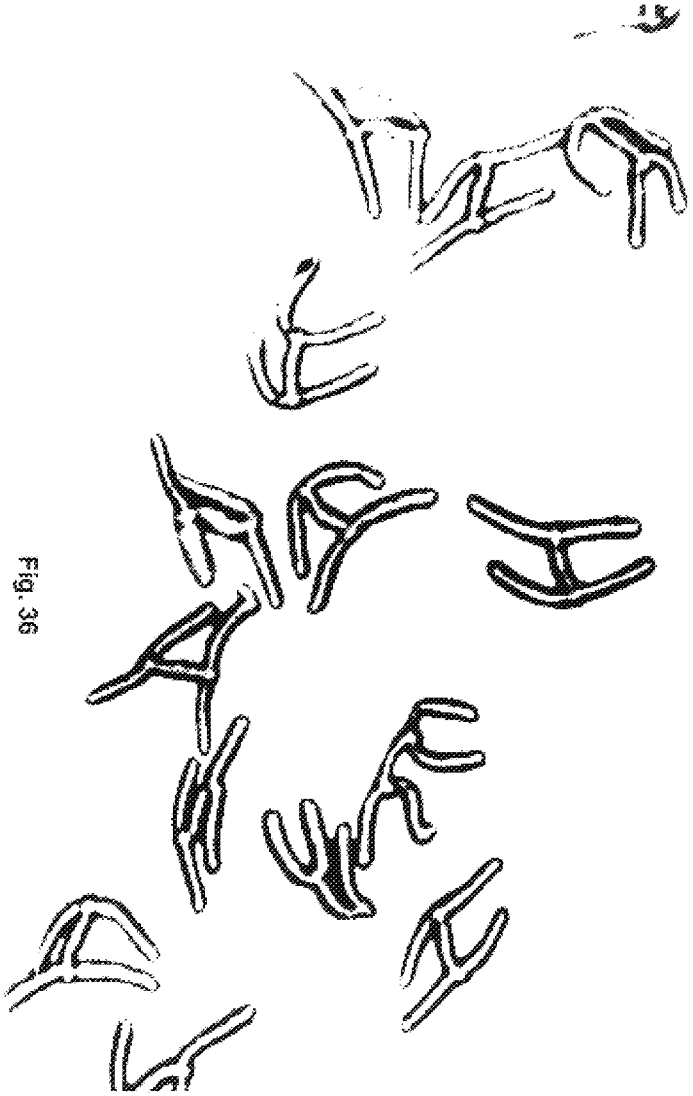
FIG. 36—a photomicrograph of stuffer box crimped fiber having a distorted cross-section.
Figure 37A:
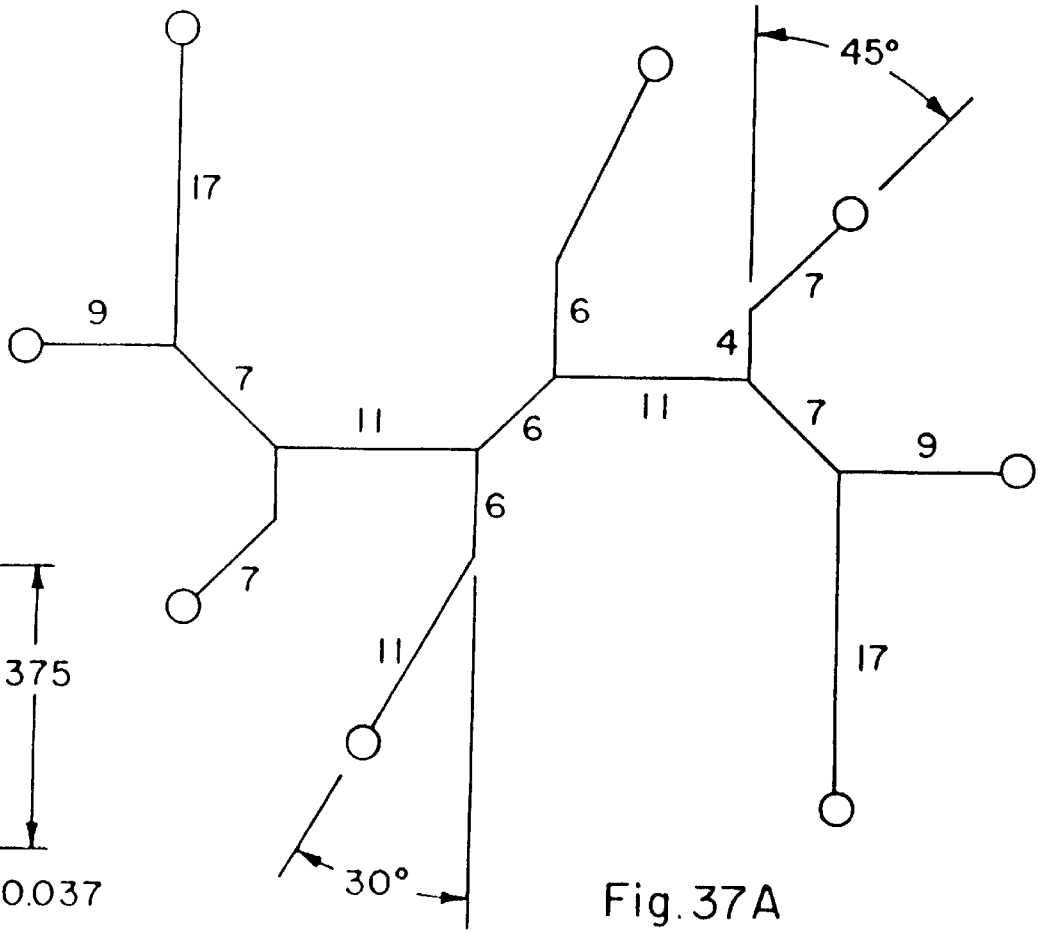
FIGS. 37A, 37B and 38—a schematic representation of a spinneret wherein the spinneret holes are oriented in a diagonal pattern on the face of the spinneret with cross-flow quenching directed toward the fiber bundle.
Figure 37B:
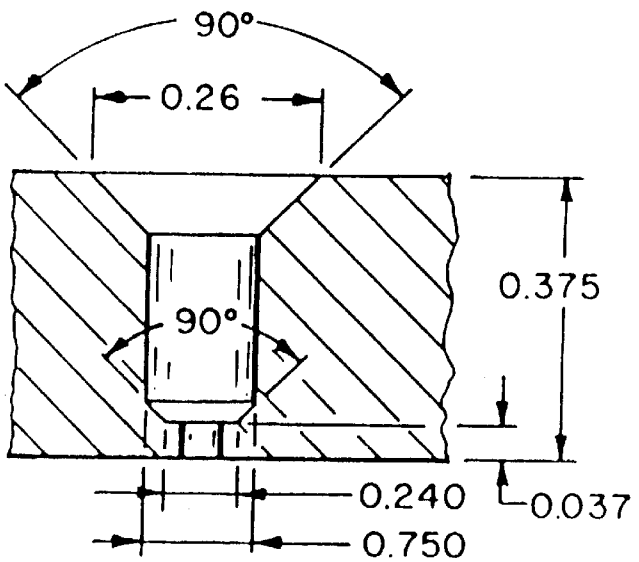
Figure 38:
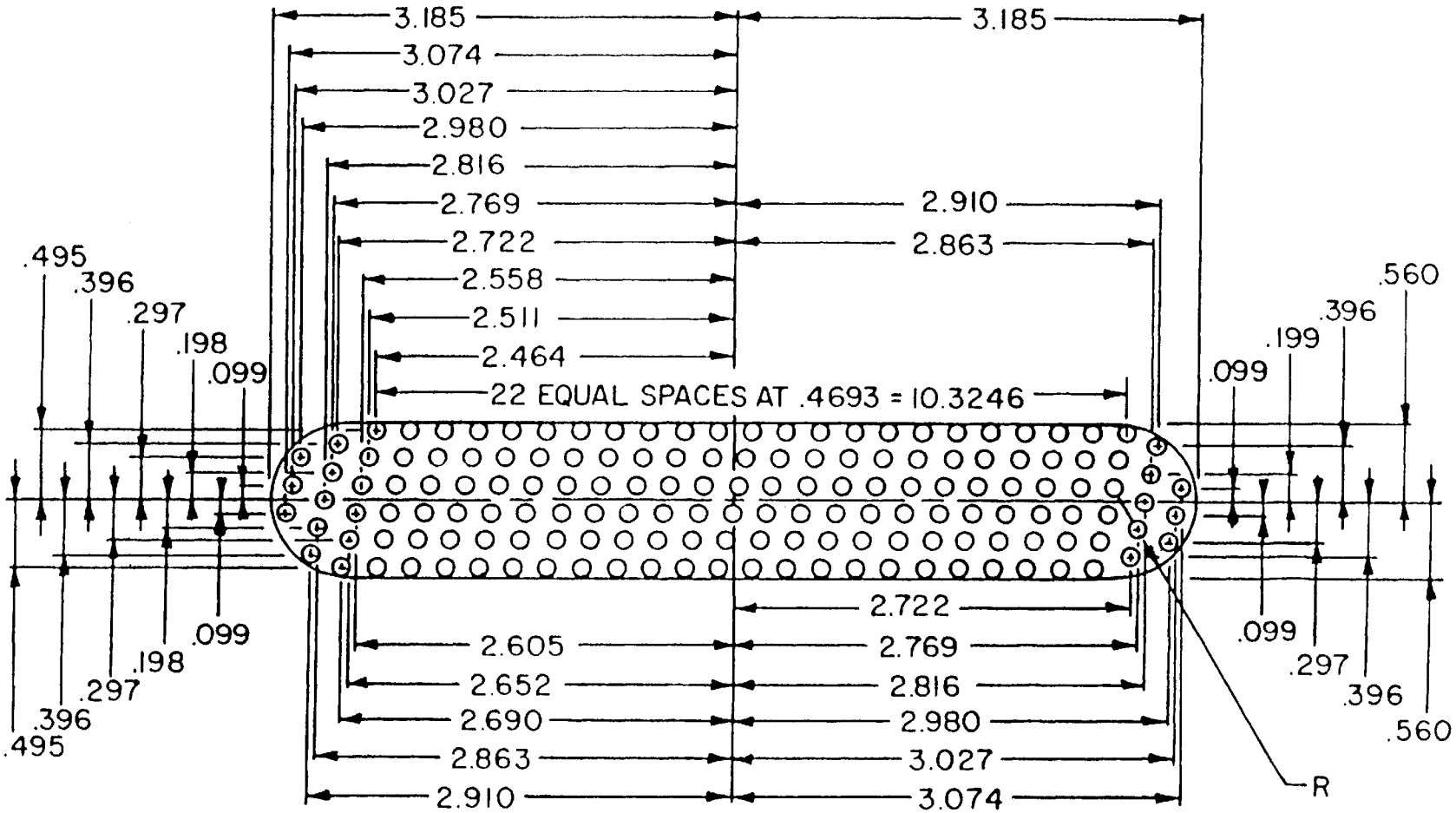
Figure 39:
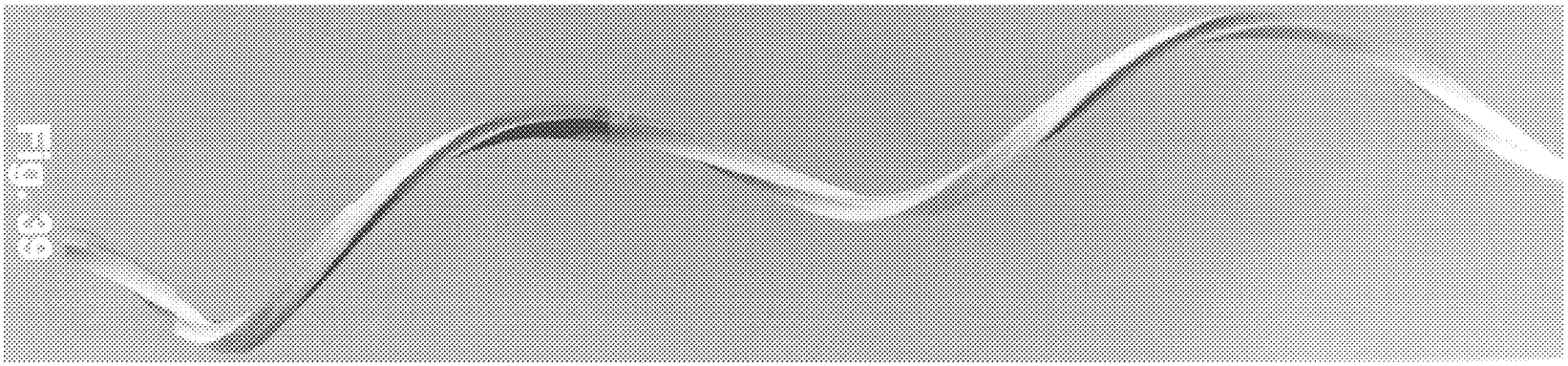
FIG. 39—a photomicrograph of a helically crimped fiber prepared by the process of the invention.

A fiber of the invention can be characterized as having one or more "channels" or "unit cells". For example, the fiber cross-section shown in FIG. 26 depicts a unit cell. A unit cell is the smallest effective transporting unit contained within a fiber. For fibers with all grooves identical, the total fiber is the sum of all unit cells. In FIG. 26 each unit cell has a height, H, and a width, W. $S_l$ is the leg thickness and $S_b$ is the backbone thickness. In addition to the specific dimensions of W and H, the other dimensional parameters of the cross-section are important for obtaining the desired type of spontaneous transportability. For example, it has been found that the number of channels and the thickness of the areas between unit cells, among other things, are important for optimizing the maximum potential flux of the fiber. For obtaining a fiber cross-section of desirable or optimal fluid movement properties the following equations are useful:

$$q = \frac{W^2}{K\mu M_f} \cdot \frac{1}{l}\left(\alpha\gamma p\cos\theta - \beta\gamma\omega - \frac{\rho g h}{g_c}A\right) \times 3600$$

$$M_f = \rho_f A_f L_f;\ K = 12$$

$$A_f = \frac{1}{n}\left\{\left[(2H + S_b)\frac{S_l}{2} + W\frac{S_b}{2}\right]n + 2\left[(2H + S_b)\frac{S_l}{2} + e \cdot S_b\right]\right\}$$

$$p = 2H + W$$

$$\omega = \frac{\pi(90 - \theta)}{180\sin(90 - \theta)} \cdot W$$

$$h = l\sin\varnothing$$

$$A = H \cdot W - \frac{W^2}{4\sin(90 - \theta)}\left[\frac{\pi(90 - \theta)}{180\sin(90 - \theta)} - \cos(90 - \theta)\right]$$

$$dpf = \rho_f A_f \cdot n \cdot (9000)(100)$$

wherein:

q=flux ($cm^3$/hr-gm)
W=channel width (cm)
$\mu$=fluid viscosity (gm/cm-sec)
$M_f$=fiber mass per channel (gm)
$\rho_f$=fiber density (gm/$cm^3$)
$A_f$=fiber cross-sectional area per channel ($cm^2$)
$L_f$=total fiber length (cm)
l=distance front has advanced along fiber (cm)
α=adhesion tension correction factor (surface) (d' less)
γ=fluid surface tension (dynes/cm-gm/$sec^2$)
p=wetted channel perimeter (cm)
H=channel depth (cm)
θ=contact angle (degrees)
β=adhesion tension correction factor (bulk) (d' less)
K=constant (d' less)
ω=arc length along meniscus (cm)
ρ=fluid density (gm/$cm^3$)
g=acceleration of gravity (cm/$se^2$)
h=vertical distance (cm)
$g_c$=gravitational constant (d' less)
A=fluid cross-sectional area per channel ($cm^2$)
n=number of channels (d' less)
$S_b$=fiber body or backbone thickness (cm)
$S_l$=fiber leg thickness (cm)
e=backbone extension (cm)
ø=fiber horizontal inclination angle (degrees)
dpf=denier per filament (gm/9000 m)

The equation for q is useful for predicting flux for a channeled fiber horizontally inclined at an angle ø. This equation contains all the important variables related to fiber geometry, fiber physical properties, physical properties of the fluid being transported, the effects of gravity, and surface properties related to the three-way interaction of the surfactant, the material from which the fiber is made, and the transported fluid. The equations for $M_f$, $A_f$, p, ω, h, and A can be substituted into the equation for q to obtain a single functional equation containing all the important system variables, or, for mathematical calculations, the equations can be used individually to calculate the necessary quantities for flux prediction.

The equation for q (including the additional equations mentioned above) is particularly useful for determining the optimum channel width to maximize uphill flux (fluid movement against the adverse effects of gravity; sin ø>0 in the equation for h). The equation for q is also useful for calculating values for downhill flux (fluid movement enhanced by gravity; sin ø<0 in the equation for h) for which there is no optimum channel width. Obviously, horizontal flux can also be calculated (no gravity effects; sin ø=0). The equation for q and the equations for p, A, and $A_f$ were derived for a fiber containing one or more rectangularly-shaped channels, but the basic principles used to derive these equations could be applied to channels having a wide variety of geometries.

A fiber of the present invention is capable of spontaneously transporting water on the surface thereof. Distilled water can be employed to test the spontaneous transportability phenomenon; however, it is often desirable to incorporate a minor amount of a colorant into the water to better visualize the spontaneous transport of the water, so long as the water with colorant behaves substantially the same as pure water under test conditions. We have found aqueous Syltint Poly Red solution from Milliken Chemicals to be a useful solution to test the spontaneous transportability phenomenon. The Syltint Poly Red solution can be used undiluted or diluted significantly, e.g., up to about 50x with water.

In addition to being capable of transporting water, fibers used in the present invention are also capable of spontaneously transporting a multitude of other fluids. Preferred aqueous fluids are body fluids, especially human body fluids. Such preferred fluids include, but are not limited to, blood, perspiration, and the like. Fluids commonly used in hair styling are also of interest.

In addition to being able to transport aqueous fluids, fibers useful in the present invention are also capable of transporting an alcoholic fluid on its surface. Alcoholic fluids are those fluids comprising greater than about 50% by weight of an alcoholic compound of the formula

R—OH wherein R is an aliphatic or aromatic group containing up to 12 carbon atoms. It is preferred that R is an alkyl group of 1 to 6 carbon atoms, more preferred is 1 to 4 carbon atoms. Examples of alcohols include methanol, ethanol, n-propanol and isopropanol. Preferred alcoholic fluids comprise about 70% or more by weight of a suitable alcohol. Preferred alcoholic fluids include antimicrobial agents, such as disinfectants, and alcohol-based inks.

The fibers used in the present invention can be comprised of any material known in the art capable of having a cross-section of the desired geometry and capable of being coated or treated so as to reduce the contact angle to an acceptable level. Preferred materials for use in the present invention are polyesters.

The preferred polyester materials useful in the present invention are polyesters or copolyesters that are well known in the art and can be prepared using standard techniques, such as, by polymerizing dicarboxylic acids or esters thereof and glycols. The dicarboxylic acid compounds used in the production of polyesters and copolyesters are well known to those skilled in the art and illustratively include terephthalic acid, isophthalic acid, p,p'-diphenyldicarboxylic acid, p,p'-dicarboxydiphenylethane, p,p'-dicarboxydiphenylhexane, p,p'-dicarboxydiphenyl ether, p,p'-dicarboxyphenoxyethane, and the like, and the dialkylesters thereof that contain from 1 to about 5 carbon atoms in the alkyl groups thereof.

Suitable aliphatic glycols for the production of polyesters and copolyesters are the acyclic and alicyclic aliphatic glycols having from 2 to 10 carbon atoms, especially those represented by the general formula $HO(CH_2)_pOH$, wherein p is an integer having a value of from 2 to about 10, such as ethylene glycol, trimethylene glycol, tetramethylene glycol, and pentamethylene glycol, decamethylene glycol, and the like.

Other known suitable aliphatic glycols include 1,4-cyclohexanedimethanol, 3-ethyl-1,5-pentanediol, 1,4-xylylene, glycol, 2,2,4,4-tetramethyl-1,3-cyclobutanediol, and the like. One can also have present a hydroxylcarboxyl compound such as 4,-hydroxybenzoic acid, 4-hydroxyethoxybenzoic acid, or any of the other hydroxylcarboxyl compounds known as useful to those skilled in the art.

It is also known that mixtures of the above dicarboxylic acid compounds or mixtures of the aliphatic glycols can be used and that a minor amount of the dicarboxylic acid component, generally up to about 10 mole percent, can be replaced by other acids or modifiers such as adipic acid, sebacic acid, or the esters thereof, or with modifiers that impart improved dyeability to the polymers. In addition one can also include pigments, delusterants or optical brighteners by the known procedures and in the known amounts.

The most preferred polyester for use in preparing the fibers of the present invention is poly(ethylene terephthalate) (PET).

Other materials that can be used to make the fibers of the present invention include polyamides such as a nylon, e.g., nylon 66 or nylon 6; polypropylene; polyethylene; and cellulose esters such as cellulose triacetate or cellulose diacetate.

A single fiber of the present invention preferably has a denier of between about 3 and about 30, more preferred is between about 4 and about 15.

Fiber shape and fiber/fluid interface variables can be manipulated to increase fluid transport rate per unit weight of fiber (flux) by accomplishing the following:

(a) using less polymer by making the fiber cross-sectional area smaller (thinner legs, walls, backbones, etc., which form the channeled structure);

(b) moderately increasing channel depth-to-width ratio;

(c) changing (increasing or decreasing) channel width to the optimum width, and (d) increasing adhesion tension, $\alpha \cos \theta$, at the channel wall by the proper selection of a lubricant for the fiber surface (which results primarily in a decrease in the contact angle at the wall without a significant lowering of the fluid surface tension at the wall).

The fibers useful in the present invention preferably have a surface treatment applied thereto. Such surface treatment may or may not be critical to obtain the required spontaneous transportability property. The nature and criticality of such surface treatment for any given fiber can be determined by a skilled artisan through routine experimentation using techniques known in the art and/or disclosed herein. A preferred surface treatment is a coating of a hydrophilic lubricant on the surface of the fiber. Such coating is typically uniformly applied at about a level of at least 0.05 weight percent, with about 0.1 to about 2 weight percent being preferred. Preferred hydrophilic lubricants include polyoxyethylene lauryl ether, polyoxyethylene oleyl ether, polyoxylene-polyoxypropylene-sorbitan linoleic phthalic ester, Milease T, and a potassium lauryl phosphate based lubricant comprising about 70 weight percent poly(ethylene glycol) 600 monolaurate. Many surfactants provide very good wetting of surfaces by lowering fluid surface tension and decreasing contact angle and thereby yield low adhesion tension at the surface. Therefore, it is important that the surfactant possess some attraction for the polyester surface (hydrophobic) and also for water (hydrophilic). It is also preferred that the surfactant bind tightly to the polyester surface and at the same time present high hydrophilicity to the water side of the interface. Another surface treatment is to subject the fibers to oxygen plasma treatment, as taught in, for example, *Plastics Finishing and Decoration*, Chapter 4, Ed. Don Satas, Van Nostrand Reinhold Company (1986).

Typical surfactants are listed in the following table:

| SYMBOL | SURFACTANT DESCRIPTION |
|---|---|
| BRIJ35 | Polyoxyethylene (23) lauryl ether (ICI) HLB = 16.9 |
| BRIJ99 | Polyoxyethylene (20) oleyl ether (ICI) HLB = 15.3 |
| BRIJ700 | Polyoxyethylene (100) stearyl ether (ICI) HLB = 18.8 |
| G1300 | G-1300 Polyoxyethylene glyceride ester (ICI) Nionic surfactant HLB = 18.1 |
| G1350 | "ATLAS" G-1350 (ICI) Polyoxylene-polyoxypropylene-sorbitan linoleic phthalic ester |
| G-1441 | G-1441 (ICI) Polyoxyethylene (40) sorbitol, lanolin alcoholysis product |
| HPMA109 | Hypermer A109 (ICI) Modified Polyester Surfactant (98%)/Xylene (2%) HLB = 13–15 |
| IL2535L1 | IL-2535 "Xylene-free/TMA free" Hypermer A109 (ICI) Modified polyester surfactant (HA = high acid no.) |
| IL2535L2 | IL-2535 "Xylene-free/TMA free" Hypermer A109 (ICI) Modified polyester surfactant (LA = low acid no.) |
| 1L2535L3 | IL-2535 "Xylene-free/TMA free" Hypermer A109 (ICI) Modified polyester surfactant (LA = low acid no.) |
| 1L2535L4 | IL-2535 "Xylene-free/TMA free" Hypermer A109 (ICI) Modified polyester surfactant (LA = low acid no.) |
| MIL T | MILEASE T (ICI) Polyester/water/other ingredients |
| RX20 RENEX 20 (ICI) Polyoxyethylene (16) tall oil (100%) (CAS-61791-002) HLB = 13.8 | |
| RX30 RENEX 30 (ICI) Polyoxyethylene (12) tridecyl alcohol (100%) (CAS 24938-91-8) HLB = 14.5 | |
| RX31 RENEX 31 (ICI) Polyoxyethylene (12) tridecyl alcohol (100%) (CAS 24938-91-8) HLB = 15.4 | |
| TL-1674 | TL-1674 (ICI) Polyoxyethylene (36) castor oil (100%) (CAS 61791-12-6) |
| TL-1914 | TL-1914 (ICI) Cocoamidopropyl Betaine (CAS-61789-40-0) |
| TW60 TWEEN 60 (ICI) Polyoxyethylene (20) sorbitan monostearate HLB = 14.9 | |

The novel spinnerets of the present invention must have a specific geometry in order to produce fibers that will spontaneously transport aqueous fluids.

Figure 3:
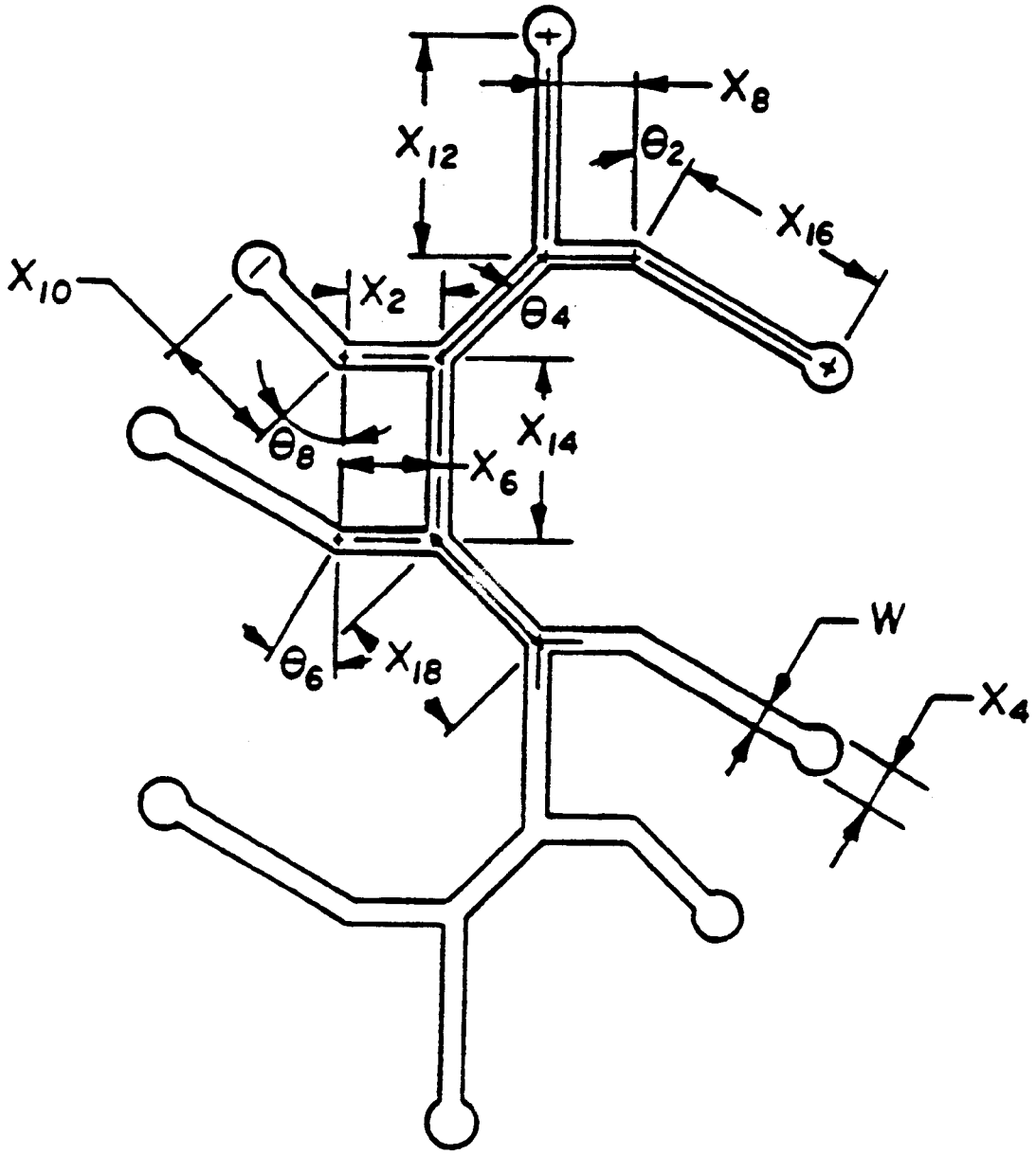
FIG. 3—schematic representation of an orifice of a spinneret useful for producing a spontaneously transportable fiber.

In FIG. 3, W is between 0.064 millimeters (mm) and 0.12 mm. $X_2$ is $4W_{-1W}^{+4W}$; $X_4$ is 2W±0.5W; $X_6$ is $6W_{-2W}^{+4W}$; $X_8$ is $6W_{-2W}^{+5W}$; $X_{10}$ is $7W_{-2W}^{+5W}$; $X_{12}$ is $9W_{-1W}^{+5W}$; $X_{14}$ is $10W_{-2W}^{+5W}$; $X_{16}$ is $11W_{-2W}^{+5W}$; $X_{18}$ is $6W_{-2W}^{+5W}$; $\theta_2$ is 30°±30°; $\theta_4$ is 45°±45°; $\theta_6$ is 30°±30°; and $\theta_8$ is 45°±45°.

Figure 4:
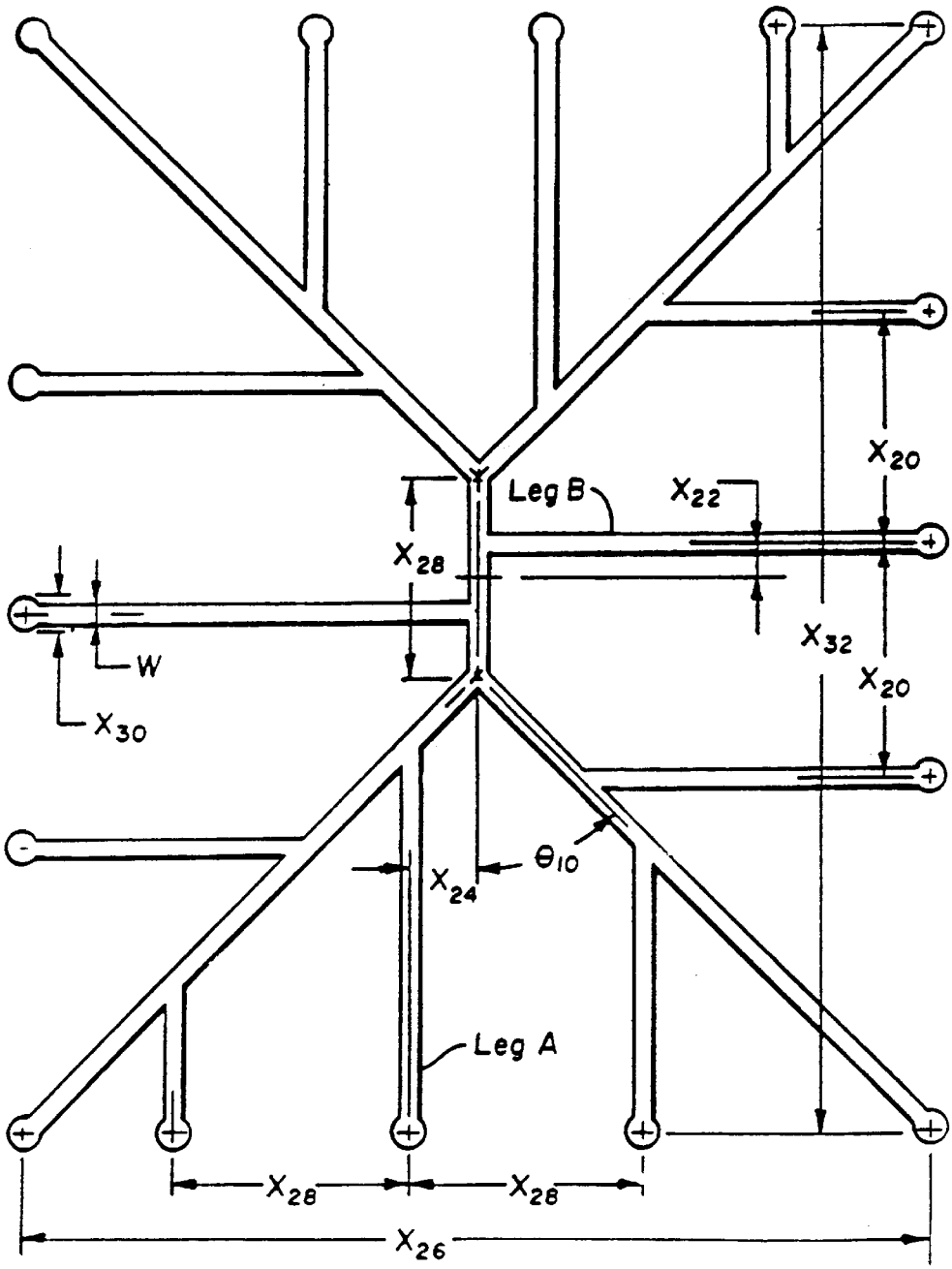
FIG. 4—schematic representation of an orifice of a spinneret useful for producing a spontaneously transportable fiber.

In FIG. 4, W is between 0.064 mm and 0.12 mm; $X_{20}$ is $17W_{-2W}^{+5W}$; $X_{22}$ is 3W±W; $X_{24}$ is 4W±2W; $X_{26}$ is $60W_{-4W}^{+8W}$; $X_{28}$ is $17W_{-2W}^{+5W}$; $X_{30}$ is 2W±0.5W; $X_{32}$ is $72W_{-5W}^{+10W}$; and $\theta_{10}$ is 45°±15°. In addition, each Leg B can vary in length from 0 to $$\frac{X_{26}}{2};$$

and each Leg A can vary in length from 0 to $$\tan(90-\theta_{10})\left[\frac{X_{26}}{2}-X_{24}\right].$$

Figure 5:
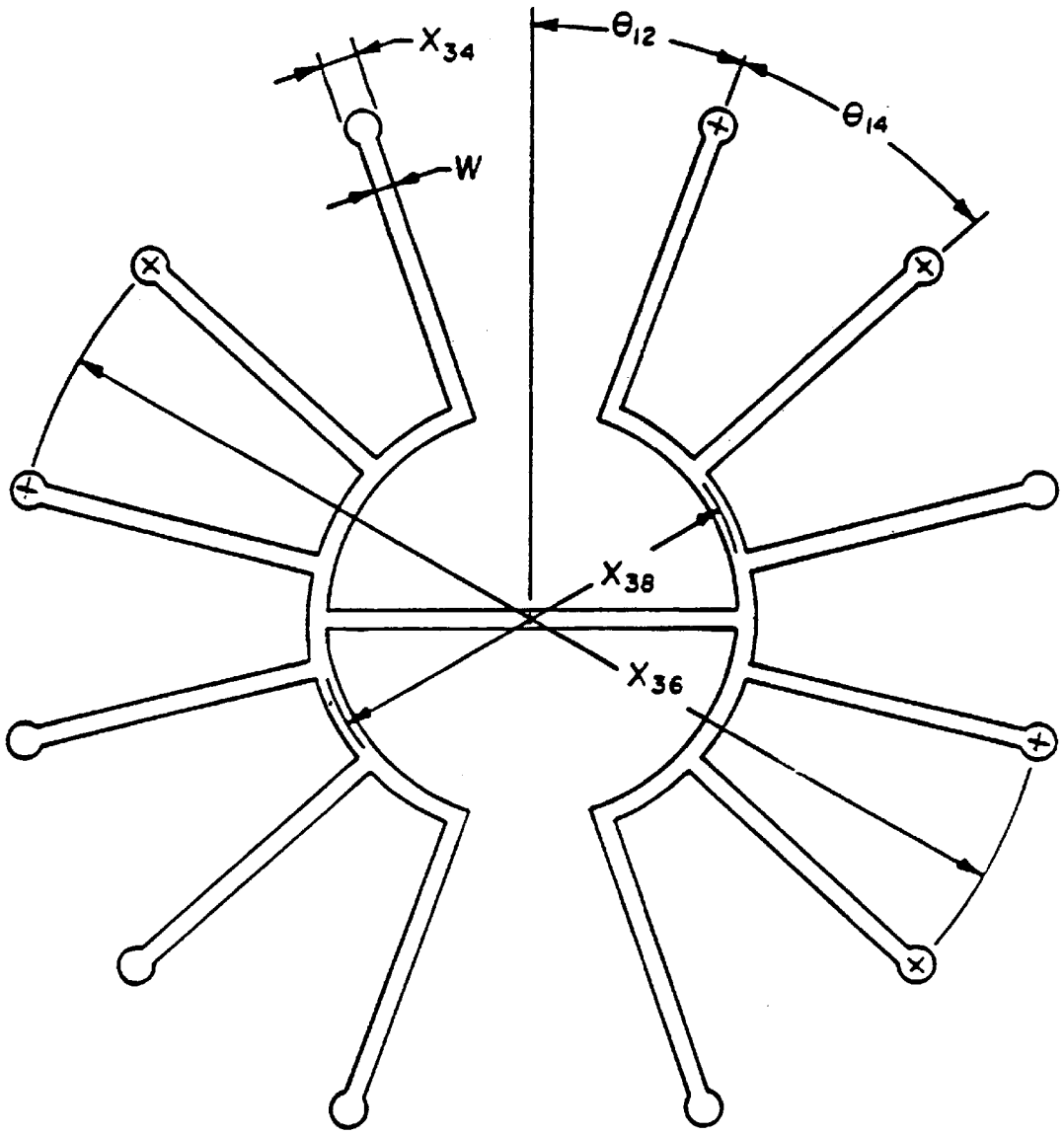
FIG. 5—schematic representation of an orifice of a spinneret useful for producing a spontaneously transportable fiber.

In FIG. 5, W is between 0.064 mm and 0.12 mm; $X_{34}$ is 2W±0.5W; $X_{36}$ is $58W_{-10W}^{+20W}$; $X_{38}$ is $24W_{-6W}^{+20W}$; $\theta_{12}$ is $20°_{-10°}^{+15°}$;

$$\theta_{14} \text{ is } \frac{180°-2\theta_{12}}{n-1};$$

and n=number of legs per 180°=2 to 6.

Figure 6:
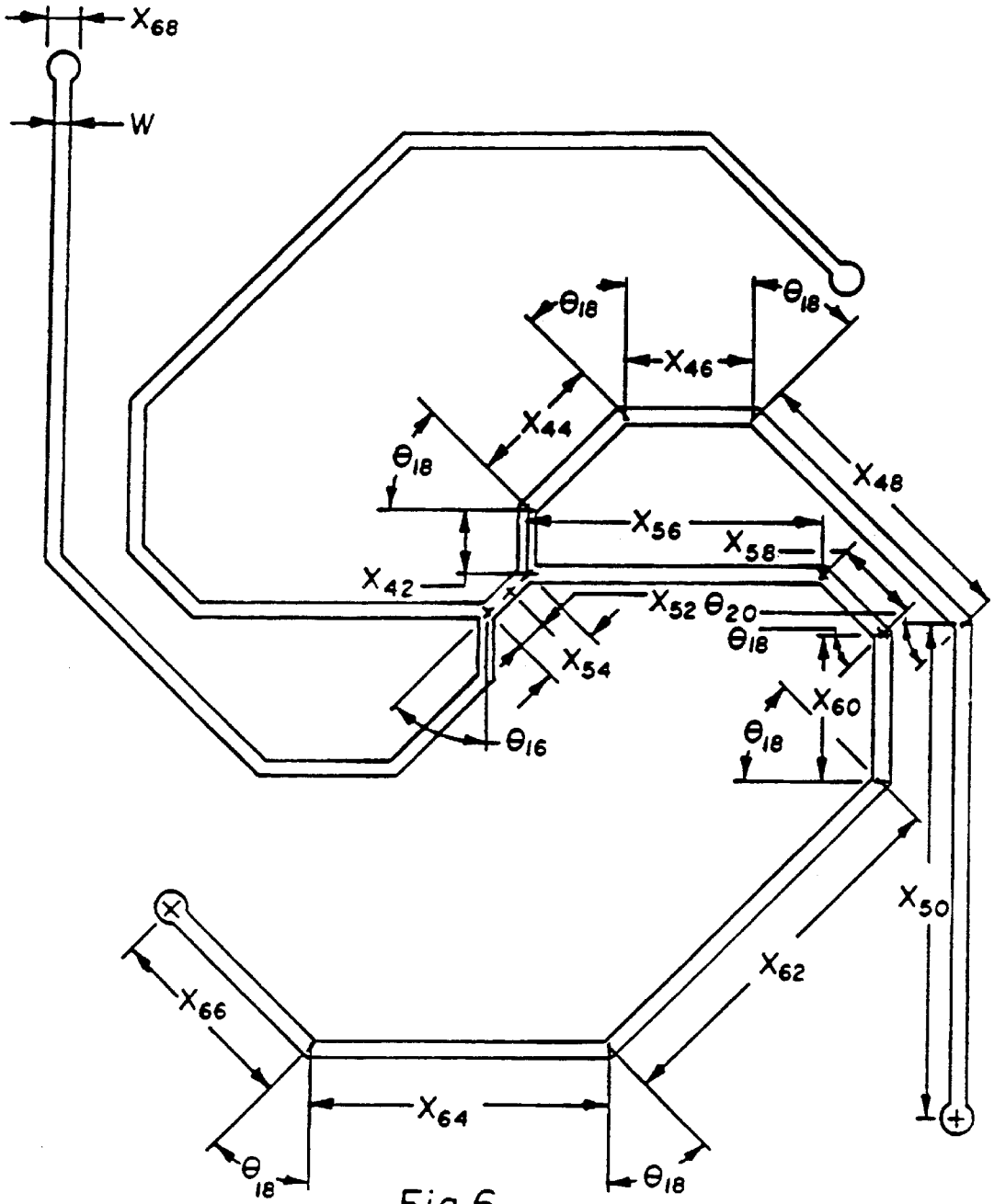
FIG. 6—schematic representation of an orifice of a spinneret useful for producing a spontaneously transportable fiber.

In FIG. 6, W is between 0.064 mm and 0.12 mm; $X_{42}$ is $6W_{-2W}^{+4W}$; $X_{44}$ is 11W±5W; $X_{46}$ is 11W±5W; $X_{48}$ is 24W±10W; $X_{50}$ is 38W±13W; $X_{52}$ is $3W_{-1W}^{+3W}$; $X_{54}$ is $6W_{-2W}^{+6W}$; $X_{56}$ is 11W±5W; $X_{58}$ is 7W±5W; $X_{60}$ is 17W±7W; $X_{62}$ is 28W±11W; $X_{64}$ is 24W±10W; $X_{66}$ is 17W±7W; $X_{68}$ is 2W±0.5W; $\theta_{16}$ is $45°_{-15°}^{+30°}$; $\theta_{18}$ is 45°±15°; and $\theta_{20}$ is 45°±15°.

Figure 6B:
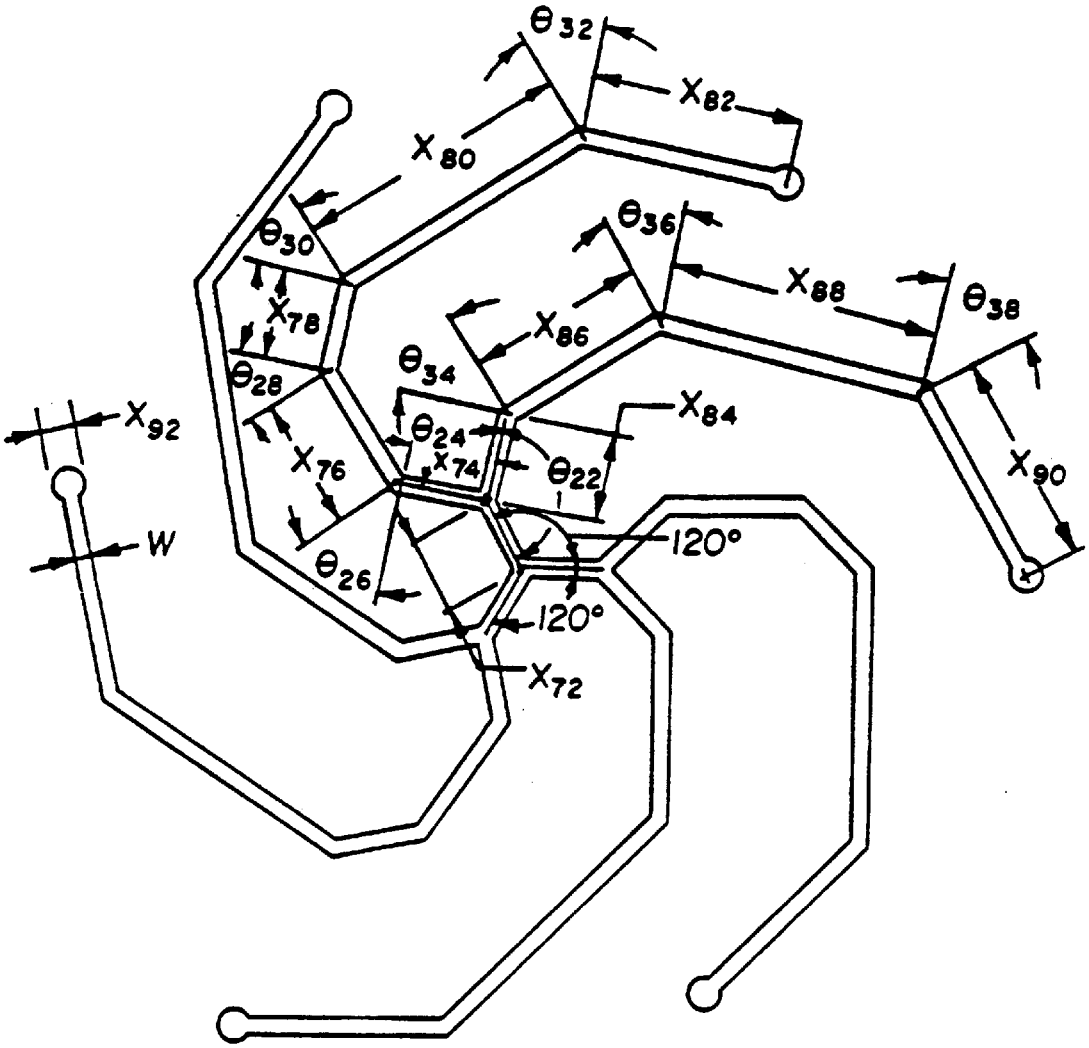
FIG. 6B—schematic representation of an orifice of a spinneret useful for producing a spontaneously transportable fiber.

In FIG. 6B, W is between 0.064 mm and 0.12 mm, $X_{72}$ is $8W_{-2W}^{+4W}$, $X_{74}$ is $8W_{-2W}^{+4W}$, $X_{76}$ is 12W±4W, $X_{78}$ is 8W±4W, $X_{80}$ is 24W±12W, $X_{82}$ is 18W±6W, $X_{84}$ is $8W_{-2W}^{+4W}$, $X_{86}$ is 16W±6W, $X_{88}$ is 24W±12W, $X_{90}$ is 18W±6W, $X_{92}$ is 2W±0.5W, $\theta_{22}$ is 135°±30°, $\theta_{24}$ is $90°\pm_{30°}^{45°}$, $\theta_{26}$ is 45°±15°, $\theta_{28}$ is 45°±15°, $\theta_{30}$ is 45°±15°, $\theta_{32}$ is 45°±15°, $\theta_{34}$ is 45°±15°, $\theta_{36}$ is 45°±15°, and $\theta_{38}$ is 45°±15°.

Figure 7:
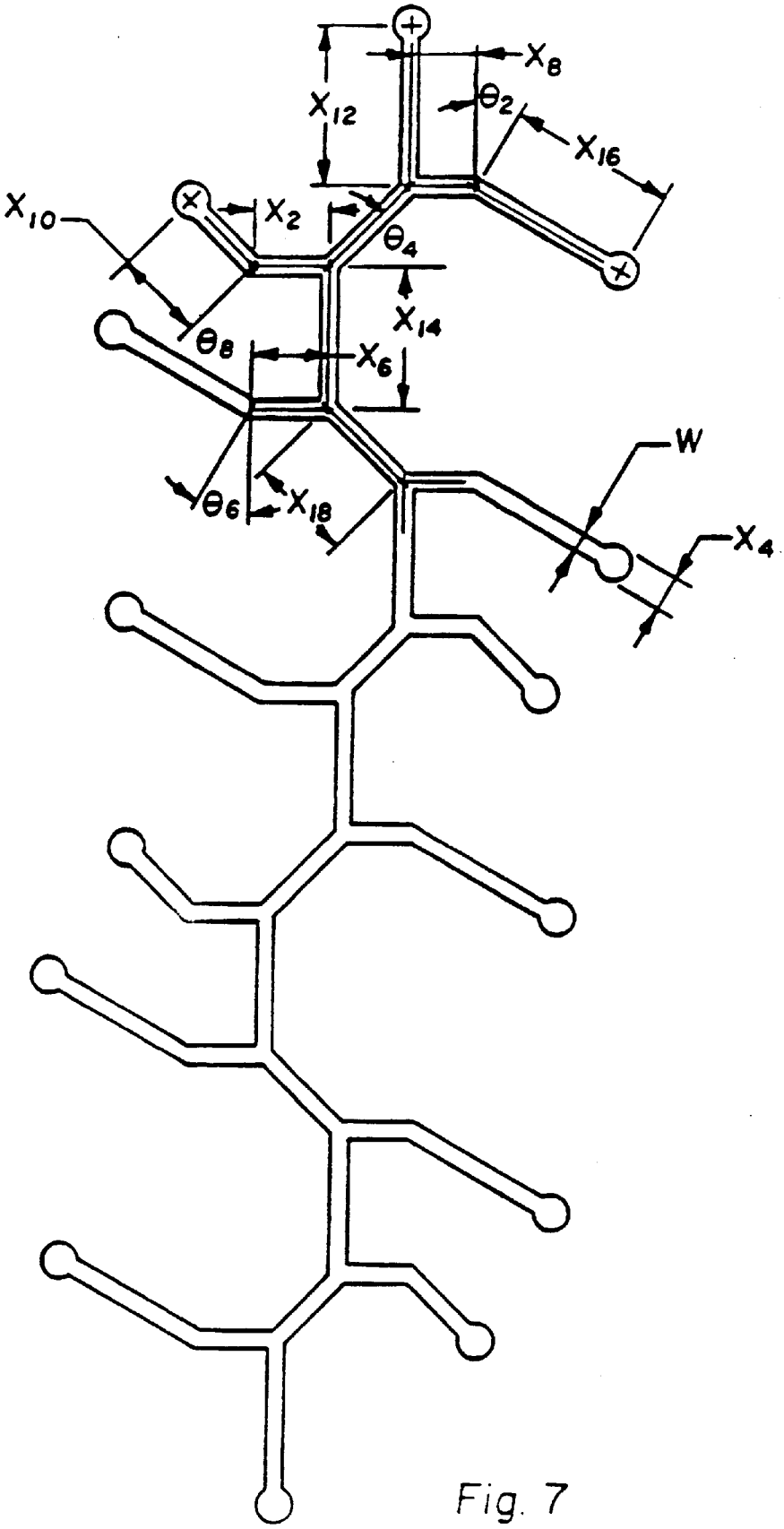
FIG. 7—schematic representation of an orifice of a spinneret having 2 repeating units, joined end to end, of the orifice as shown in FIG. 3.
Figure 8:
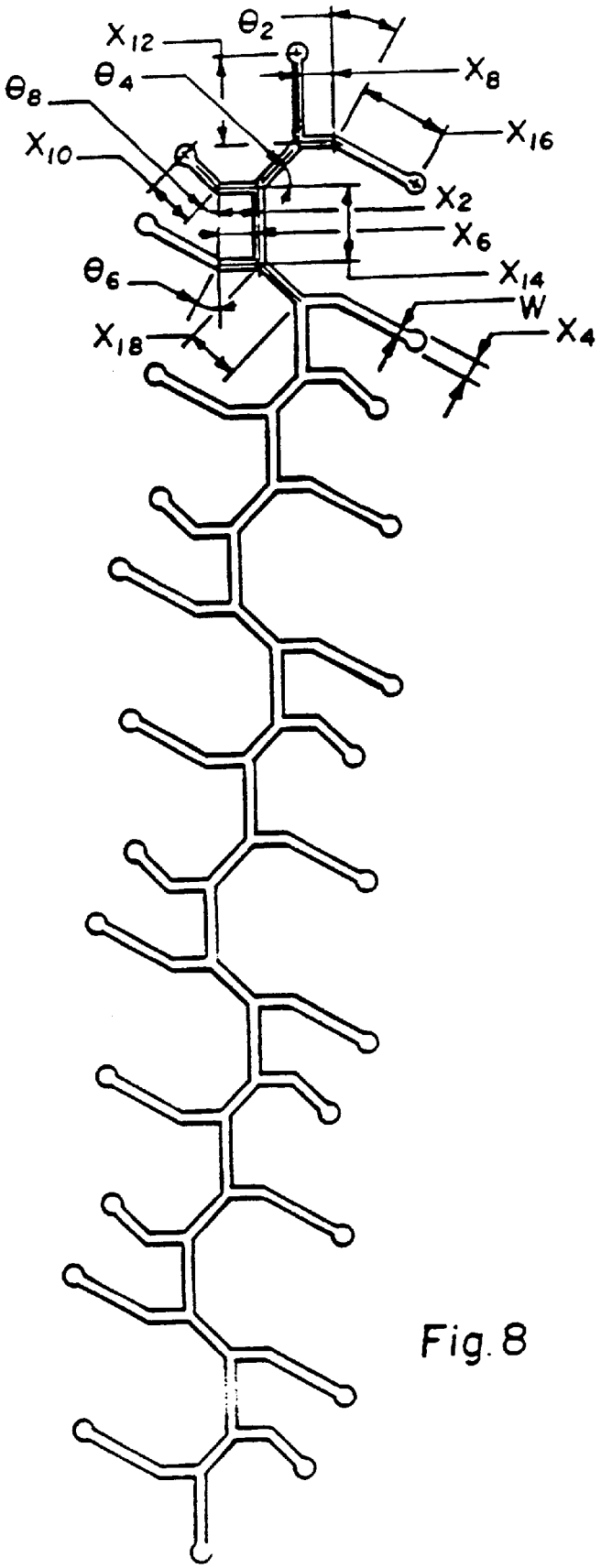
FIG. 8—schematic representation of an orifice of a spinneret having 4 repeating units, joined end to end, of the orifice as shown in FIG. 3.

In FIG. 7, the depicted spinneret orifice contains two repeat units of the spinneret orifice depicted in FIG. 3, therefore, the same dimensions for FIG. 3 apply to FIG. 7. Likewise, in FIG. 8, the depicted spinneret orifice contains four repeat units of the spinneret orifice depicted in FIG. 3, therefore, the same dimension for FIG. 3 applies to FIG. 8.

Figure 20:
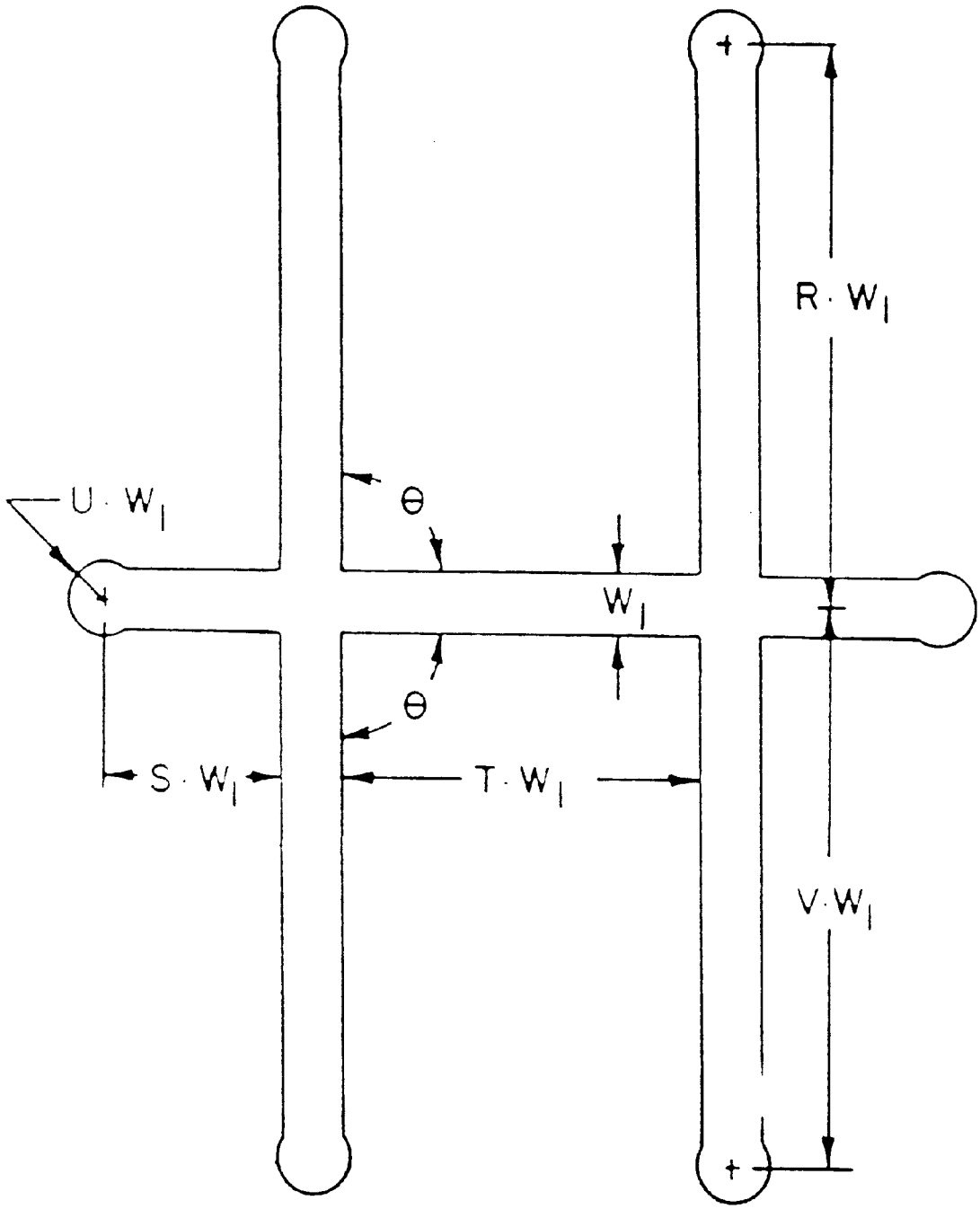
FIG. 20—a schematic representation of a preferred "H" shape orifice of a spinneret useful for producing a spontaneously transportable fiber.

FIG. 20 depicts a preferred "H" shape spinneret orifice of the invention. In FIG. 20 $W_1$ is between 60 and 150$\mu$, $\theta$ is between 80° and 120°, S is between 1 and 20, R is between 10 and 100, T is between 10 and 300, U is between 1 and 25, and V is between 10 and 100. In FIG. 20 it is more preferred that $W_1$ is between 65 and 100$\mu$, $\theta$ is between 900 and 1100, S is between 5 and 10, R is between 30 and 75, T is between 30 and 80, U is between 1.5 and 2, and V is between 30 and 75.

Figure 21:
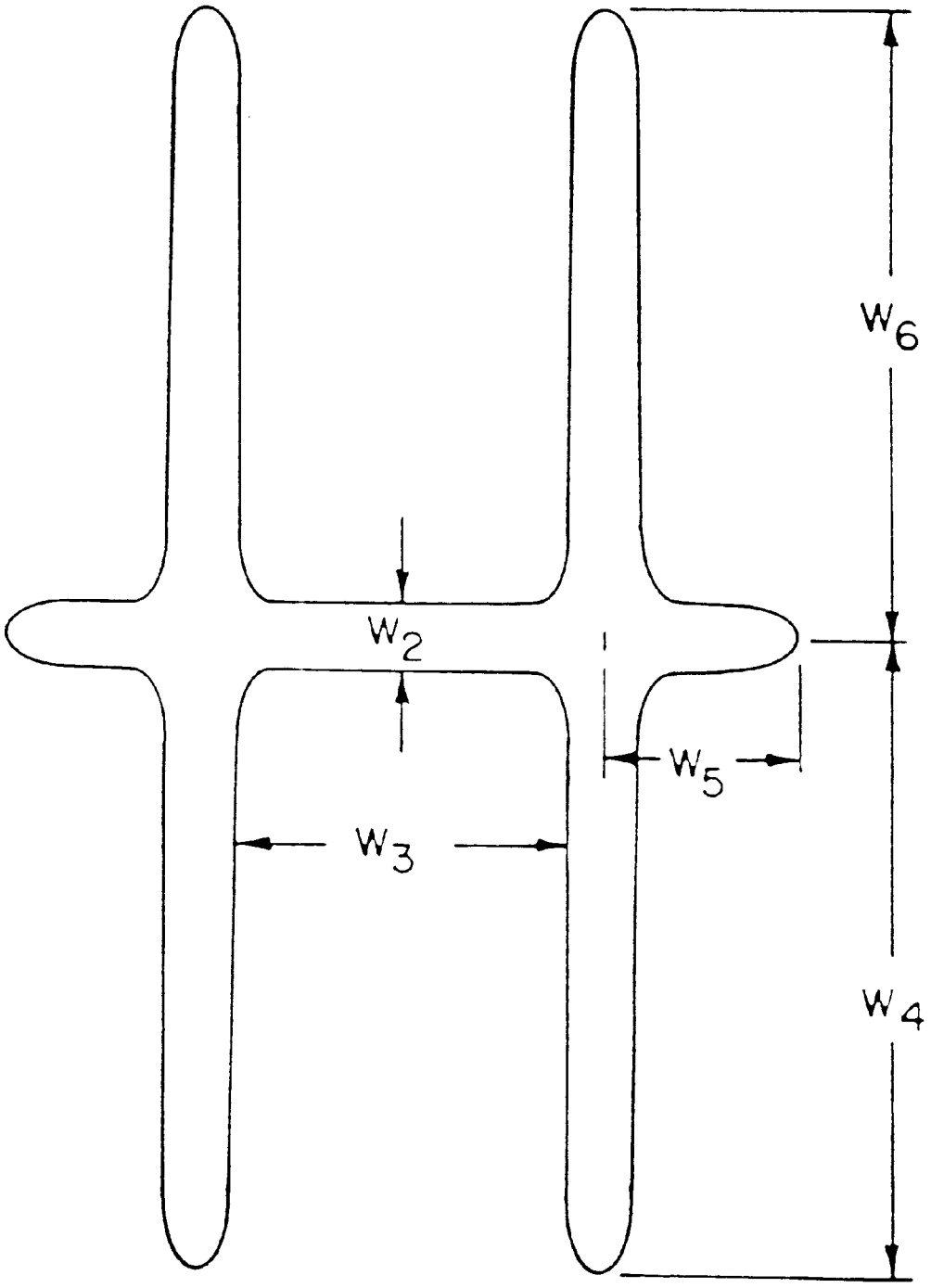
FIG. 21—a schematic representation of a poly(ethylene terephthalate) fiber cross-section made using a spinneret having an orifice as illustrated in FIG. 20.
Figure 22B:
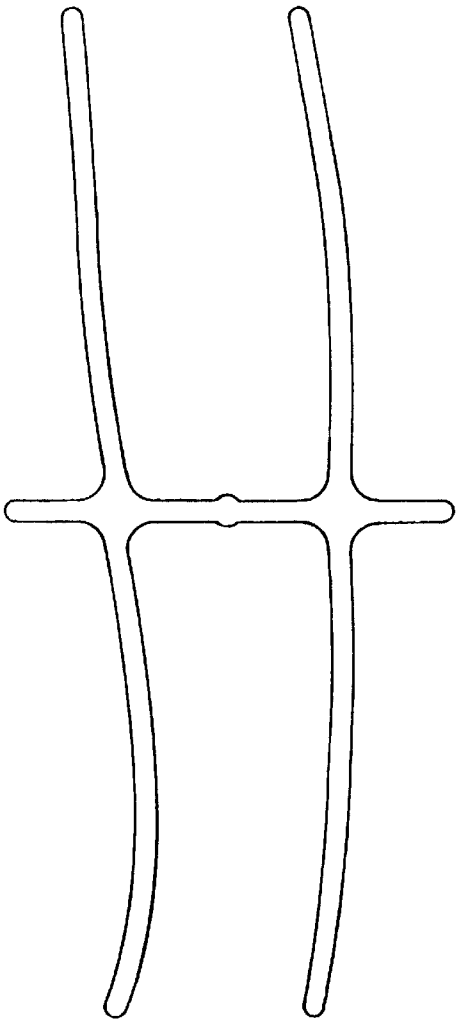
FIGS. 22A and 22B—a schematic representation of a preferred "H" shape orifice of a spinneret useful for producing a spontaneously transportable fiber.
Figure 22A:
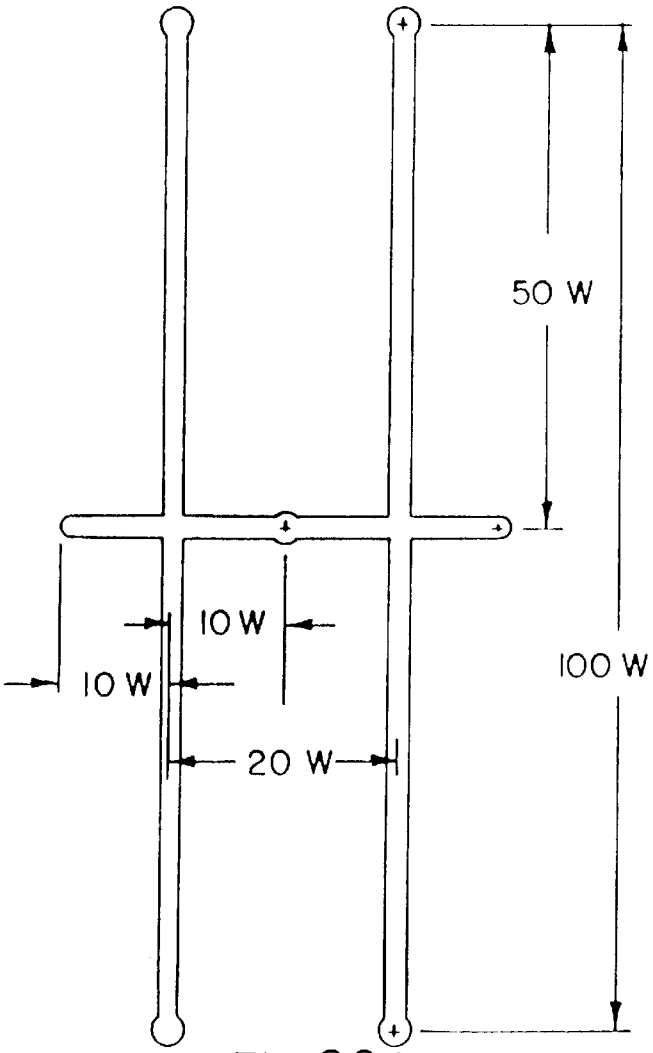
Figure 23B:
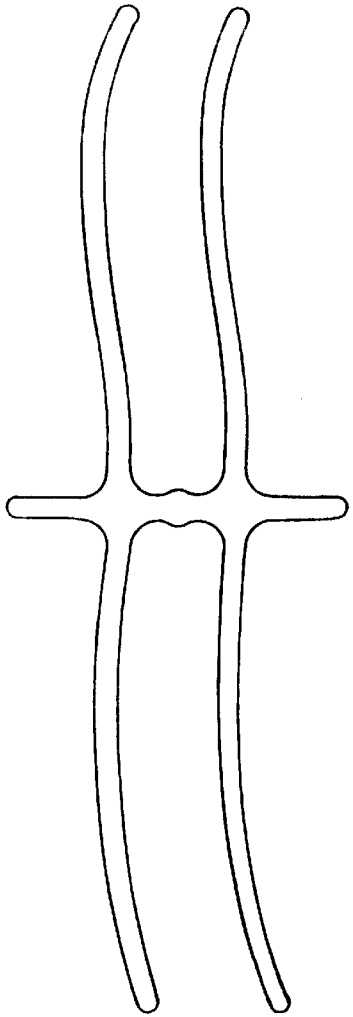
FIGS. 23A and 23B—a schematic representation of a preferred "H" shape orifice of a spinneret useful for producing a spontaneously transportable fiber.
Figure 23A:
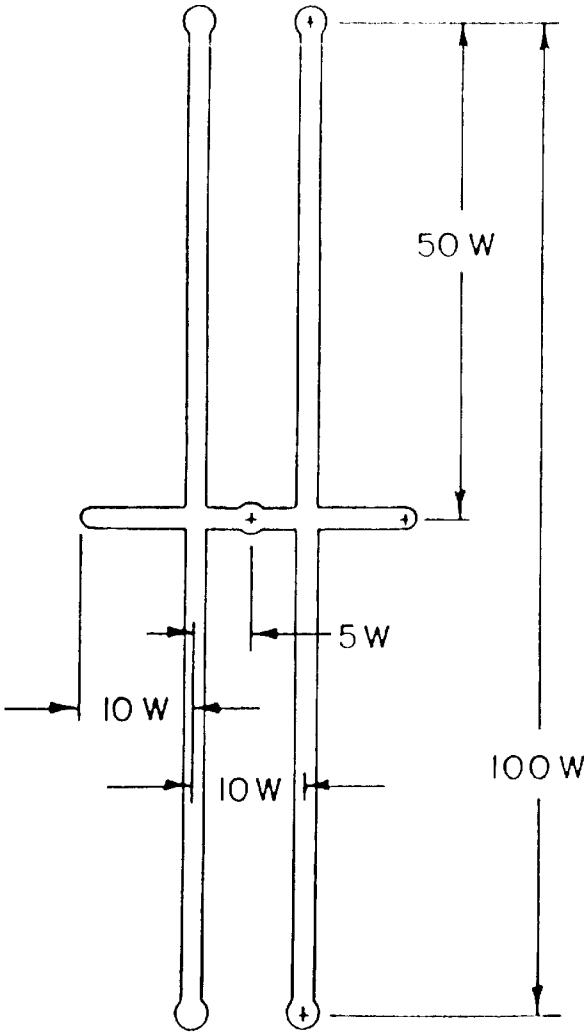
Figure 24:
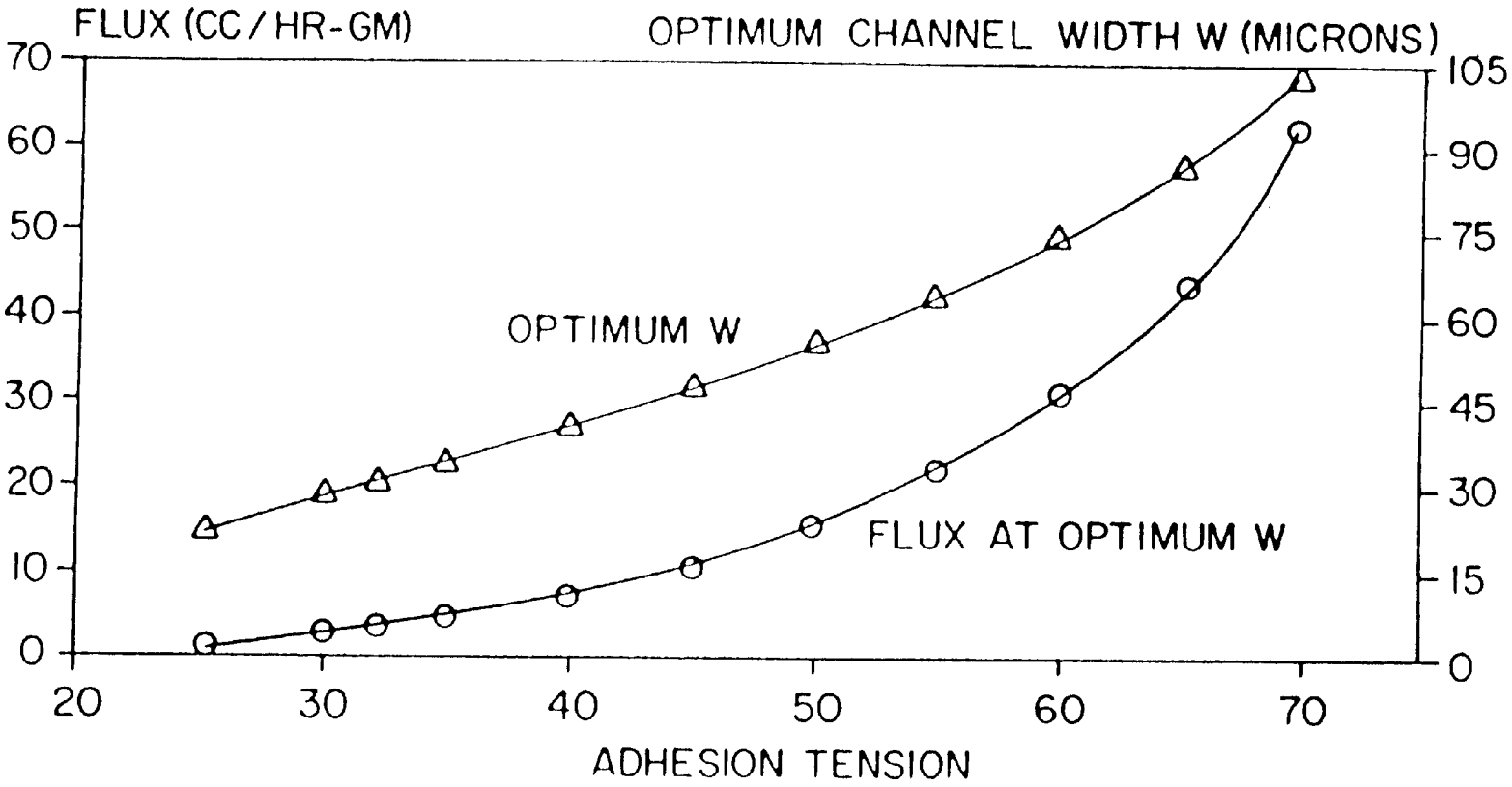
FIG. 24—graph of maximum flux in cc/hr/g vs. adhesion tension for a poly(ethylene terephthalate) having an "H" shape cross-section with two unit cells or channels wherein each channel depth is 143$\mu$ and the leg thickness of each channel is 10.9$\mu$.

FIG. 21 depicts a poly(ethylene terephthalate fiber cross-section made from the spinneret orifice of FIG. 20. In FIG. 21 $W_2$ is less than 20$\mu$, $W_3$ is between 10 and 300$\mu$, $W_4$ is between 20 and 200$\mu$, $W_5$ is between 5 and 50$\mu$, and $W_6$ is between 20 and 200$\mu$. In FIG. 21 it is more preferred that $W_2$ is less than 10$\mu$, $W_3$ is between 20 and 100$\mu$, $W_4$ is between 20 and 100$\mu$, and $W_5$ is between 5 and 20$\mu$.

Figure 16:
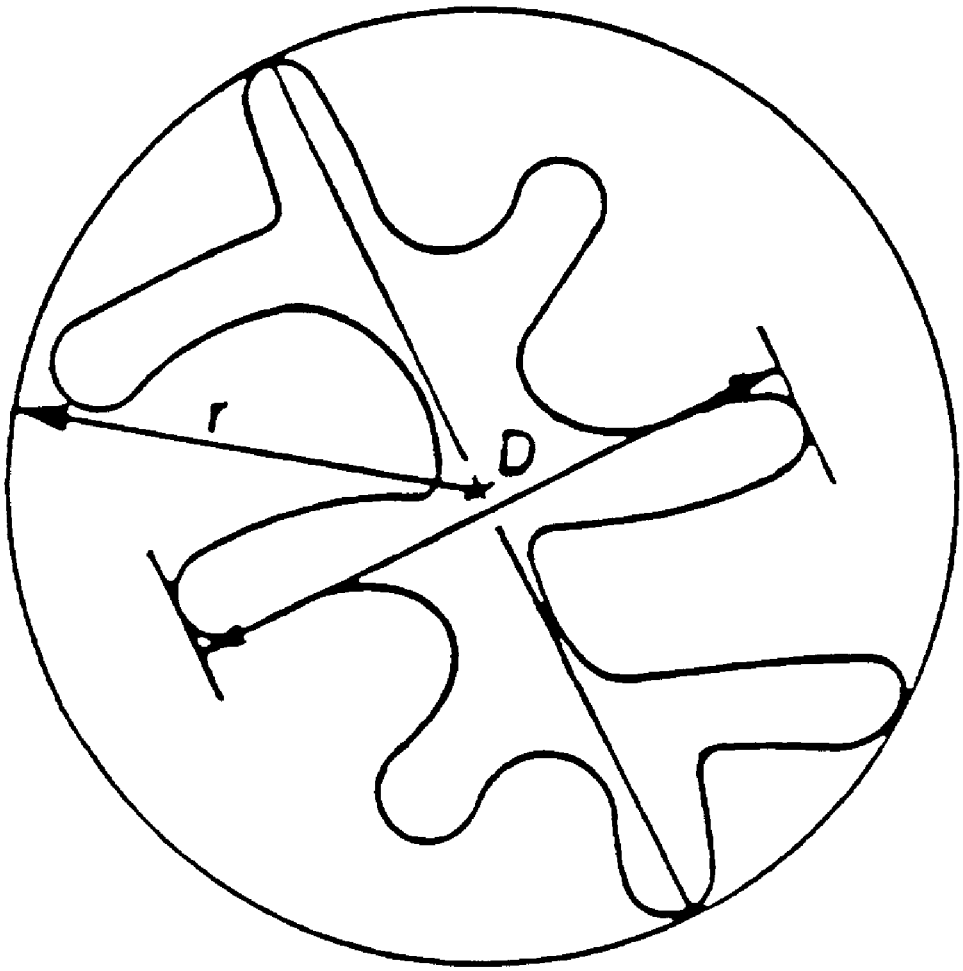
FIG. 16—schematic representation of a fiber cross-section made using a spinneret having an orifice as illustrated in FIG. 3. Exemplified is a typical means of determining the shape factor X.
Figure 17:
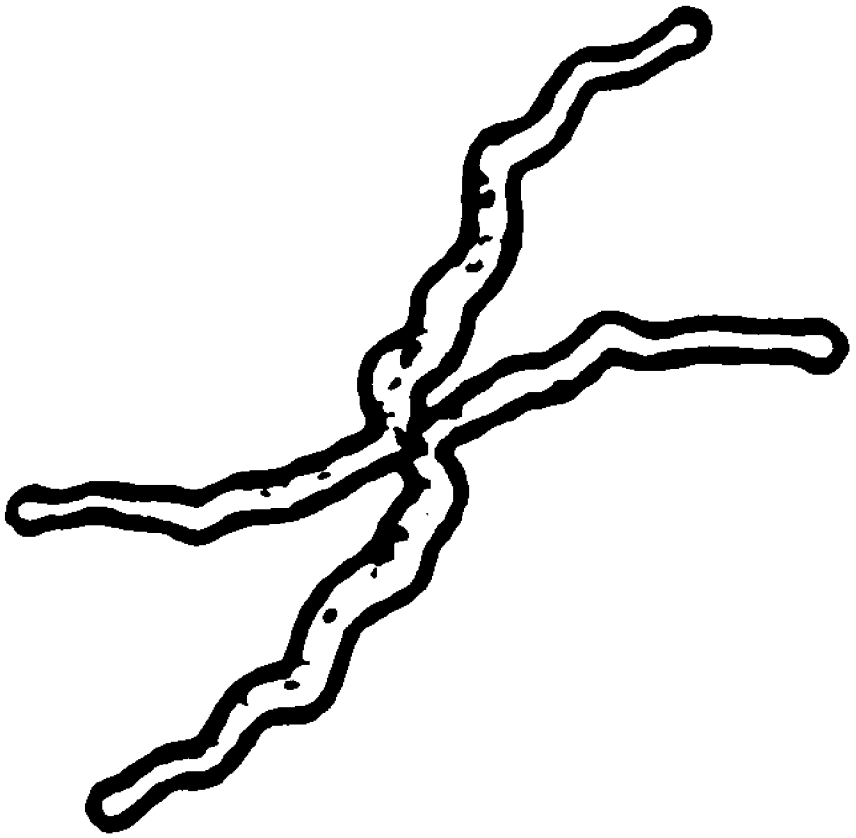
FIG. 17—photomicrograph of a poly(ethylene terephthalate) fiber cross-section made using a spinneret having an orifice as illustrated in FIG. 6.
Figure 17B:
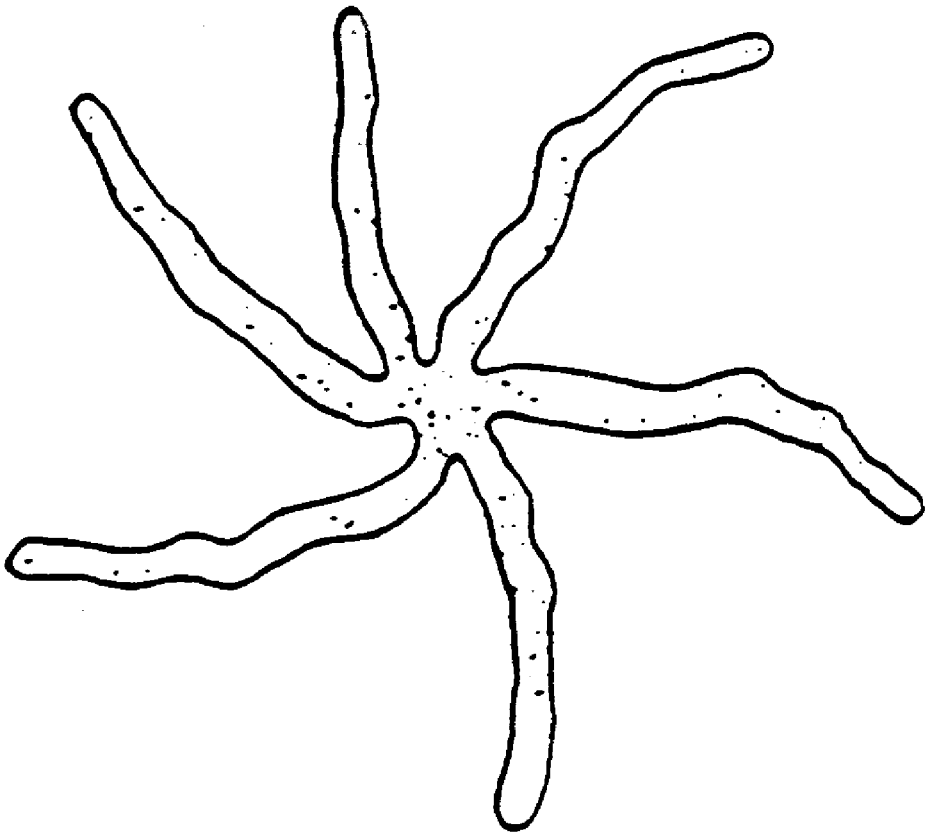
FIG. 17B—schematic representation of a poly(ethylene terephthalate) fiber cross-section made using a spinneret having an orifice as illustrated in FIG. 6B.

FIG. 16 illustrates the method for determining the shape factor, X, of the fiber cross-section. In FIG. 16, r=37.5 mm, $P_w$=355.1 mm, D=49.6 mm; thus, for the fiber cross-section of FIG. 16:

$$X = \frac{355.1}{4\times 37.5+(\pi-2)49.6} = 1.72.$$

The fibers useful in the present invention can be in the form of crimped or uncrimped staple fibers.

The fibers of the headband can be substantially parallel to the major axis thereof.

The absorbent headbands of the present invention can be made by use of techniques known in the art, for example in U.S. Pat. Nos. 4,573,986; 3,938,522; 4,102,340; 4,044,768; 4,282,874; 4,285,342; 4,333,463; 4,731,066; 4,681,577; 4,685,914; and 4,654,040; and/or by techniques disclosed herein.

Maximum Potential Flux Test

Figure 25:
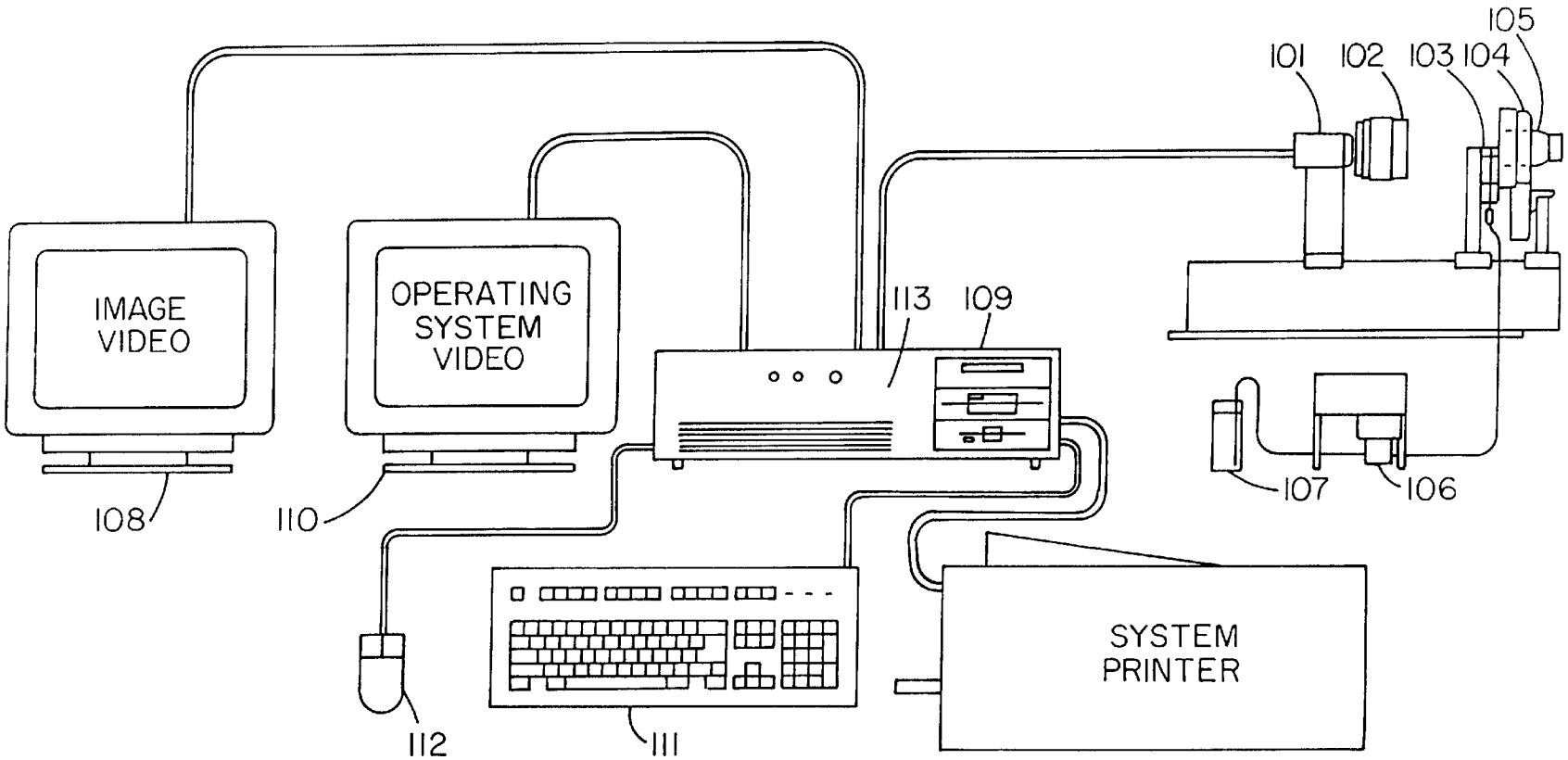
FIG. 25—a schematic representation of the apparatus used to determine maximum potential flux.

This method describes a single filament wetting test instrument that will aid the process of designing new fibers by providing detailed experimental data which can be used to evaluate design changes or to test theoretical relationships. This measurement system is based on computer image analysis. A video camera coupled to a computer automatically senses when fluid is provided to the filament and then follows the advance of the fluid interface over a period of time. The fluid interface position vs. time is recorded for subsequent plotting and further analysis. Consistent fluid delivery is achieved by use of a metering pump. The image analysis based spontaneous wetting test instrument includes a light source, a video camera, a metered fluid delivery system, an image monitor, a computer with an image processing board, application specific software, a video graphic printer, and precision mounting hardware (FIG. 25). The fluorescent ring light provides uniform bright illumination of the fiber while providing a viewing path for the camera. The metered pump consistently delivers the proper amount of fluid to the fiber at the press of a button. The imaging board within the computer captures an image from the video camera for processing and display. The computer analyzes the digital image to extract the fluid interface vs. time information which is the primary raw output of this device. This, and other information, is displayed graphically on the image monitor. The system components illustrated in FIG. 25 are as follows:

101 NEC TI-324A CCD camera
102 AF Micro Nikkon 60 mm lens with 62 mm dark green filter
103 Fluid dispensing tip
104 Fluorescent light ring with opal diffusing glass
105 Light diffuser
106 FMI pump
107 Fluid reservoir
108 NEC/multisync II image monitor
109 Gateway 2000 486/33C computer,
110 Monitor
111 Keyboard 112 Mouse 113 Matrox IP8 imaging board Maximum potential flux is one characterization of single filaments which exhibit spontaneous wetting behavior. The method used for calculating maximum potential flux employs the use of values from: 1) fiber geometry (cross sectional area of fluid-moving channels in square centimeters), 2) mass of 20 cm of filament in grams (which is proportional to denier per filament and 3) initial fluid velocity in cm per hour. The maximum potential flux is defined as the product of area for flow times initial velocity divided by the mass of a 20 cm length of fiber, i.e., mpf=(C1×velocity×area for flow)÷denier of fiber expressed as cc/gm of fiber/hr where C1 is a conversion factor.

The single filament wettability test is used to determine the initial fluid velocity of spontaneously wettable fibers. The computer controlled test is initiated by the operator. A drop of colored fluid is presented from beneath the filament through a specially designed tip by a metered pump. A video camera in front of the fiber sends the signal to the computer and the fluid movement is displayed on the imaging monitor. The fluid front position vs. time curve is determined over a 4 second interval and the slope of the curve calculated for the first 30 data points collected. From the average slopes, average fluid velocity and flux can be calculated.

The possible sources of error are as follows:

1. Stretch filament.
2. Insufficient crimp pulled out of filament.
3. Wetting fluid has separated in the pumping system.
4. Room temperature and relative humidity are not in normal range.
5. Computer calibration is not correct.
6. Fiber imperfections cannot be resolved with contrast adjustment resulting in incorrect detection of fluid movement.
7. Image background if fiber moves during the test time.
8. Insufficient or excessive fluid volume presented to filement.
9. Contamination by body oils, work surface oils and dirt etc.

Calibration should be done any time a change has been made in the camera or lighting system, such as camera position, focus or parts using the following procedure:

1. Turn on imaging system and open the wetting program. The Single Filament Wetting window will appear.
2. Open the Calibration window by opening the file drop down menu and selecting calibration from the list.
3. Place the ruler in the upright position in the sample holder, adjusting the external light source so that the ruler divisions are clearly visible. Ensure that 10 millimeters is in the field of view.
4. Position the markers to enclose the 10 millimeters.
5. Point to the calculate button and click on it. The number of pixels/mm will be calculated and should be between 480 and 492.
6. Point to the OK button and click on it. The data will be saved and used in calculating the distances from the wetting routine.
7. Return to the Single Filament Wetting window.

The calibration should be confirmed daily merely by placing the ruler in the sample holder and observing that the field of view is 10 millimeters.

Procedure

1. From the single filament wetting window file menu, create a file from the Open/Create file window.
2. Place a single filament which has weights on both ends sufficient to cause tension but not stretch the filament across the mounting stand.
3. Set marker position, marker size and fluid start location.
4. Open the Data and Fit window. Adjust the lighting so that the filament is slightly darker than the background and confirm this by generating a histogram and establishing the threshold. Return to the Single Filament Wetting window.
5. Dispense a drop of fluid, point to the Do Wet button and click on it. The first 3 snaps of the test will be displayed at the bottom of the imaging screen and the real time at the top.
6. At the end of the test, the position vs. time curve (red) will be displayed along with the fitted curve (blue) and the regression curve (green) on the Data and Fit window.
7. Return to the Single Filament Wetting window and continue testing as described moving the filament to another location or changing filaments.
8. When all data has been collected, open the Microsoft Excel spreadsheet, update the curves, enter the cross-sectional channel area which is determined by adding all channel areas obtained from icroscopic measurements of channel width and depth at 25× magnification and the denier per filament which is the weight in grams of 9000 meters of fiber divided by the number of filaments in the strand or bundle. The flux value will be calculated automatically.
9. Print a report and return to the SF Wetting window.

Documentation for the Windows Single Filament Wetting Instrument (SFW).

Computer Setup

The Matrox IP8 board uses the address range D000-DFFF for frame memory. It also uses some of the C000 space for writing to registers. So config.sys must contain the following line:

device=c:\windows\emm386.exe noems x=D000-DFFF

Also, system.ini must have EMMEXCLUDE=D000-DFFF under the [386Enh] section.
These areas must also be set as NONcachable, and 8 bit IO. On the Gateway machines do a Ctrl-Alt-Esc sequence to get into setup. For the video IO setting run install from the video directory (Ultra,Mach32, or whatever.). Config.sys also needs to load the IP8 driver:

device=c:\ip8\util\ip8drv.sys

The directory tree should include:

```
C:\
IP8 dll's and  CMDIALOG.VBX
        PROJECTS
                WETTING
                        DATA
                        CONTROL
        WINDOWS         (with VBRUN200.DLL in SYSTEM)
        EXCEL           (include in Path)
```

Run IPinit.exe (p3-3 IP8 Installation/Interface Guide); set camera to mono, and buffer size to 32K. Be sure to save settings to Power Up.

Recommended order for understanding SFW instrument.

- Run Program c:\projects\wetting\wet.exe.
- Look at Visual Basic (VB) code WITHIN VB (run wet.mak).
- Look at Excel XWET.XLM, and XWET.XLT; read imbedded notes.
- Look at cwet.c program.

Basic Operating Structure.

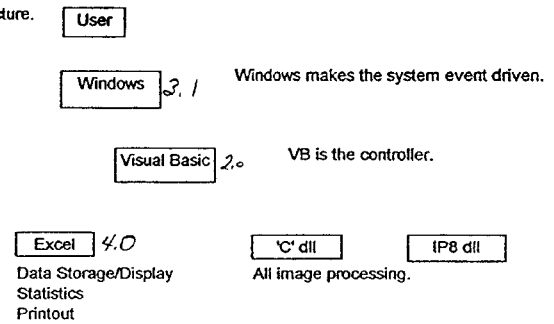

Comments about navigating through code:

Within VB, make frequent use of selecting meun item or double-clicking button to jump to related code, Shift-F2 to jump to routine, and Ctrl-F to find text. An example of using find to help map out communications would be searching for .Poke or .LinkExecute.

A quick way to see what 'C' routines are exported is to look at ~~coress~~ cwet.def.

- 33 -

```
/*  WET.C

    Single Filament Spontaneous Fiber Wetting test.
    Author:  Wayne Culberson, 1/89.
    11/92: Windows version with Matrox IP8, Horizontal camera, back light.

 */

#define WIN30
#include <ip.h>

#include <windows.h>
#include <math.h>
#include <stdlib.h>
#include <time.h>
#include <string.h>

#define dT .03333333333        // 1/(Snaps/sec)
#define SNAPS 121              // Tmax*(Snaps/sec)+1  [4*30+1]; VB Arrays dim at 128

double  xPixPerMM ;   // Used in cDoWet() only, set in cSetPixPerMM()
int MarkerPosition, MarkerSize, MarkerCol ;  // VB insures that MarkerSize is even


int FAR PASCAL LibMain(HANDLE hModule, WORD wDataSeg, WORD cbHeapSize, LPSTR lpszCmdLine)
        {
        return TRUE;
        }

void FAR PASCAL
cShowThreshold( int Threshold )
        {
        int i, j ;
        unsigned char  LUTcolor[3*257];

        for ( i=1,j=0 ;  i<255  ; i++,j+=3 ) {
                if ( i<Threshold ) {   // make below Threshold shade of red
                        LUTcolor[j]=min(255,(int)i+100);  LUTcolor[j+1]=0;
LUTcolor[j+2]=0;
                        }
                else    LUTcolor[j]=LUTcolor[j+1]=LUTcolor[j+2]=i ;
                }
        LUTcolor[j]=0;  LUTcolor[j+1]=0;  LUTcolor[j+2]=255; // Bright(255)=blue
        VG_SetLUT( OUT_LUT,LUTcolor,255,1 );
        }

int FAR PASCAL
cInitIP(void)
        {
        int ErrorCode ;
        unsigned char color=255;

        if ( (ErrorCode=(int)VG_InitLib())!=0 && ErrorCode!=-5 && ErrorCode!=-6 )  return
ErrorCode ;
        if ( (ErrorCode=(int)VG_Reset(YES)) )  return ErrorCode ;
        VG_SetFrameBufConfig( QUAD );
        VG_SetAccessBufSt( ON );       // _VG_AcsBufSize set by IP8init 2-32K
        VG_SetGrabRegUpd( DIRECT );

        cShowThreshold( 0 );
        VG_SetKeyColor( &color );      // 255 = Overlay Key Color

        return 0 ;
        }

void FAR PASCAL
cQuitIP(void)
        {
        VG_QuitLib();          // Free up IP8 dll's
        }

void FAR PASCAL
cSetPixPerMM( LPSTR PathName )
        {
        static char    Value[32] ;
```

```
        GetPrivateProfileString( "Defaults","xPixPerMM","",(LPSTR)Value,32,PathName );

        xPixPerMM = atof(Value);
        }

void FAR PASCAL
cCalibrate( char FAR *Name, int l, int r )
        {
        static int  ol, or ;
        unsigned char color=0 ;

        if ( !_fstrcmp( Name,"StartUp"  ) ) {
                VG_ClearScreen( &color );
                color = 255;
                VG_SetPenColor( &color );
                VG_MoveTo( l,0 );       VG_LineTo( l,120 );    // draw new
                VG_MoveTo( r,0 );       VG_LineTo( r,120 );
                }
        else if ( !_fstrcmp( Name,"Scroll"  ) ) {
                VG_SetPenColor( &color );
                VG_MoveTo( ol,0);       VG_LineTo( ol,120 );   // erase
                VG_MoveTo( or,0);       VG_LineTo( or,120 );
                color = 255;
                VG_SetPenColor( &color );
                VG_MoveTo( l,0 );       VG_LineTo( l,120 );    // new
                VG_MoveTo( r,0 );       VG_LineTo( r,120 );
                }
        ol = l ;        // save for erase
        or = r ;
        }

void FAR PASCAL
cLiveImage( int Position, int Size, int Col )
        {
        unsigned char color=0 ;

        VG_SetKeyComp( MEMORY );
        VG_SetKeyOut( LIVE );
        VG_SetKeyType( SPECIAL );       // always live for PROGRESSIVE Grab

        VG_SetGrabSourcePos( 0,0,512,480 );   // clear whole frame buf
        VG_SetGrabDestPos( 0,0 );
        VG_SetGrabColor( &color );      // Fast clear of Frame Buf
        VG_SetGrabColorSt( ON );
        VG_SingleGrab();        while ( VG_GetGrabSt() );
        VG_SetGrabColorSt( OFF );
        VG_SetGrabSourcePos( 0,0,512,120 );   // normal grab position; top 1/4 of screen
        VG_SetGrabDestPos( 0,0 );

        VG_SetKeyOut( MEMORY );                 // Overlay memory when KeyColor=memory
        VG_SetKeyType( EQUAL );
        VG_SetDispType( KEY_VIDEO );   // SetKey Comp,Out,Type=[MEM,MEM,=]p6-241

        color = 255;
        VG_SetPenColor( &color );
        VG_MoveTo(  10,Position-Size/2 );       // draw 2 horz., 1 vert line
        VG_LineTo( 501,Position-Size/2 );
        VG_MoveTo(  10,Position+Size/2 );
        VG_LineTo( 501,Position+Size/2 );
        VG_MoveTo( Col,Position-30 );
        VG_LineTo( Col,Position+30 );

        MarkerPosition = Position ;   // save for others
        MarkerSize = Size ;   // VB insures that this is even
        MarkerCol = Col ;
        }

int FAR PASCAL
cGetThreshold( unsigned long far Dry[], unsigned long far Back[], unsigned long far *max )
        {
        int i ; // note: max is for VB plot scaling.

        VG_SetDispType( MEMORY_VIDEO );         // SetObjectColor(&low,&high) (default)
        VG_SetKeyComp( MEMORY );
```

```
        VG_SetKeyOut( LIVE );                    // Must make Keyer output LIVE for
PROGRESSIVE Grab
        VG_SetKeyType( SPECIAL );
        VG_SetGrabDestPos( 0,0 );
        VG_SingleGrab();        while ( VG_GetGrabSt() );  // wait for Grab
        VG_SetImageSourcePos( 0,MarkerCol,MarkerPosition-3*MarkerSize/2-1,512-
MarkerCol,MarkerSize+1 );
        VG_CalcHisto( Back );
        VG_SetImageSourcePos( 0,MarkerCol,MarkerPosition-MarkerSize/2,512-
MarkerCol,MarkerSize+1 );
        VG_CalcHisto( Dry );
        for ( i=64,*max=0 ;  i<255  ; i++ ) if ( Back[i]>*max ) *max=Back[i] ;
        for ( i=0 ;  i<256 && Back[i]==0 && Dry[i]==0  ; i++ ) ;
        return i-5 ;   // Threshold: i is lowest gray level
        }

double
GetSlope( double FAR L[], int NumFitPts )
        {       //  Least squares Regression; L*L = Slope*i  (T=i*dT)
        int     i ;
        double  Sumii=0., SumiLL=0., maxL ;

        maxL = (510-MarkerCol)/xPixPerMM ;    // Don't include points off screen
        if ( L[i]>=maxL ) return 0. ;         // Avoid blow-up if cursor jumped to edge
        for ( i=0 ;  i<NumFitPts && L[i]<maxL  ; i++ ) {
                SumiLL += i*L[i]*L[i] ;
                Sumii += i*i ;
                }
        return SumiLL/(Sumii*dT) ;    // return Slope with 0 intercept
        }

int
Dark( unsigned char far *ptr, unsigned char Threshold )
        {  // Check MarkerSize vertical line; If fluid (dark) advancing, return 1
        int y ;

        for ( y=0 ;  y<=MarkerSize  ; y++,ptr+=512 )
                if ( *ptr < Threshold )   return 1 ;
        return 0 ;
        }

void
DrawMarker( unsigned char far *ptr )
        {       // Draw vertical fluid interface marker
        int  y ;

        for ( y=0 ;  y<=MarkerSize  ; y++,ptr+=512 )
                *ptr = 255 ;
        }

struct Ktype {
        unsigned short int rows ;
        unsigned short int cols ;
        double nums[64] ;
        } ;

struct Ktype FAR Ldata ;

struct Ktype FAR * FAR PASCAL        // called by Excel
cCtoXL(void)
        {
        return &Ldata ;
        }

double FAR PASCAL
cDoWet( double FAR L[], int Threshold, double FAR *Slope, int NumFitPts )
        {
        // Wait for fluid, then start sampling @ 30 samples/sec till SNAPS.
        // Get L[i]'s.
        // Returns RunTime.

        int      i ;
        long     StartTime ;
        unsigned char FB=0 ;
        unsigned char far *ptr ;
```

```
unsigned char far *ptr0 ;
unsigned char far *end ;
double  Tc ;

VG_SetCPUFrameBuf( FB );
VG_SetGrabFrameBuf( FB );

VG_SetWinType( 1,LINE_PTR );
VG_SetLineWidth( 1,WIDTH512 );
VG_SetWinOrig( 1,0,MarkerPosition-MarkerSize/2+360 );

ptr = ptr0 = _VG_AcsBufAdd[1] + MarkerCol; // Pixels from left edge of image
end = _VG_AcsBufAdd[1] + 511 ;

VG_SetGrabRegUpd( DIRECT );
VG_SetDispType( MEMORY_VIDEO );
VG_SetKeyComp( MEMORY );
VG_SetKeyOut( LIVE );  // Must make Keyer output LIVE for PROGRESSIVE Grab
VG_SetKeyType( SPECIAL );
VG_SetGrabDestPos( 0,360 );

StartTime = GetCurrentTime();
do      {               // ******************************** Wait for fluid loop
        VG_SingleGrab();
        if ( GetCurrentTime()-StartTime  > 4000 )  {  // Time Out, No Wet
                while ( VG_GetGrabSt() ) ;     // wait for end of Grab
                for ( i=0 ;  i<SNAPS  ; i++ )  L[i]=0.;
                goto EndWet ;
                }
        while ( VG_GetGrabSt() ) ;     // wait for end of Grab
        }
while (  !Dark(ptr,(unsigned char)Threshold)  );

StartTime = GetCurrentTime() ;        // ************** Now follow fluid
for ( i=0 ;  i<SNAPS  ; i++ ) {
        if ( i<3 )  VG_SetGrabDestPos( 0,240-i*120 );        // next grab in new
loc
        else  {
                VG_SetGrabFrameBuf( (FB^=FB) );       // Toggle Frame Buffers
                VG_SetCPUFrameBuf( (FB^=FB) );
                }
        VG_SingleGrab();       // start next grab, then analyze previous below

        while ( ptr<end  &&  Dark(ptr,(unsigned char)Threshold) ) { // find fluid
front
                ++ptr ;
                }
        DrawMarker( ptr );
        L[i] = (ptr-ptr0)/xPixPerMM ;                          // At i'th time slot

        while ( VG_GetGrabSt() ) ;                             // wait for end of
Grab
        if ( i<3 )  VG_SetWinOrig( 1,0,MarkerPosition-MarkerSize/2+240-i*120 );
        }
EndWet :        // Time Out (No Wet) jumped here.
Tc = (GetCurrentTime()-StartTime)/1000. ;
VG_SetGrabFrameBuf( 0 );       // Make sure these are set to FB 0
VG_SetCPUFrameBuf( 0 );

*Slope = GetSlope( L,NumFitPts );

Ldata.rows = SNAPS/4+1 ;       // Copy data to structure for cCtoXL, 0:30 (31pts)
Ldata.cols = 1 ;                       //    Be sure to get Excel arrayCtoXL matched
up.
for ( i=0 ;  i<=SNAPS/4  ; i++ )  Ldata.nums[i] = L[4*i] ;  // copy every other

if ( Tc>(int)(1+(SNAPS+1)*dT*18.2)/18.2  ||  Tc<(int)(-1+(SNAPS-1)*dT*18.2)/18.2 )
        return -Tc ;
else  return  Tc ;
}
```

cwet.def

```
LIBRARY      CWET
EXETYPE      WINDOWS

CODE         PRELOAD MOVEABLE DISCARDABLE
DATA         PRELOAD SINGLE
SEGMENTS    'WEP_TEXT' FIXED PRELOAD

HEAPSIZE     4096

EXPORTS
    WEP @1 RESIDENTNAME
    cInitIP @2
    cSetPixPerMM @3
    cLiveImage  @4
    cDoWet  @5
    cCtoXL  @6
    cQuitIP @7
    cGetThreshold @8
    cShowThreshold @9
    cCalibrate  @10
```

- 38 -
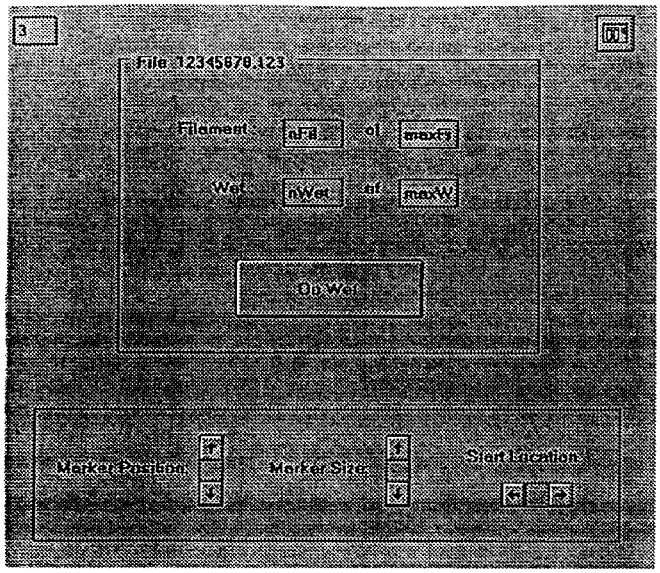

- 39 -

```
MAIN.FRM - 1

VERSION 2.00
Begin Form M
   Caption          =   "Single Filament Wetting"
   ControlBox       =   0   'False
   Height           =   6552
   Left             =   12
   LinkMode         =   1  'Source
   LinkTopic        =   "M"
   MaxButton        =   0   'False
   MinButton        =   0   'False
   ScaleHeight      =   484
   ScaleMode        =   3  'Pixel
   ScaleWidth       =   561
   Top              =   12
   Width            =   6828
   Begin CommonDialog OpenDialog
      Left          =   6120
      Top           =   120
   End
   Begin Frame MarkerFrame
      Height        =   1452
      Left          =   360
      TabIndex      =   11
      Top           =   4080
      Visible       =   0   'False
      Width         =   6012
      Begin HScrollBar StartCol
         Height     =   252
         Left       =   4800
         Max        =   300
         TabIndex   =   17
         Top        =   840
         Width      =   732
      End
      Begin VScrollBar MarkerSize
         Height     =   732
         Left       =   3600
         Max        =   26
         Min        =   4
         SmallChange =  2
         TabIndex   =   15
         Top        =   360
         Value      =   10
         Width      =   252
      End
      Begin VScrollBar MarkerPosition
         Height     =   732
         Left       =   1680
         Max        =   105
         Min        =   15
         TabIndex   =   14
         Top        =   360
         Value      =   105
         Width      =   252
      End
      Begin Label Label6
         Caption    =   "Marker Size:"
         Height     =   252
         Left       =   2400
         TabIndex   =   13
         Top        =   600
```

```
MAIN.FRM - 2
        Width            =   1092
      End
      Begin Label Label5
         Caption         =   "Marker Position:"
         Height          =   252
         Left            =   240
         TabIndex        =   12
         Top             =   600
         Width           =   1452
      End
      Begin Label Label7
         Caption         =   "Start Location:"
         Height          =   252
         Left            =   4440
         TabIndex        =   16
         Top             =   480
         Width           =   1332
      End
   End
   Begin Frame FileFrame
      Caption          =   " File  12345678.123  "
      Height           =   3132
      Left             =   1200
      TabIndex         =   1
      Top              =   480
      Visible          =   0   'False
      Width            =   4332
      Begin CommandButton DoWetButton
         Caption         =   "Do Wet"
         Height          =   612
         Left            =   1200
         TabIndex        =   10
         Top             =   2160
         Width           =   1932
      End
      Begin TextBox maxWet
         Height          =   288
         Left            =   2880
         TabIndex        =   9
         Text            =   "maxWet"
         Top             =   1320
         Width           =   612
      End
      Begin TextBox nWet
         Height          =   288
         Left            =   1680
         TabIndex        =   8
         Text            =   "nWet"
         Top             =   1320
         Width           =   612
      End
      Begin TextBox maxFil
         Height          =   288
         Left            =   2880
         TabIndex        =   7
         Text            =   "maxFil"
         Top             =   720
         Width           =   612
      End
      Begin TextBox nFil
         Height          =   288
```

- 41 -

MAIN.FRM - 3

```
            Left            =   1680
            TabIndex        =   6
            Text            =   "nFil"
            Top             =   720
            Width           =   612
         End
         Begin Label Label4
            Caption         =   "of"
            Height          =   252
            Left            =   2520
            TabIndex        =   5
            Top             =   1320
            Width           =   252
         End
         Begin Label Label3
            Caption         =   "Wet :"
            Height          =   255
            Left            =   960
            TabIndex        =   4
            Top             =   1320
            Width           =   615
         End
         Begin Label Label2
            Caption         =   "of"
            Height          =   252
            Left            =   2520
            TabIndex        =   3
            Top             =   720
            Width           =   252
         End
         Begin Label Label1
            Caption         =   "Filament :"
            Height          =   255
            Left            =   600
            TabIndex        =   2
            Top             =   720
            Width           =   975
         End
      End
      Begin TextBox x
         Height          =   300
         Left            =   120
         LinkTimeout     =   -1
         TabIndex        =   0
         Text            =   "3  "
         Top             =   120
         Visible         =   0   'False
         Width           =   450
      End
      Begin Menu mFile
         Caption         =   "File"
         Begin Menu mOpen
            Caption         =   "Open File"
         End
         Begin Menu mView
            Caption         =   "View File"
         End
         Begin Menu mCalibrate
            Caption         =   "Calibrate"
         End
         Begin Menu mExit
```

```
MAIN.FRM - 4
        Caption          =   "Exit Wetting"
      End
   End
End
```

MAIN.FRM - 1

```
Sub PlotData (L#(), Slope#, NumFitPts%)
    Dim J%, maxPoints!, maxLength!

    maxLength = 10       'mm
    maxPoints = 120      'time = Point*dT
    Plot.Picture1.Scale (0, maxLength)-(maxPoints, 0)
    Plot.Picture1.Cls: Plot.Picture1.CurrentY = maxLength
    Plot.Picture1.Print " Slope = " + Format$(Slope, "#.0")
    For J = 0 To maxPoints
      Plot.Picture1.Circle (J, L(J)), maxPoints / 200, RED         'raw data
      Plot.Picture1.Circle (J, L(J) * L(J) / 10), maxPoints / 200, GREEN  'linea
rized
      If J < NumFitPts And Sqr(Slope * .033333 * (J + 1)) <= 10 Then Plot.Pictur
e1.Line (J, Sqr(Slope * .033333 * J))-(J + 1, Sqr(Slope * .033333 * (J + 1))), C
YAN
    Next J

    Plot.PrintThreshold.Caption = "Threshold:" + Str$(Threshold)
    Plot.Show
End Sub

Sub DoWetButton_Click ()
    Static Pos(128) As Double
    ReDim Dry(257) As Long, Back(257) As Long
    Dim RunTime#, Slope#, r#, le#, NumFitPts%

    If Threshold = 0 Then
        MsgBox "Please Set Threshold.", MB_ICONEXCLAMATION, "Invalid Threshold"
        Exit Sub
    End If

    DoWetButton.Caption = "Release Fluid"
    Screen.MousePointer = 11
    DoEvents    'This should not be needed; but sometimes cDoWet didn't get star
ted right
    NumFitPts = 30  '30=1sec
    RunTime = cDoWet(Pos(0), Threshold, Slope, NumFitPts)
    Screen.MousePointer = 0
    DoWetButton.Caption = "Do Wet"

    If RunTime < 0 Then
        MsgBox "Note RunTime Discrepancy.  RunTime=" + Format$(Abs(RunTime), "#.
00") + " sec", MB_ICONEXCLAMATION, "RunTime Error"
    End If

    PlotData Pos(), Slope, NumFitPts

    M.x.LinkExecute "[RUN(" + Q$ + "XWET.XLM!arrayCtoXL" + Q$ + ")]"
    M.x.LinkExecute "[FORMULA(" + Format$(Slope, "#.000") + ")]"

    If (Val(nWet.Text) + 1) > Val(maxWet.Text) Then     'set nFil/nWet for next
        nWet.Text = "1"
        If Val(nFil.Text) = Val(maxFil.Text) Then MsgBox "You have completed " +
nFil.Text + " Filaments.", MB_ICONINFORMATION, "Reminder"
        nFil.Text = Str$(Val(nFil.Text) + 1)
        M.x.LinkExecute "[SAVE()]"      'save while new filament is loaded
        DoEvents
    Else
        nWet.Text = Str$(Val(nWet.Text) + 1)
```

```
MAIN.FRM - 2

    End If
End Sub

Sub Form_Click ()
    cLiveImage MarkerPosition.Value, MarkerSize.Value, StartCol.Value
End Sub

Sub MarkerPosition_Change ()
    cLiveImage MarkerPosition.Value, MarkerSize.Value, StartCol.Value
End Sub

Sub MarkerSize_Change ()
    cLiveImage MarkerPosition.Value, MarkerSize.Value, StartCol.Value
End Sub

Sub maxFil_Change ()
    putXL (maxFil.Text), "maxFil"
End Sub

Sub maxWet_Change ()
    putXL (maxWet.Text), "maxWet"
End Sub

Sub mCalibrate_Click ()
    Calibrate.Show MODAL
End Sub

Sub mExit_Click ()
    cQuitIP     'does IP8 QuitLib

    x.LinkMode = NONE   'close link to current spreadsheet
    x.LinkTopic = "Excel|xwet.xlm"
    x.LinkMode = COLD
    x.LinkExecute "{RUN(" + Q$ + "XWET.XLM!ClearOut" + Q$ + ")}" 'close all exce
pt XWET.XLM

    i% = WritePrivateProfileString("Defaults", "MarkerRow", Str$(MarkerPosition.
Value), IniFile)
    i% = WritePrivateProfileString("Defaults", "MarkerSize", Str$(MarkerSize.Val
ue), IniFile)
    i% = WritePrivateProfileString("Defaults", "StartCol", Str$(StartCol.Value),
 IniFile)

    'AppActivate "Microsoft Excel - XWET.XLM"
    SendKeys "%{TAB}", True
    SendKeys "%fx", True
    z% = DoEvents()
    End
End Sub

Sub mOpen_Click ()
    OpenSheet
End Sub

Sub mView_Click ()
    SendKeys "%{TAB}", True
    'AppActivate "Microsoft Excel - " & OpenDialog.Filetitle
End Sub

Sub nFil_Change ()
    putXL (nFil.Text), "nFil"
```

```
MAIN.FRM - 3

End Sub

Sub nWet_Change ()
    putXL (nWet.Text), "nWet"
End Sub

Sub StartCol_Change ()
    cLiveImage MarkerPosition.Value, MarkerSize.Value, StartCol.Value
End Sub
```

- 46 -
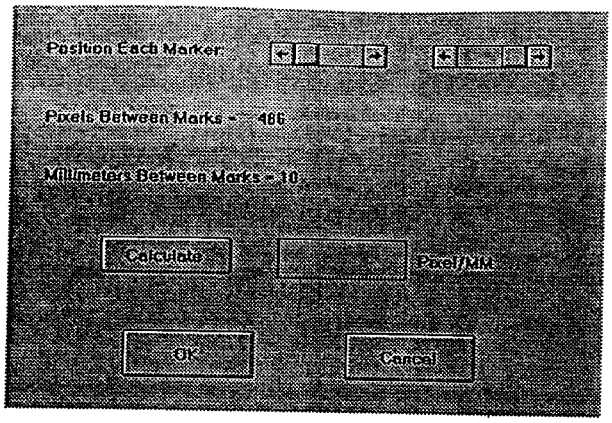

- 47 -

```
CALIBRAT.FRM - 1

VERSION 2.00
Begin Form Calibrate
   Caption          =   "Calibrate"
   ControlBox       =   0   'False
   Height           =   4608
   Left             =   336
   LinkMode         =   1  'Source
   LinkTopic        =   "Form1"
   MaxButton        =   0   'False
   MinButton        =   0   'False
   ScaleHeight      =   4188
   ScaleWidth       =   6108
   Top              =   1428
   Width            =   6204
   Begin CommandButton CancelButton
      Caption          =   "Cancel"
      Height           =   495
      Left             =   3480
      TabIndex         =   10
      Top              =   3360
      Width            =   1335
   End
   Begin CommandButton OkButton
      Caption          =   "OK"
      Height           =   495
      Left             =   1200
      TabIndex         =   9
      Top              =   3360
      Width            =   1335
   End
   Begin TextBox xPixPerMM
      Height           =   405
      Left             =   2760
      TabIndex         =   6
      Top              =   2400
      Width            =   1335
   End
   Begin CommandButton Calx
      Caption          =   "Calculate"
      Height           =   375
      Left             =   960
      TabIndex         =   4
      Top              =   2400
      Width            =   1335
   End
   Begin HScrollBar HScroll2
      Height           =   255
      LargeChange      =   10
      Left             =   4320
      Max              =   509
      Min              =   156
      TabIndex         =   1
      Top              =   360
      Value            =   499
      Width            =   1215
   End
   Begin HScrollBar HScroll1
      Height           =   255
      LargeChange      =   10
      Left             =   2640
      Max              =   356
```

```
CALIBRAT.FRM - 2

      Min              =   2
      TabIndex         =   0
      Top              =   360
      Value            =   13
      Width            =   1215
   End
   Begin Label Label3
      Caption          =   "Pixel/MM"
      Height           =   255
      Left             =   4200
      TabIndex         =   5
      Top              =   2520
      Width            =   975
   End
   Begin Label Label2
      Caption          =   "Millimeters Between Marks = 10"
      Height           =   255
      Left             =   360
      TabIndex         =   3
      Top              =   1680
      Width            =   2895
   End
   Begin Label Pixels
      Caption          =   "486"
      Height           =   252
      Left             =   2520
      TabIndex         =   8
      Top              =   1080
      Width            =   612
   End
   Begin Label Label4
      Caption          =   "Pixels Between Marks ="
      Height           =   252
      Left             =   360
      TabIndex         =   7
      Top              =   1080
      Width            =   2052
   End
   Begin Label Label1
      Caption          =   "Position Each Marker:"
      Height           =   255
      Left             =   360
      TabIndex         =   2
      Top              =   360
      Width            =   2055
   End
End
```

CALIBRAT.FRM - 1

```
'Uses Global IniFile in FileButton_Click

Declare Sub cCalibrate Lib "cwet.dll" (ByVal LiveOrSnap$, ByVal l%, ByVal r%)

Sub Calx_Click ()
    xPixPerMM.Text = Format$(Val(Pixels.Caption) / 10, "#.0000")
End Sub

Sub CancelButton_Click ()
    cLiveImage M.MarkerPosition.Value, M.MarkerSize.Value, M.StartCol.Value
    Unload Calibrate
End Sub

Sub Form_Load ()
    cCalibrate "StartUp", HScroll1.Value, HScroll2.Value
End Sub

Sub HScroll1_Change ()
    cCalibrate "Scroll", HScroll1.Value, HScroll2.Value
    Pixels.Caption = Str$(HScroll2.Value - HScroll1.Value)
End Sub

Sub HScroll2_Change ()
    cCalibrate "Scroll", HScroll1.Value, HScroll2.Value
    Pixels.Caption = Str$(HScroll2.Value - HScroll1.Value)
End Sub

Sub OkButton_Click ()
    i% = WritePrivateProfileString("Defaults", "xPixPerMM", (xPixPerMM.Text), In
iFile)
    cSetPixPerMM (IniFile)        'tell C to get new value
    cLiveImage M.MarkerPosition.Value, M.MarkerSize.Value, M.StartCol.Value
    Unload Calibrate
End Sub
```

- 50 -
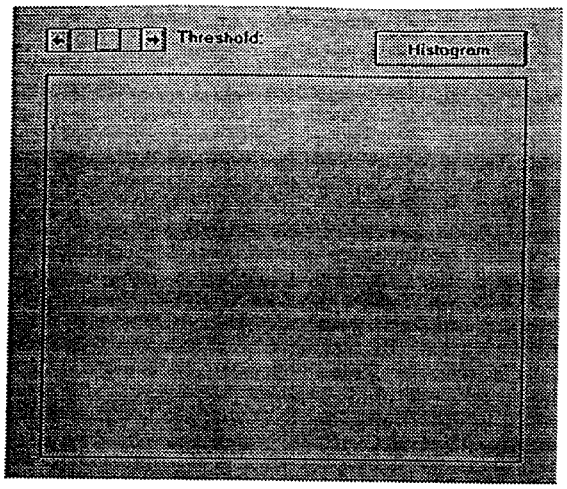

```
PLOT.FRM - 1

VERSION 2.00
Begin Form Plot
   Caption          =   "Data and Fit"
   Height           =   5340
   Left             =   3096
   LinkMode         =   1  'Source
   LinkTopic        =   "Form2"
   ScaleHeight      =   4920
   ScaleWidth       =   5652
   Top              =   480
   Width            =   5748
   Begin PictureBox Picture1
      AutoRedraw       =   -1  'True
      Height           =   3975
      Left             =   360
      ScaleHeight      =   3948
      ScaleWidth       =   4908
      TabIndex         =   0
      Top              =   720
      Width            =   4935
   End
   Begin CommandButton Histogram
      Caption          =   "Histogram"
      Height           =   375
      Left             =   3720
      TabIndex         =   3
      Top              =   240
      Width            =   1575
   End
   Begin HScrollBar ThresholdScroll
      Height           =   255
      LargeChange      =   10
      Left             =   360
      Max              =   255
      TabIndex         =   1
      Top              =   240
      Value            =   140
      Width            =   1215
   End
   Begin Label PrintThreshold
      Caption          =   "Threshold:"
      Height           =   255
      Left             =   1680
      TabIndex         =   2
      Top              =   240
      Width            =   1335
   End
End
```

```
PLOT.FRM - 1

Dim MaxPix As Long


Sub Histogram_Click ()
    ReDim Dry(257) As Long, Back(257) As Long
    Dim J%, MaxGray%, Thresh%

    Thresh = cGetThreshold(Dry(0), Back(0), MaxPix)

    MaxGray = 255
    Plot.Picture1.DrawMode = 13 'copy pen
    Plot.Picture1.Cls
    Plot.Picture1.Scale (0, MaxPix)-(MaxGray, -2)
    For J = 0 To MaxGray - 1
      Plot.Picture1.Line (J, Back(J))-(J + 1, Back(J + 1)), RED
      Plot.Picture1.Line (J, Dry(J))-(J + 1, Dry(J + 1)), GREEN
    Next J
    Plot.Picture1.DrawMode = 7  'xor pen
    Plot.Picture1.Line (Threshold, 0)-(Threshold, MaxPix / 3), WHITE
    ThresholdScroll.Value = Thresh      'triggers ThresholdScroll_Change
    ThresholdScroll.SetFocus
End Sub

Sub ThresholdScroll_Change ()
    Plot.Picture1.Line (Threshold, 0)-(Threshold, MaxPix / 3), WHITE  'erase
    Threshold = ThresholdScroll.Value
    Plot.Picture1.Line (Threshold, 0)-(Threshold, MaxPix / 3), WHITE
    PrintThreshold.Caption = "Threshold:" + Str$(Threshold)
    cShowThreshold Threshold
End Sub

Sub ThresholdScroll_LostFocus ()
    Plot.Picture1.DrawMode = 13 'copy pen
End Sub
```

EXCEL.BAS - 1

```
Declare Function FindWindow Lib "User" (lpClassName As Any, lpWindowName As Any)
 As Integer


Function FileExists (FileName$) As Integer
    Dim s As OFSTRUCT
    'This assumes no OFN_NOCHANGEDIR flag in OpenDialog box; ie file in current
dir
    i% = OpenFile(FileName, s, &H4000)  'OF_EXIST = &H4000
    If i% = -1 Then
        FileExists = False
    Else
        FileExists = True
    End If
End Function

Function getXL$ (Item$)
    M.x.LinkItem = Item
    M.x.LinkRequest
    getXL = Left$(M.x.Text, Len(M.x.Text) - 2) 'remove last 2 somethings that Ex
cel includes
End Function


Sub Main ()
    Q$ = Chr$(34) 'double quote used various places

    Path = "c:\projects\wetting"
    ChDir Path
    IniFile = Path + "\wet.ini"

    If cInitIP() <> 0 Then
        MsgBox "Initialization Error " + Str$(i%), MB_ICONSTOP, "IP8 Error"
        End
    End If

    If FindWindow(ByVal "XLMain", ByVal 0&) = False Then
        x$ = "Excel " + Path + "\XWET.XLM"
        z% = Shell(x$, 4)  ' Start Excel. 4=Normal w/o focus,7=Min w/o
    End If

    Plot.Show
    M.Show
    OpenSheet

    cSetPixPerMM (IniFile)       'tell C to get xPixPerMM
    M.MarkerPosition.Value = GetPrivateProfileInt("Defaults", "MarkerRow", 99, I
niFile)
    M.MarkerSize.Value = GetPrivateProfileInt("Defaults", "MarkerSize", 99, IniF
ile)
    M.StartCol.Value = GetPrivateProfileInt("Defaults", "StartCol", 99, IniFile)
    cLiveImage M.MarkerPosition.Value, M.MarkerSize.Value, M.StartCol.Value
End Sub

Sub OpenSheet ()
    M.OpenDialog.DefaultExt = "xls"   'This section sets up and calls Open Dialo
g Box
    M.OpenDialog.DialogTitle = "Open/Create File"
    M.OpenDialog.FileName = ""
    M.OpenDialog.Filter = "All Files  (*.*)|*.*|Excel Sheets  (*.xls)|*.xls"
    M.OpenDialog.Flags = OFN_CREATEPROMPT   'OFN_NOCHANGEDIR: let change, note C
```

EXCEL.BAS - 2

```
hDir below
    M.OpenDialog.InitDir = "data"
    M.OpenDialog.Action = 1     'Windows does Dialog Box
    If M.OpenDialog.FileName = "" Then Exit Sub   'Cancel returns empty filename

    M.x.LinkMode = NONE   'close link to current spreadsheet
    M.x.LinkTopic = "Excel|System"
    M.x.LinkMode = COLD
    M.x.LinkExecute "[RUN(" + Q$ + "XWET.XLM!ClearOut" + Q$ + ")]" 'close all ex
cept XWET.XLM & CONTROL.XLS

    If FileExists((M.OpenDialog.FileTitle)) Then
        M.x.LinkExecute "[OPEN(" + Q$ + M.OpenDialog.FileName + Q$ + ")]"
    Else
        M.x.LinkExecute "[OPEN(" + Q$ + Path + "\xwet.xlt" + Q$ + ")]"
        M.x.LinkExecute "[SAVE.AS(" + Q$ + M.OpenDialog.FileName + Q$ + ",1)]"
    End If

    ChDir Path

    M.x.LinkTopic = "Excel|" + M.OpenDialog.FileTitle
    M.x.LinkMode = COLD

    M.nFil.Text = getXL("nFil")      'ReadExcel
    M.nWet.Text = getXL("nWet")
    M.maxFil.Text = getXL("maxFil")
    M.maxWet.Text = getXL("maxWet")

    M.FileFrame.Caption = " File: " & M.OpenDialog.FileTitle
    M.FileFrame.Visible = True
    M.MarkerFrame.Visible = True

    Threshold = 0        'Force evaluation of new Threshold in M.DoWetButton_Clic
k
End Sub

Sub putXL (ValStr$, Item$)
    M.x.LinkItem = Item
    M.x.Text = ValStr
    M.x.LinkPoke
End Sub
```

GLOBAL.BAS - 1

```
Global Path$, IniFile$        'set in Excel.bas, Sub Main
Global Q$                     'quotes " ; set in Excel main ; used in LinkExecute
Global Threshold%             'set in Plot ThresholdScroll_Change, used in M DoWet

'************* cWET.DLL calls ************************************************

Declare Function cInitIP% Lib "cwet.dll" ()
Declare Sub cQuitIP Lib "cwet.dll" ()
Declare Sub cSetPixPerMM Lib "cwet.dll" (ByVal IniFileName$)
Declare Sub cLiveImage Lib "cwet.dll" (ByVal Position%, ByVal Size%, ByVal Start
Col%)
Declare Function cDoWet# Lib "cwet.dll" (l As Double, ByVal Threshold%, slope#,
ByVal NumFitPts%)
Declare Sub cShowThreshold Lib "cwet.dll" (ByVal thresh%)
Declare Function cGetThreshold% Lib "cwet.dll" (Wet As Long, Back As Long, MaxPi
x As Long)


'*********** Windows API calls, From WINAPI.WRI ****************************

Declare Function WritePrivateProfileString% Lib "Kernel" (ByVal lpAppName$, ByVa
l lpKeyName$, ByVal lpString$, ByVal lpFileName$)
Declare Function GetPrivateProfileInt% Lib "Kernel" (ByVal lpAppName$, ByVal lpK
eyName$, ByVal nDefault%, ByVal lpFileName$)

Type OFSTRUCT        '  OpenFile() Structure, used by Excel.bas FileExists
    cBytes As String * 1
    fFixedDisk As String * 1
    nErrCode As Integer
    reserved As String * 4
    szPathName As String * 128
End Type
Declare Function OpenFile Lib "Kernel" (ByVal lpFileName As String, lpReOpenBuff
 As OFSTRUCT, ByVal wStyle As Integer) As Integer


'******** Visual Basic global constant file; Edited by WTC 4/92 ***************
********

Global Const NONE = 0

Global Const mLEFT = 1  'LEFT_BUTTON
Global Const mRIGHT = 2 'RIGHT_BUTTON

' MsgBox parameters
Global Const MB_OK = 0                    ' OK button only
Global Const MB_OKCANCEL = 1              ' OK and Cancel buttons
Global Const MB_ABORTRETRYIGNORE = 2      ' Abort, Retry, and Ignore buttons
Global Const MB_YESNOCANCEL = 3           ' Yes, No, and Cancel buttons
Global Const MB_YESNO = 4                 ' Yes and No buttons
Global Const MB_RETRYCANCEL = 5           ' Retry and Cancel buttons

Global Const MB_ICONSTOP = 16             ' Critical message
Global Const MB_ICONQUESTION = 32         ' Warning query
Global Const MB_ICONEXCLAMATION = 48      ' Warning message
Global Const MB_ICONINFORMATION = 64      ' Information message

Global Const MB_DEFBUTTON1 = 0            ' First button is default
Global Const MB_DEFBUTTON2 = 256          ' Second button is default
Global Const MB_DEFBUTTON3 = 512          ' Third button is default
```

GLOBAL.BAS - 2

```
' MsgBox return values
Global Const IDOK = 1                    ' OK button pressed
Global Const IDCANCEL = 2                ' Cancel button pressed
Global Const IDABORT = 3                 ' Abort button pressed
Global Const IDRETRY = 4                 ' Retry button pressed
Global Const IDIGNORE = 5                ' Ignore button pressed
Global Const IDYES = 6                   ' Yes button pressed
Global Const IDNO = 7                    ' No button pressed

' Show (form)
Global Const MODAL = 1
Global Const MODELESS = 0

' LinkMode (controls)
Global Const HOT = 1                     ' 1 - Hot
Global Const COLD = 2                    ' 2 - Cold

' Value (check box)
Global Const UNCHECKED = 0               ' 0 - Unchecked
Global Const CHECKED = 1                 ' 1 - Checked
Global Const GRAYED = 2                  ' 2 - Grayed

Global Const WINDOW_TEXT = &H80000008            ' Text in windows.
Global Const GRAY_TEXT = &H80000011              ' Grayed (disabled) text.  This
color is set to 0 if the current display driver does not support a solid gray co
lor.
Global Const BUTTON_TEXT = &H80000012            ' Text on push buttons.

Global Const BLACK = &H0&
Global Const RED = &HFF&
Global Const GREEN = &HFF00&
Global Const YELLOW = &HFFFF&
Global Const BLUE = &HFF0000
Global Const MAGENTA = &HFF00FF
Global Const CYAN = &HFFFF00
Global Const WHITE = &HFFFFFF
```

- 57 -

XWET.XLM

```
Print
=UpdatePlot()
=PRINT(2,1,1,1,FALSE,TRUE,1)
=ArrayToValues()
=RETURN()

ArrayToValues
=SELECT(Z)
=COPY(Z)
=PASTE.SPECIAL(3,1,FALSE,FALSE)
=CANCEL.COPY()
=RETURN()

AddHiLight
Z=((ROW(SELECTION())-ROW(!StartRef)-1)*!maxWet+COLUMN(SELECTION())-COLUMN(!StartRef))
=ACTIVATE(GET.DOCUMENT(1)&" Chart 2")
=SELECT("S"&Z)
=PATTERNS(2,1,1,1,0,2,15,3)
=RETURN()

CancelHiLight
=ACTIVATE(GET.DOCUMENT(1)&" Chart 2")
=SELECT("S1")
=PATTERNS(0,1,1,1,2,1,1,1,TRUE)
=RETURN()

ReturnToSFW
=SEND.KEYS("%{TAB}")
=RETURN()

arrayCtoXL
Z=OFFSET(!PlotRef,1,(!nFil-1)*!maxWet+!nWet,31,1)
=FORMULA.ARRAY(CALL("cwet.dll","cCtoXL","K"),Z)
=FORMULA("F"&!nFil&"W"&!nWet,OFFSET(Z,-1,0))
=SELECT(OFFSET(!StartRef,!nFil,!nWet,1,1))
=RETURN()

UpdatePlot
Z=OFFSET(!PlotRef,1,0,31,(!nFil-1)*!maxWet+!nWet)
=SELECT("Chart 2")
=CHART.WIZARD(FALSE,Z,,,2,1,2)
=RETURN()
```

- 58 -

XWET.XLM

```
ClearOut
=SET.NAME("Docs",DOCUMENTS())
=FOR("Z",1,COLUMNS(Docs))
=  INDEX(Docs,Z)
=  IF(AND(B4<>"XWET.XLM",B4<>"XCONTROL.XLS"))
=     ACTIVATE(B4)
=     FILE.CLOSE(1)
=  END.IF()
=NEXT()
=RETURN()

FilNames
=SELECT(OFFSET(!StartRef,1,0,3,1))
=FILL.AUTO(OFFSET(!StartRef,1,0,!maxFil,1),FALSE)
=UpdatePlot()
=RETURN()

Auto_Open_Mac
=ADD.TOOLBAR("SFW Toolbar",{4,"xwet.xlm!Print",FALSE,TRUE,0,"Print (w/Preview)";0,0,0,0,0,0;138,"xwet.x
=SHOW.TOOLBAR("SFW Toolbar",TRUE,5,,,500)

=WINDOW.MAXIMIZE()
=APP.MAXIMIZE()
=SEND.KEYS("%{TAB}")
=RETURN()

Auto_Close_Mac
=SAVE()
=RETURN()
```

- 59 -

9/27/94

~~DEB.PAT~~ xwet.xLT

FTRL No.: 123
Package No.:
Sample ID:
Operator:

cArea: 0.0
cArea StdDev:
dpf:

| | Slope | Vo | mpf | b |
|---|---|---|---|---|
| Avg: | #DIV/0! | #DIV/0! | #DIV/0! | #DIV/0! |
| StdDev: | #DIV/0! | | | |
| CV: | #DIV/0! | | | |

mpf is two way

Slopes:

| | Wet 1 | Wet 2 | Wet 3 |
|---|---|---|---|
| Flmt 1 | | | |
| Flmt 2 | | | |
| Flmt 3 | | | |
| Flmt 4 | | | |
| Flmt 5 | | | |
| Flmt 6 | | | |
| Flmt 7 | | | |
| Flmt 8 | | | |
| Flmt 9 | | | |
| Flmt 10 | | | |
| Flmt 11 | | | |
| Flmt 12 | | | |
| Flmt 13 | | | |
| Flmt 14 | | | |
| Flmt 15 | | | |
| Flmt 16 | | | |
| Flmt 17 | | | |
| Flmt 18 | | | |
| Flmt 19 | | | |
| Flmt 20 | | | |

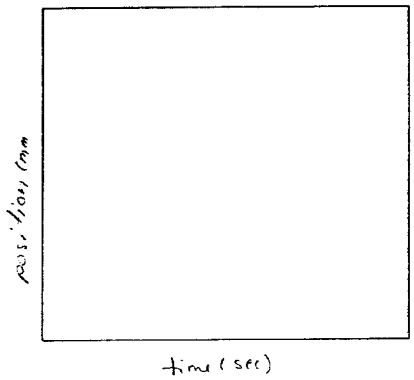

Units:

Slope [mm^2/sec]

Vo [mm/sec] =SQRT(Slope/4T) where T=.022sec mpf [cm^3/(gm*hr)] = 2*.1620*cArea*Vo/dpf b [cm^4/(gm*hr)] =.0081*cArea*Slope/dpf Note: b = .05*SQRT(T)*SQRT(Slope)*mpf Measurement of Advancing Contact Angle The technique (Modified Wilhelmy Slide Method) used to measure the adhesion tension can also be used to measure the Advancing Contact Angle $\theta_a$. The force which is recorded on the microbalance is equal to the adhesion tension times the perimeter of the sample film.

$$\text{Force} = \text{Adhesion Tension} \times \text{Perimeter}$$

$$= \gamma \text{Cos}\theta_a \times p$$

Where $\gamma$ is the surface tension of the fluid (dynes/cm)

$\theta_a$ is the advancing contact angle (degree)

p is the perimeter of the film (cm)

or solving for $\theta_a$:

$$\theta_a = \cos^{-1}\left[\frac{\text{Force}}{\gamma p}\right]$$

For pure fluids and clean surfaces, this is a very simple calculation. However, for the situation which exists when finishes are applied to surfaces and some of this finish comes off in the fluid the effective $\gamma$ is no longer the $\gamma$ of the pure fluid. In most cases the materials which come off are materials which lower significantly the surface tension of the pure fluid (water in this case). Thus, the use of the pure fluid surface tension can cause considerable error in the calculation of $\theta_a$.

To eliminate this error a fluid is made up which contains the pure fluid (water in this case) and a small amount of the material (finish) which was deposited on the sample surface. The amount of the finish added should just exceed the critical micelle level. The surface tension of this fluid is now measured and is used in the $\theta_a$ calculation instead of the pure fluid $\gamma$. The sample is now immersed in this fluid and the Force determined. $\theta_a$ is now determined using the surface tension of the pure fluid with finish added and the Force as measured in the pure fluid with finish added. This $\theta_a$ can now be used in (1−X $\theta_a$) expression to determine if the expression is negative.

Determination of Crimp Amplitude and Crimp Frequency

This describes the determination of crimp amplitude and crimp frequency for fibers in which the crimp is helical (3-dimensional).

The sample is prepared by randomly picking 25 groups of filaments. One filament is picked from each group for testing. Results are the average of the 25 filaments.

A single fiber specimen is placed on a black felt board next to a NBS ruler with one end of the fiber on zero. The relaxed length (Lr) is measured.

The number of crimp peaks (N) are counted with the fiber in the relaxed length. Only top or bottom peaks are counted but not both. Half peaks at both ends are counted as one. Half counts are rounded up.

The single fiber specimen is grasped with tweezers at one end and held at zero on the ruler, and the other end is extended just enough to remove crimp without stretching the filament. The extended length (Le) is measured.

Definitions

Crimp Frequency=The number of crimps per unit straight length of fiber.

Crimp Amplitude=The depth of the crimp, one-half of the total height of the crimp, measured perpendicular to the major axis along the center line of the helically crimped fiber.

Calculations

For a true helix of pitch angle ø having N total turns, a relaxed length Lr, and an extended (straight) length Le, the following equations apply:

$$\text{Le} \cos \varnothing = \text{N}\pi(2\text{A})$$

$$\text{Le} \sin \varnothing = \text{Lr}$$

where A is the previously defined crimp amplitude. From these equations, A is readily calculated from the measured values of Lr, Le, and N as follows:

$$\varnothing = \sin^{-1}(Lr / Le)$$

$$A = \frac{Le}{2N\pi}\cos\varnothing$$

Crimp frequency (C) as previously defined is calculated as follows:

$$C = \frac{N}{Le}.$$

When Le and Lr are expressed in inches, crimp amplitude has units of inches and crimp frequency has units of crimps per inch.

The following examples are to illustrate the invention but should not be interpreted as a limitation thereon.

EXAMPLE 1

Figure 9:
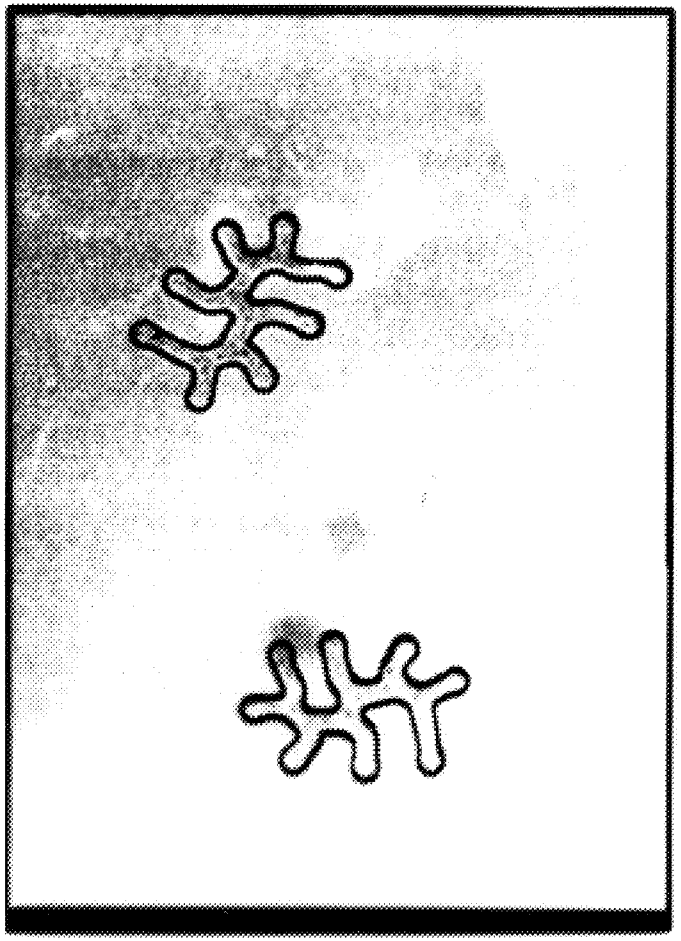
FIG. 9—photomicrograph of a poly(ethylene terephthalate) fiber cross-section made using a spinneret having an orifice as illustrated in FIG. 3.
Figure 10:
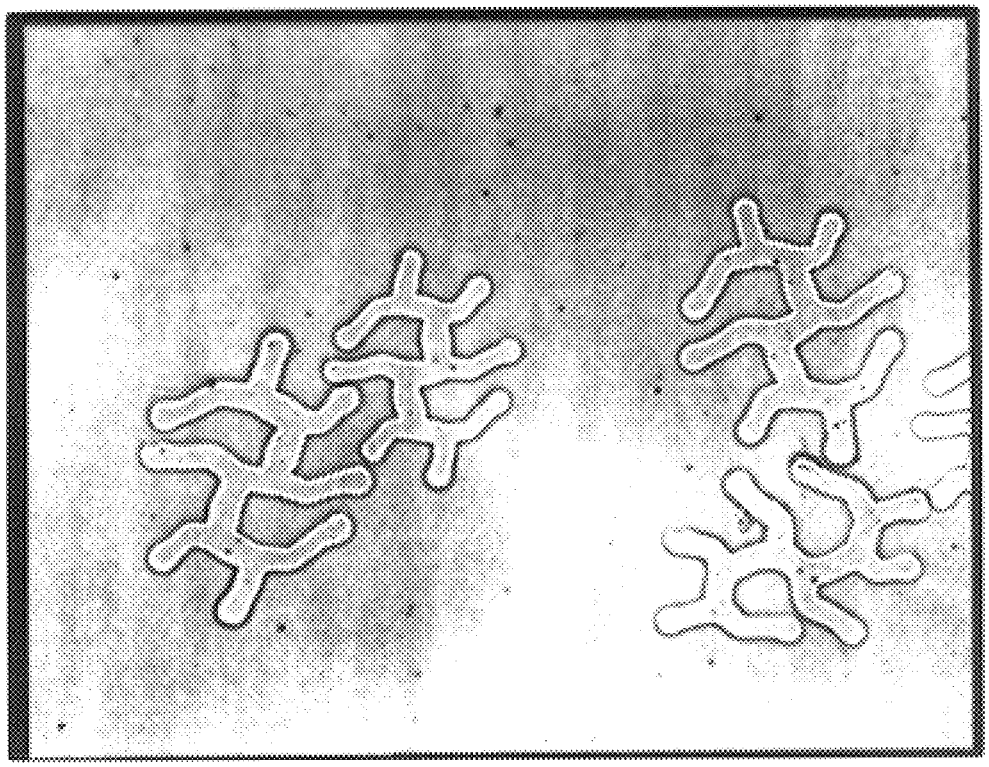
FIG. 10—photomicrograph of a polypropylene fiber cross-section made using a spinneret having an orifice as illustrated in FIG. 3.
Figure 11:
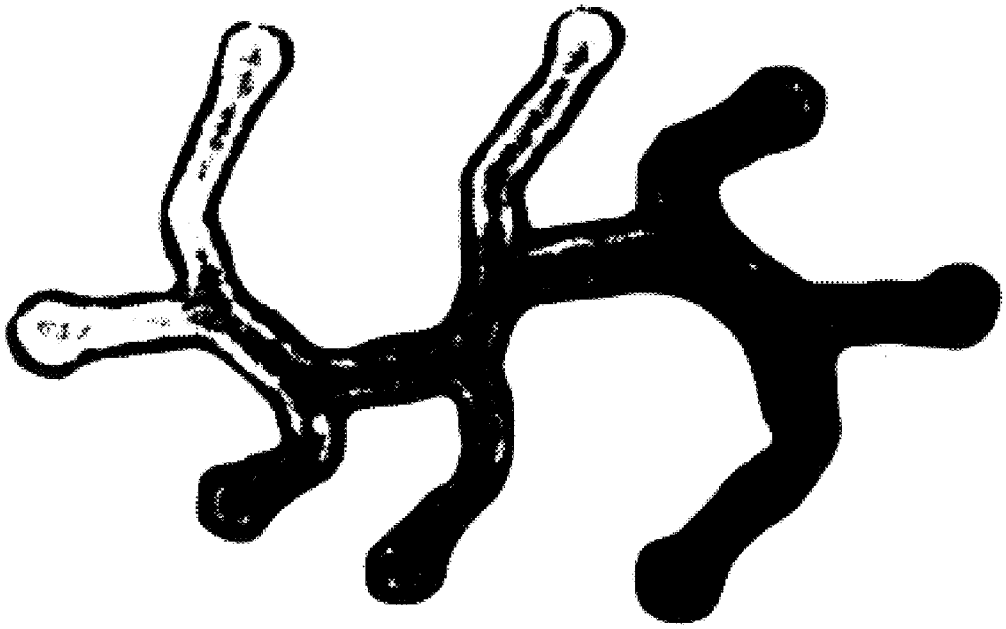
FIG. 11—photomicrograph of a nylon 66 fiber cross-section made using a spinneret having an orifice as illustrated in FIG. 3.
Figure 12:
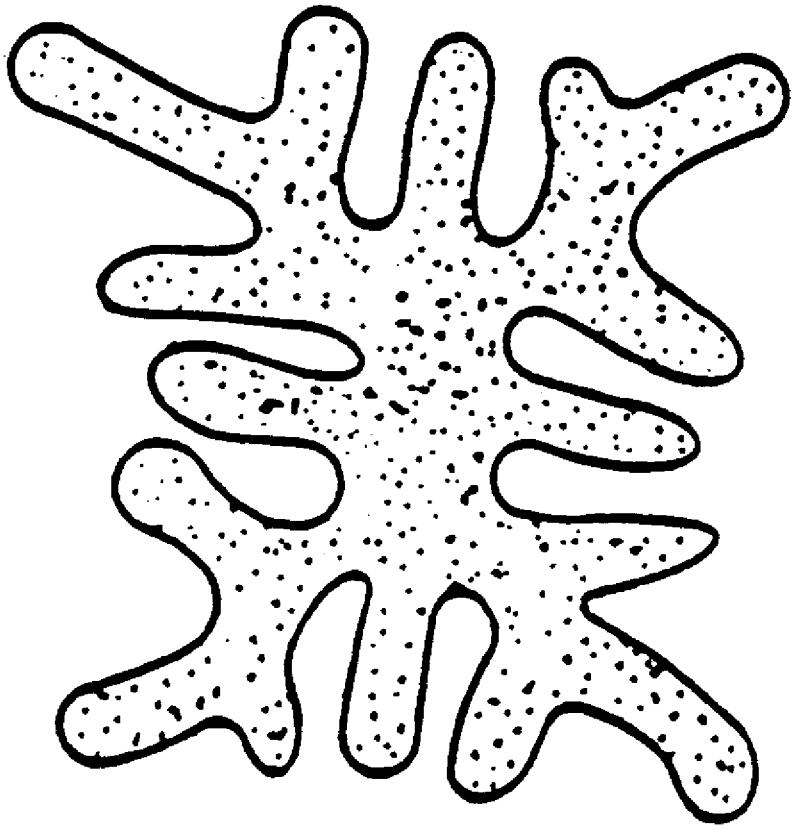
FIG. 12—schematic representation of a poly(ethylene terephthalate) fiber cross-section made using a spinneret having an orifice as illustrated in FIG. 4.
Figure 13:
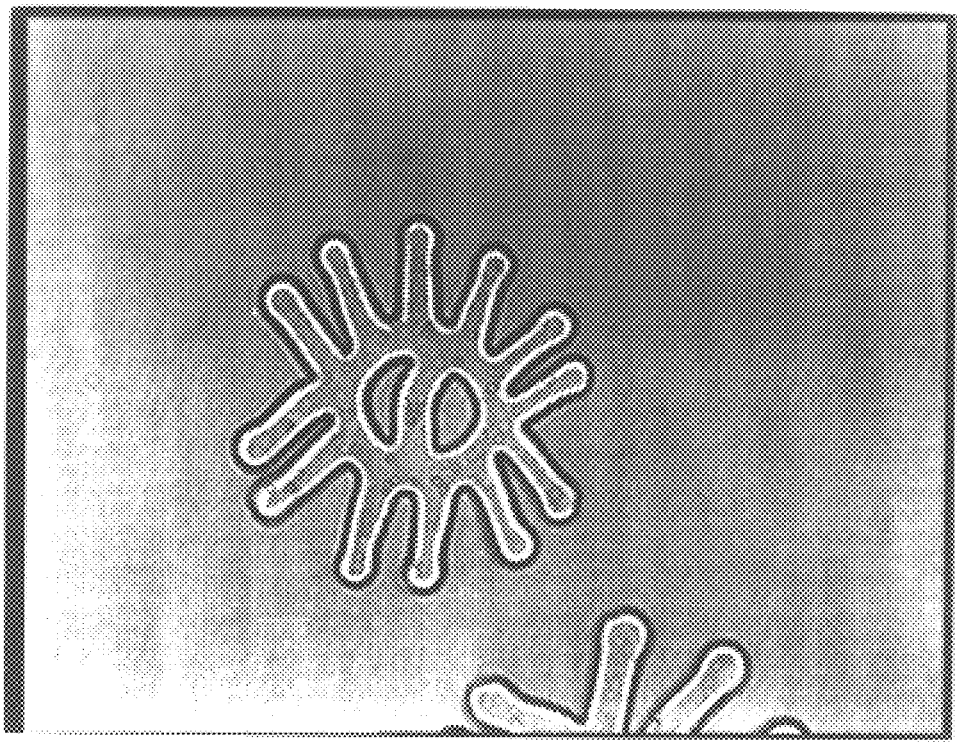
FIG. 13—photomicrograph of a poly(ethylene terephthalate) fiber cross-section made using a spinneret having an orifice as illustrated in FIG. 5.
Figure 14:
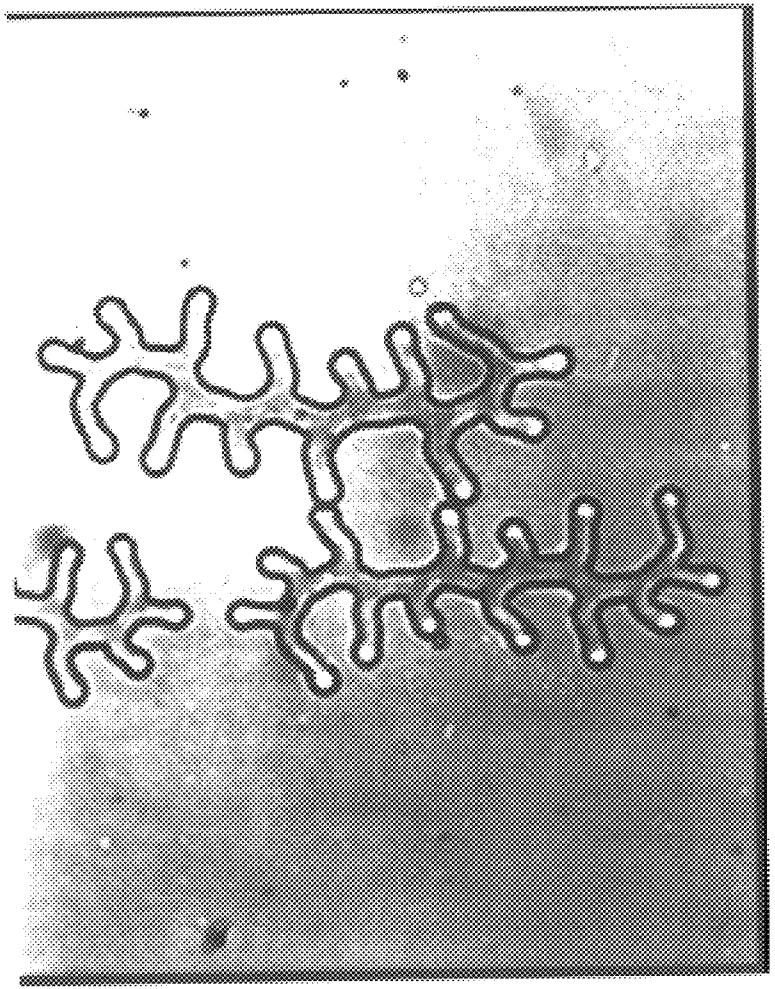
FIG. 14—photomicrograph of a poly(ethylene terephthalate) fiber cross-section made using a spinneret having an orifice as illustrated in FIG. 7.
Figure 15:
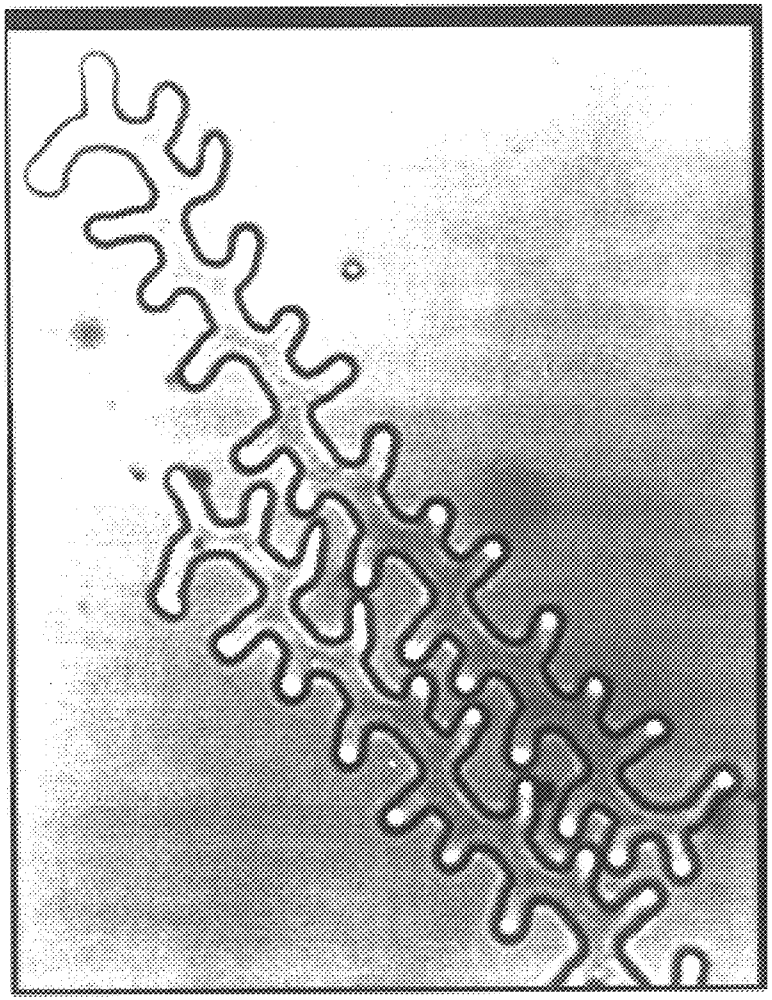
FIG. 15—photomicrograph of a poly(ethylene terephthalate) fiber cross-section made using a spinneret having an orifice as illustrated in FIG. 8.

Six denier per filament grooved polyester fibers shaped as shown in FIG. 9 and lubricated with 0.5% of a mixture of 98% polyoxyethylene sorbitan monolaurate and 2% 4-cetyl-4-ethylmorpholinum ethosulfate in accordance with this invention as described hereinabove are blended with 10% weight polyester binder fiber during carding and a 70 grain (~54,000 denier) sliver was produced. This sliver was then passed through an air flow oven at 325° F. and the residence time was approximately 1 minute to activate the binder. This bonded sliver was then tested by a beautician. Significant improvements in keeping the fluid away from the skin were observed which reduces irritation and burning. An improvement in handling of this product was noted when compared to the cotton sliver currently used in this area. The breaking strength was 105 grams.

EXAMPLE 2

Same as Example 1 except binder fiber was at the 10% level of sheath core binder fiber. The end use results were the same as in Example 10.

EXAMPLE 3

Same as Example 1 except the binder fiber is ~10% binder powder. The carded web was 100% polyester grooved fiber and the binder powder was added at the infrared oven. The warm bonded sliver was collected and coiled into an approximately circular shape. The same advantages listed in Example 10 were observed with this product also.

For Examples 4, 5, and 6, the staple length of the fibers is 3 inches, shape factor is 2.7, maximum potential flux is 122 cc/g/hr, and surface tension of the measuring fluid is 62 dynes/cm.

EXAMPLE 4

The material in Example 1 at the same blend ratio (90/10) was used to make a 100,000 denier sliver in the same manner as disclosed in Example 10. This size sliver probably represents the upper limit on a practical manageable sliver for this end use.

EXAMPLE 5

Same as Example 4 except the sliver denier is 30,000. This size sliver probably represents the lower practical size limit to do a useful job in this end use.

EXAMPLE 6

It is clear that the breaking strength of the sliver can be too weak (cannot handle the sliver without it coming apart) or too strong (difficult to break by the beautician). Experiments on various slivers suggest that 100 grams is a reasonable minimum strength limit and 2,000 grams represent a reasonable maximum strength limit.

EXAMPLE 7

It is also clear that the higher the maximum potential flux, the better able the sliver can manage the fluid. A 50,000 denier sliver made from 26 dpf, 6 in. staple, helically crimped, 5 crimps per inch with a shape factor of 3.99, an MPF of about 800 cc/h/g and a breaking strength of 168 grams was shown to be very useful in this end use. Slivers can easily be made from fiber having maximum potential flux as high as 2700 cc/g/hr. Other things being equal (softness, breaking strength, appearance, etc.) the higher the maximum potential flux the better.

Unless otherwise specified, all parts, percentages, etc., are by weight.

The invention has been described in detail with particular reference to preferred embodiments thereof, but it will be understood that variations and modifications can be effected within the spirit and scope of the invention. Moreover, all patents, patent applications (published or unpublished, foreign or domestic), literature references or other publications noted above are incorporated herein by reference for any disclosure pertinent to the practice of this invention.

We claim:

1. An absorbent head band for protecting skin and eyes from irritation or other unpleasant sensations caused by contact with liquids used in cosmetology comprising a sliver of spontaneously wettable fibers, said sliver having a size of about 30,000–100,000 denier, the fibers of said sliver being held together by a binder such as to have a tensile strength of between 100 and 2000 grams, said fibers having a dpf of 3–30, a staple length of 1½–6 inches, a shape factor of 1.5–5 and a maximum potential flux of at least 75 cc/g/hr using a liquid having a surface tension of about 60–65 dynes/cm and a viscosity of about 1 centipoise.

2. A head band according to claim 1 wherein said sliver has a size of about 40,000–60,000 denier.

3. A head band according to claim 1 wherein said fibers have a staple length of about 2–3 inches.

4. A head band according to claim 1 wherein said sliver has a tensile strength of about 150–1000 grams.

5. A head band according to claim 1 wherein the fibers therein satisfy the following equation $$(1-X\cos\theta_a)<0,$$

wherein $\theta_a$ is the advancing contact angle of water measured on a flat film made from the same material as the fiber and having the same surface treatment, if any, X is a shape factor of the fiber cross-section that satisfies the following equation $$x=\frac{P_w}{4r+(\pi-2)D}$$

wherein $P_w$ is the wetted perimeter of the fiber and r is the radius of the circumscribed circle circumscribing the fiber cross-section and D is the minor axis dimension across the fiber cross-section.

6. A head band according to claim 1 wherein the fibers therein satisfy the following equation $$(1-X\cos\theta_a)<-0.7,$$

wherein $\theta_a$ is the advancing contact angle of water measured on a flat film made from the same material as the fiber and having the same surface treatment, if any, X is a shape factor of the fiber cross-section that satisfies the following equation $$x=\frac{P_w}{4r+(\pi-2)D}$$

wherein $P_w$ is the wetted perimeter of the fiber and r is the radius of the circumscribed circle circumscribing the fiber cross-section and D is the minor axis dimension across the fiber cross-section.

7. A head band according to claim 1 wherein the fibers therein satisfy the following equation $$(1-X\cos\theta_a)<0,$$

wherein $\theta_a$ is the advancing contact angle of water measured on a flat film made from the same material as the fiber and having the same surface treatment, if any, X is a shape factor of the fiber cross-section that satisfies the following equation $$x=\frac{P_w}{4r+(\pi-2)D}$$

wherein $P_w$ is the wetted perimeter of the fiber and r is the radius of the circumscribed circle circumscribing the fiber cross-section and D is the minor axis dimension across the fiber cross-section, and wherein the maximum potential flux of said fiber is at least 75 cc/g/hr when measured using a liquid having a surface tension of about 60–65 dynes/$cm^2$.

8. An absorbent head band according to claim 1 wherein the fibers are polyethylene terephthalate having an I.V. of about 0.62–0.64 and have a shape generally as shown in FIG. 9, have a denier per filament of about 6, and the sliver has a denier of about 50,000–60,000.

* * * * *